US005250937A

United States Patent [19]

Kikuo et al.

[11] Patent Number: 5,250,937

[45] Date of Patent: Oct. 5, 1993

[54] HALF TONE LIQUID CRYSTAL DISPLAY CIRCUIT WITH AN A.C. VOLTAGE DIVIDER FOR DRIVERS

[75] Inventors: Ono Kikuo, Hitachi; Kohji Takahashi, Chiba; Nobutake Konishi, Hitachiohta; Jun-ichi Ohwada, Mobara; Takeshi Tanaka, Hitachi, all of Japan

[73] Assignee: Hitachi, Ltd., Tokyo, Japan

[21] Appl. No.: 666,900

[22] Filed: Mar. 8, 1991

[30] Foreign Application Priority Data

Mar. 8, 1990 [JP] Japan ..... 2-57781

[51] Int. Cl.[5] ..... G09G 3/36

[52] U.S. Cl. ..... 345/89; 345/94; 345/101

[58] Field of Search ..... 340/784, 811, 765, 793

[56] References Cited

U.S. PATENT DOCUMENTS 4,562,478 12/1985 Hirasawa et al. ..... 340/784
4,684,939 8/1987 Streit ..... 340/784
4,808,990 2/1989 Kamigaki et al. ..... 340/784
5,034,734 7/1991 Iguchi ..... 340/784
5,061,920 10/1991 Nelson ..... 340/784
5,066,945 11/1991 Kanno et al. ..... 340/784
5,109,219 4/1992 Kasten et al. ..... 340/784

*Primary Examiner*—Jeffery Brier
*Attorney, Agent, or Firm*—Antonelli, Terry, Stout & Kraus

[57] ABSTRACT

A half tone liquid crystal display circuit is disclosed including a voltage divider using as a reference voltage a voltage which is approximately determined on the basis of a point of intersection of the extensions of straight lines along the gradients of brightness-voltage characteristics corresponding to at least two observation angles vertically different with respect to a liquid crystal display panel having a TFT active matrix structure to generate driving voltages for the half tone displays associated with a voltage varied to correspond to the observation angles; and a correcting voltage waveform generator for generating a dynamic observation angle correcting voltage varied in association with a vertical scanning operation corresponding to the difference in the vertical observation angles of a liquid crystal display frame. The half tone driving voltages generated by the voltage divider from the dynamic observation angle correcting voltage are subjected to level modulations.

30 Claims, 36 Drawing Sheets

(a)
(b)
DU
VSSH 1
UD00 2
UD01 3
UD02 4
UD03 5
UD10 6
UD11 7
UD12 8
UD13 9
UD20 10
UD21 11
UD22 12
UD23 13
CL1 14
VDDH 15
CL2U 16
VEEH 17
VCOM 18
V0U 19
V1U 20
V2U 21
V3U 22
V4U 23
V5U 24
V6U 25
V7U 26
VSSV 27
VDDV 28
VEEV 29
30
DL
VSSH 1
LD00 2
LD01 3
LD02 4
LD03 5
LD10 6
LD11 7
LD12 8
LD13 9
LD20 10
LD21 11
LD22 12
LD23 13
CL1 14
VDDH 15
CL2L 16
VEEH 17
VCOM 18
V0D 19
V1D 20
V2D 21
V3D 22
V4D 23
V5D 24
V6D 25
V7D 26
VSSV 27
FLM 28
CL3 29
30
IC22
T4
T5
D1
ZD3
T7
T6
F3
VCC
VC
VZ
IC3
VEE
V1(-)
VRE
COMP
V1(+)
D4
ZD4
IC1

HALF TONE LIQUID CRYSTAL DISPLAY CIRCUIT WITH AN A.C. VOLTAGE DIVIDER FOR DRIVERS

BACKGROUND OF THE INVENTION (a) Field of the Invention

The present invention relates to a half tone liquid crystal display circuit and, more particularly, to a technology which is effective when applied to a color liquid crystal display circuit having a TFT active matrix structure for multi-color displays by a digital method.

(b) Description of the Prior Art

The color liquid crystal display circuit having the active matrix structure mounting TFTs (i.e., Thin Film Transistors) thereon is disclosed on pp. 211 of "Nikkei Electronics" published on Sept. 10, 1984 by Nikkei McGraw-Hill, for example.

The TFT liquid crystal display circuit is used as a small-sized low-power-consumption display circuit mainly for a monitor in a microcomputer system but is highly desired to have half-tone multi-color display as the display circuit in an office automation system.

For the half tone display using the liquid crystal display panel of the TFT active matrix structure, it is necessary to use a linear region in the brightness-voltage characteristics of the liquid crystal. However, the brightness-voltage characteristics in the liquid crystal highly fluctuate in dependence upon the vertical observation angle, as shown in FIG. 31. The angle of view or observation angle range, in which the color tone is maintained over a half tone, is found as small as about 9 degrees if it is determined from the transmissivity of each scale set at an observation angle of 0 degrees for the display panel. As shown in FIG. 31, each scale is varied in the direction to have the transmissivity reduced as a whole, i.e., toward the black level. As a result, the multi-color display to express delicate color tones for 512 colors, for example, is not practically possible.

In case, therefore, the observation angle is varied, as above, it is possible to vary the driving voltages corresponding to the individual scales. In this case, according to the simplest concept, it is possible to make the driving voltages adjustable to correspond to the individual scale displays. According to this adjustment, however, as many as eight portions have to be adjusted each time the observation angle is varied for the display of eight scales. The number of these combinations is so great as to prevent practical applications. For these reasons, the color liquid crystal display circuit of the prior art prepares the eight colors by combining the monotones of red, green and blue colors without using the linear portion of the aforementioned brightness-voltage characteristics. In this monotone case, the driving voltages can be generated with margins sufficient for preventing the fluctuations of the aforementioned brightness-voltage characteristics using the observation angle.

We have discovered that the brightness (transmissivity)-voltage characteristics are approximately varied with a constant reference voltage against the aforementioned vertical observation angle in the liquid crystal. By making use of this reference voltage, moreover, we have developed a display driving voltage generator which makes adjustments for the variations of the observation angle for the half tone displays by using the region in which the transmissivity of the liquid crystal linearly varies.

An object of the present invention is to provide a half tone liquid crystal display circuit which adjusts the half tone display simply and, accurately for the variations of the vertical observation angle.

Another object of the present invention is to provide a half tone liquid crystal display circuit which produces a multi-color display of high quality.

The aforementioned and other objects and novel features of the present invention will become apparent from the following description to be made with reference to the accompanying drawings.

SUMMARY OF THE INVENTION

The summary of one embodiment of the present invention to be disclosed hereinafter will be briefly described in the following. Specifically, there is provided an observation angle correcting method in the half tone display of a liquid crystal, comprising the steps of: generating an approximate reference voltage from a voltage which is approximately determined on the basis of a point of intersection of the extensions of straight lines along the gradients of brightness-voltage characteristics corresponding to at least two observation angles vertically different with respect to a liquid crystal display panel; generating a voltage which is varied to correspond to said observation angles; and generating driving voltages for the half tone displays, which are corrected by a divided voltage associated with said voltage. The driving voltages thus generated are fed to the signal line electrodes of the liquid crystal display panel having the TFT active matrix structure for the half tone displays.

According to the above-specified means, the plural driving voltages for the half tones can be varied by the adjustment of one portion along the gradients of the brightness-voltage characteristics corresponding to those observation angles so that the tone displays for the vertical variations of the observation angles can be adjusted simply and; accurately. As a result, a multi-color display for 512 colors, for example, can be realized for practical use by using the liquid crystal display circuit having the TFT active matrix structure.

The summary of a second embodiment of the present invention to be disclosed hereinafter will be briefly described in the following. Specifically, there is provided a half tone liquid crystal display circuit, characterized: in that, by using as a reference voltage a voltage which is approximately determined on the basis of a point of intersection of the extensions of straight lines along the gradients of brightness-voltage characteristics corresponding to at least two observation angles vertically different with respect to a liquid crystal display panel having a TFT active matrix structure, driving voltages for the half tone displays associated with a voltage varied to correspond to said observation angles are generated; and in that operating voltages having inverted polarities are fed to a circuit for generating said reference voltage in accordance with a liquid crystal AC conversion signal and a voltage dividing circuit. The reference voltage is subjected to an automatic temperature compensation by a temperature compensator corresponding to the temperature dependency thereof. A packaged substrate having a voltage supply circuit for generating the half tone driving voltages is superposed on the back of a liquid crystal display panel across a back light.

According to the above-specified means, the plural half tone driving voltages can be varied along the gradients of the brightness-voltage characteristics corresponding to the observation angles by adjusting only one portion, so that the scale displays can be adjusted easily and, accurately for the vertical variations of the observation angles. Despite packaging the substrate for the half tone liquid crystal display circuit with a relatively large number of elements, the size can be prevented from being large-sized, as viewed from the front.

The summary of a third embodiment of the present invention to be disclosed hereinafter will be briefly described in the following. Specifically, there is provided a half tone liquid crystal display circuit, comprising: a voltage divider for using as a reference voltage a voltage which is approximately determined on the basis of a point of intersection of the extensions of straight lines along the gradients of brightness-voltage characteristics corresponding to at least two observation angles vertically different with respect to a liquid crystal display panel having a TFT active matrix structure, to generate driving voltages for the half tone displays associated with a voltage varied to correspond to said observation angles are generated; and a correcting voltage waveform generator for generating a dynamic observation angle correcting voltage varied in association with a vertical scanning operation corresponding to the difference in the vertical observation angles of a liquid crystal display frame, wherein the half tone driving voltages generated by said voltage divider from said dynamic observation angle correcting voltage are subjected to level modulations.

According to the above-specified means, a plurality of half tone driving voltages can be varied along the gradients of the brightness-voltage characteristics corresponding to those observation angles by adjusting one portion. As a result, the scale displays for the static vertical variations of the observation angles can be adjusted simply but accurately and can be automatically corrected for the dynamic vertical variations.

DESCRIPTION OF THE PREFERRED EMBODIMENTS

Figure 1:
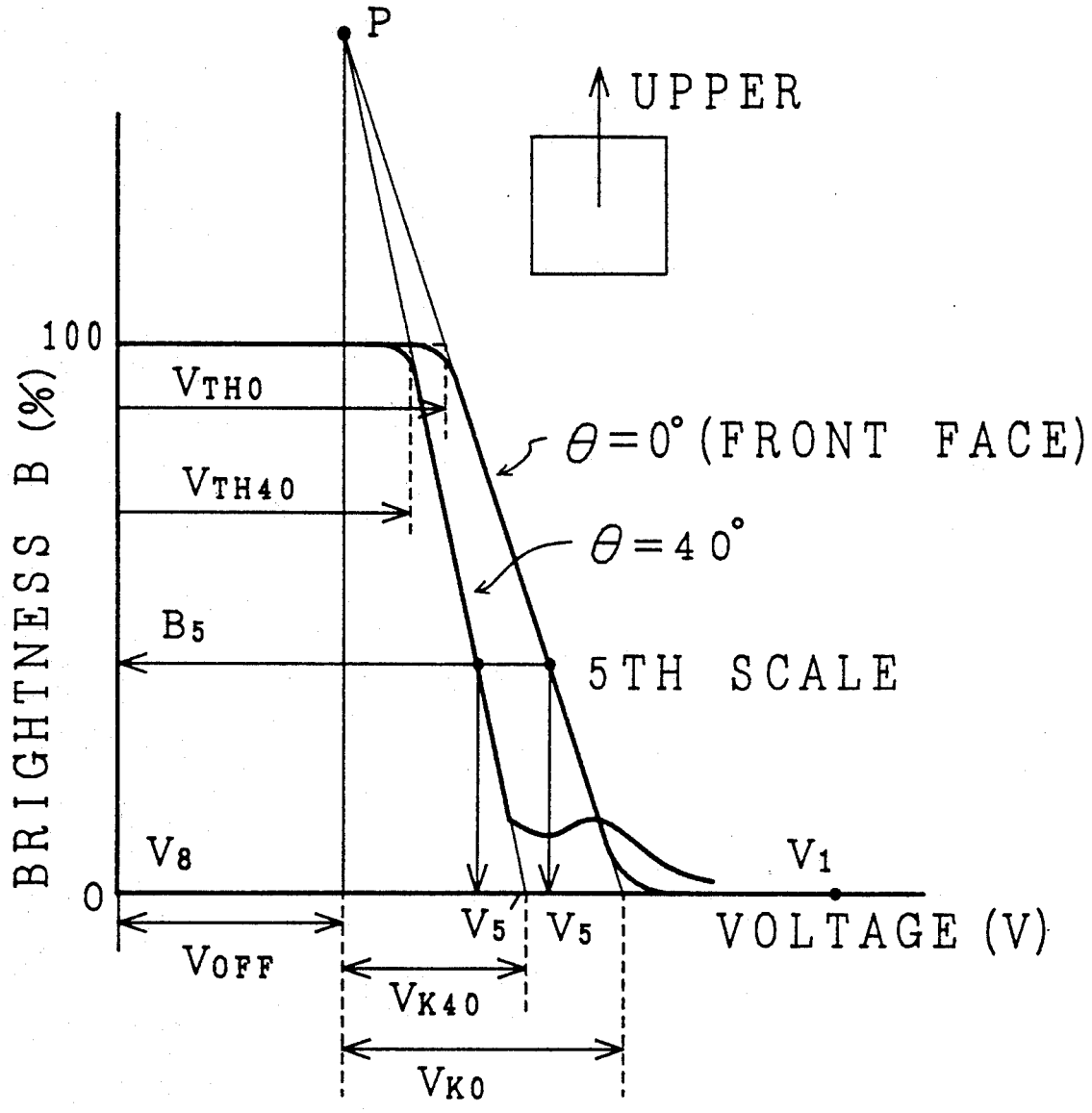
FIG. 1 is a diagram for explaining the principle of the observation angle correcting method in the half tone liquid crystal display according to the present invention.

FIG. 1 presents a characteristic diagram for explaining the observation angle correcting method in a half tone liquid crystal display circuit according to the present invention.

In FIG. 1, the ordinate plots the brightness (or transmissivity of a liquid crystal) B, and the abscissa plots the voltage V to be applied between the two electrodes of the liquid crystal. A characteristic curve for $\theta=0$ degrees plots an observation angle corresponding to the front face (or normal line) of the liquid crystal, and a characteristic curve for $\theta=40$ degrees plots an observation angle inclined at an elevation of 40 degrees with respect to the normal line. If the observation angle is thus varied from 0 to 40 degrees, the zone of the characteristic curve, in which the brightness is linearly varied, is shifted leftward as a whole. In order to achieve eight scales, for example, the voltage $V_5$ may be varied to $V_5'$ so that an equal brightness such as the intermediate 5th scale may be obtained when the observation angle is varied in the aforementioned manner. Despite this concept, however, the characteristic curve for $\theta=0$ degrees is shifted leftward in parallel and the gradient of brightness for the voltage is also varied when the observation angle is varied to 40 degrees as above. Thus, the remaining seven scales have to be individually subjected to the voltage correction, as has been described hereinbefore, so that the combinations are too great; for practical use.

We have carefully observed the aforementioned characteristic curves for $\theta=0$ degrees and $\theta=40$ degrees and have discovered that the following laws dominate the variations of the characteristic curves. Specifically, the characteristic curve for the observation angle $\theta=40$ degrees is varied from that for the observation angle $\theta=0$ degrees such that it is shifted leftward in its entirety and has an increased gradient. From these characteristic variations of the characteristic curves for the variations of the observation angles, the zones of the two curves, in which the brightness linearly varies, are approximated by straight lines, and these lines are extended upward. Then, the extensions of these two straight lines thus approximated by thin lines in FIG. 1 have a point of intersection P in the upper portion of the characteristic diagram. On the other hand, the two straight lines have individual intersection points with the abscissa if they are extended downward.

If perpendiculars are drawn from the point P to the abscissa (or voltage axis), it is possible to draw two right triangles having the perpendicular as their bases. In other words, the oblique side of a rectangular triangle, which has a reference voltage ($V_{OFF}$) corresponding to the aforementioned intersection point P and a height of a voltage (which may be called the "observation angle correcting voltage" in the following) $V_{KO}$ determined from the intersection point with the aforementioned abscissa (or voltage axis), corresponds to the aforementioned characteristic curve for $\theta=0$ degrees.

The oblique side of a right triangle, which is formed by varying the observation angle correcting voltage $V_{K40}$ for the aforementioned reference voltage ($V_{OFF}$), corresponds to the aforementioned characteristic curve for $\theta=40$ degrees. Thus, it is found that the voltage $V_5'$ for $\theta=40$ degrees can be automatically obtained, merely by varying the aforementioned voltage $V_{KO}$ or the height of the rectangular triangle, from the voltage $V_5$ for $\theta=0$ degrees corresponding to an intermediate scale, which is obtained by dividing the oblique side of the aforementioned two rectangular triangles at an identical ratio, namely, the brightness (of the 5th scale) B5, as exemplified as a representative in FIG. 1.

In other words, when the eight scales are to be obtained by dividing the oblique side of the right triangles, which correspond to brightnesses (or transmissivities) of 0 to 100%, equally into eight parts, liquid crystal driving voltages for obtaining the eight scales equally divided can be determined merely by adjusting the voltage $V_{KO}$, which corresponds to the brightness 0 determined from a straight line approximating the gradient of the aforementioned characteristic curve, at one portion such as $V_{K40}$ in a manner to correspond to the variations of the observation angle. The reference voltage $V_{OFF}$ can be deemed as one kind of offset voltage with respect to the aforementioned voltage $V_{KO}$ or $V_{K40}$. Hence, the reference voltage is expressed as the voltage $V_{OFF}$ in FIG. 1.

In the description thus far made, the characteristic curve in the zone, in which the brightness of the liquid crystal is linearly varied with the variation of the voltage, is approximated by the straight line. As a matter of fact, however, the characteristic curve has a turnover point, at which the brightness will rise again if the voltage is raised, in the vicinity of a point at which the brightness is 0. Since this turnover point is varied with the variation of the aforementioned observation angle, the voltage for establishing the 1st scale corresponding to the brightness 0 so as to eliminate these influences is set at a high fixed level such as the voltage $V_1$ with a margin sufficient for avoiding the influences of the turnover characteristics of the aforementioned characteristic curves. Therefore, the aforementioned voltages $V_{KO}$ and $V_{K40}$ are exclusively determined as the adjusting voltages for correcting the observation angle but are not used as the actual liquid crystal driving voltages.

Figure 2:
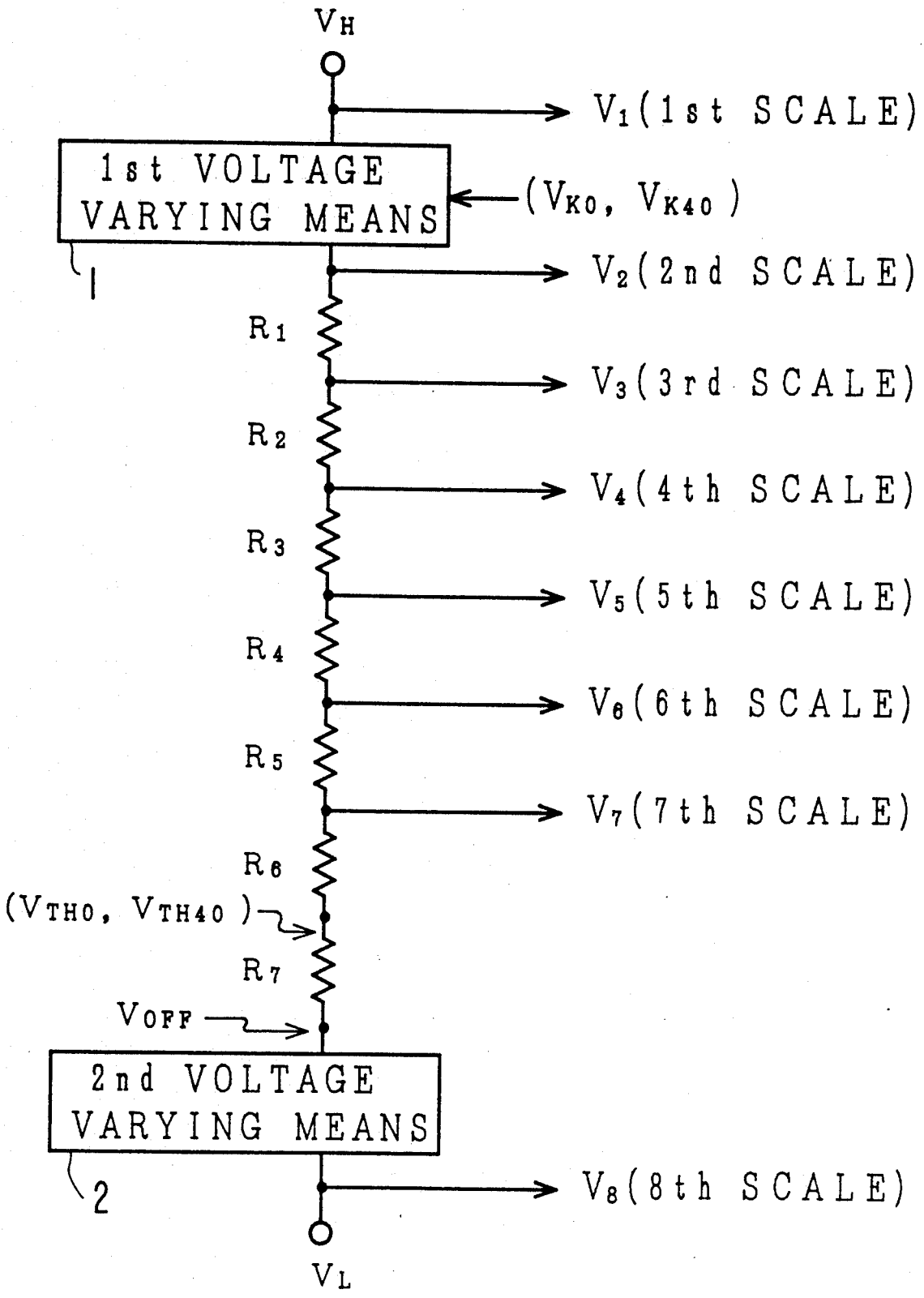
FIG. 2 is a circuit diagram showing one embodiment of a driving voltage generator having an observation angle correcting function in the half tone display.

FIG. 2 is a fundamental circuit diagram showing one embodiment of a driving voltage generator having a observation angle correcting function in a half tone display.

A voltage $V_H$ at a high level is used as a liquid crystal driving voltage $V_1$ corresponding to the 1st scale corresponding to the white level of transmissivity 100%. This voltage $V_H$ is applied through voltage varying means 1 to a resistor $R_1$ which is positioned at one end of a series voltage dividing resistance circuit $R_1$ to $R_7$. The remaining series voltage dividing resistors $R_1$ to $R_6$ generate six liquid crystal driving voltages $V_2$ to $V_7$, which correspond to the 2nd to 7th scales, at their mutual nodes. When the 1st to 8th eight scales are to be established by making the seven equal divisions of transmissivities from 0 to 100%, the aforementioned series resistance circuit $R_1$ to $R_6$ is given a mutually equal resistance. On the other hand, the resistor $R_7$ is used to generate the so-called observation threshold voltage $V_{TH0}$ or $V_{TH40}$, at which the transmissivity begins to vary from 100% in the characteristic diagram of FIG. 1. For the voltage $V_{KO}$ corresponding to $\theta=0$ degrees, for example, the voltage, which is generated by the division at the ratio between the resistance of the aforementioned resistor $R_7$ and the composite resistance of the series resistance circuit $R_1$ to $R_6$, is set to the level corresponding to the threshold voltage $V_{THO}$. The voltage of ($V_{KO}-V_{THO}$) is equally divided into seven parts at the ratio of the resistances of the aforementioned series resistance circuit $R_1$ to $R_6$. The resistor $R_7$ at the other end of the series voltage dividing resistance circuit is connected with a voltage $V_L$ at the lower level through voltage varying means 2 for generating the aforementioned reference voltage $V_{OFF}$. The voltage $V_L$ is used as a liquid crystal driving voltage $V_8$ corresponding to the 8th scale for generating the black level of transmissivity 0% with a sufficient margin.

According to this structure, a voltage corresponding to the variation of the observation angle $\theta$ such as the aforementioned voltage $V_{KO}$ or $V_{K40}$ of FIG. 1 can be obtained by varying the level of the voltage to be generated by the aforementioned voltage varying means 1. As has been described above, the voltage $V_{KO}$ or $V_{K40}$ is not extracted as the output, because it is not used as the actual liquid crystal driving voltage, but is in fact one existing in the aforementioned voltage varying means 1. By varying the voltage to the level $V_{KO}$ or $V_{K40}$ by the voltage varying means 1, the individual liquid crystal driving voltages $V_2$ to $V_7$ corresponding to the aforementioned six scales can be obtained in association with those variations.

The resistor is divided into the resistors $R_6$ and $R_7$, as described above, so as to facilitate understanding of the present invention. Despite this description, however, the voltage corresponding to the aforementioned threshold voltage $V_{THO}$ obtained from the node of the resistors $R_6$ and $R_7$ is not used as the liquid crystal driving voltage. In an actual circuit, therefore, the resistors $R_6$ and $R_7$ can be replaced by one resistor, as will be shown in FIG. 10.

In this embodiment, the reference voltage $V_{OFF}$ can be adjusted by the voltage varying means 2. This adjustment is required for the dispersion of the characteristics of the liquid crystal elements and for temperature compensations, as will be described hereinafter. These temperature compensations will be described in detail in the following.

Figure 3:
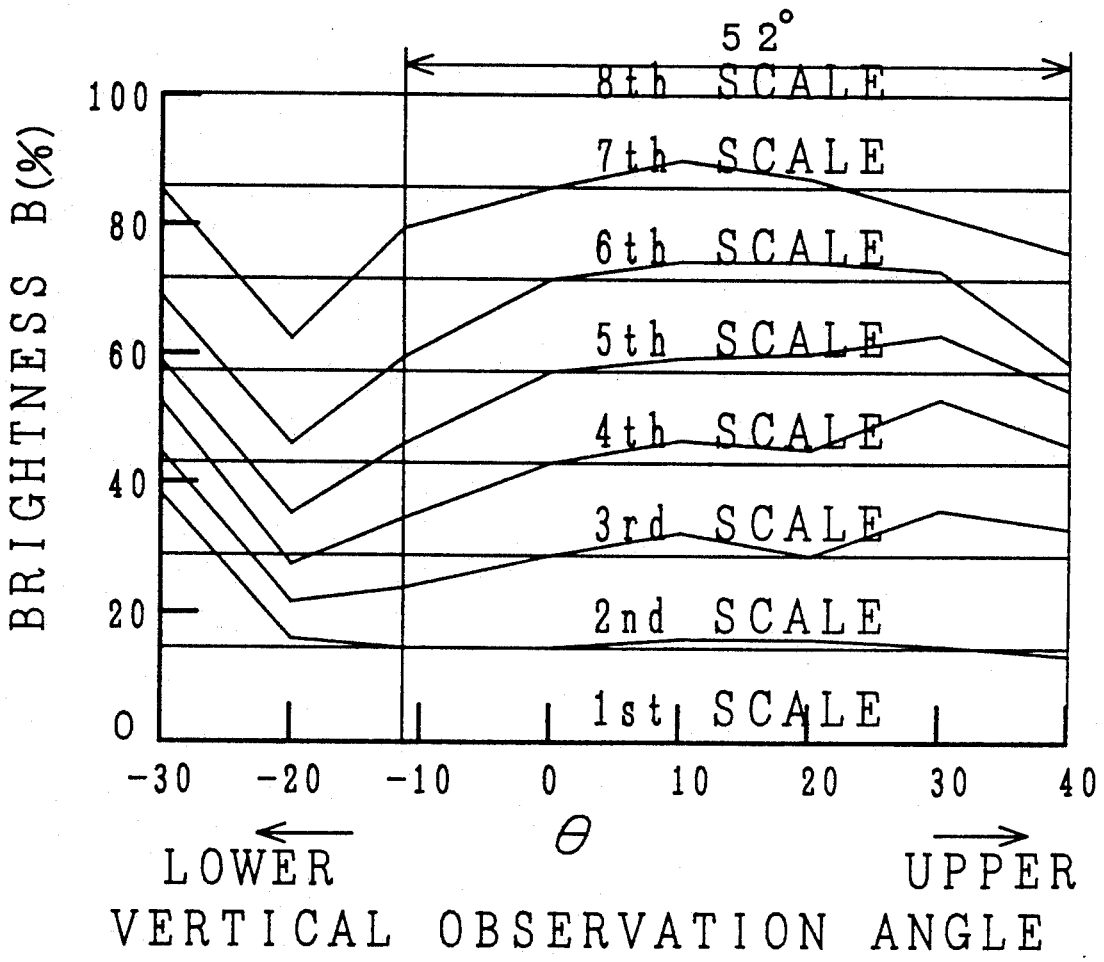
FIG. 3 is a diagram showing the curves of the brightness-observation angle using the aforementioned voltage varying means 1.

FIG. 3 shows one example of curves of brightness-observation angle obtained by the adjustments using the aforementioned voltage varying means 1.

In FIG. 3, the individual intermediate scales, i.e., the 2nd to 7th scales are used as parameters. By the adjustment of one portion by the voltage varying means 1, as shown in FIG. 3, the transmissivity (or brightness) for the observation angle $\theta$ can be confined within the range of the observation angle of about 52 degrees and within a color tone discrepancy of a half scale. As a result, the observer is enabled to make an adjustment easily to a correct color tone within the aforementioned range of observation angle in accordance with an arbitrary observation angle.

Figure 4:
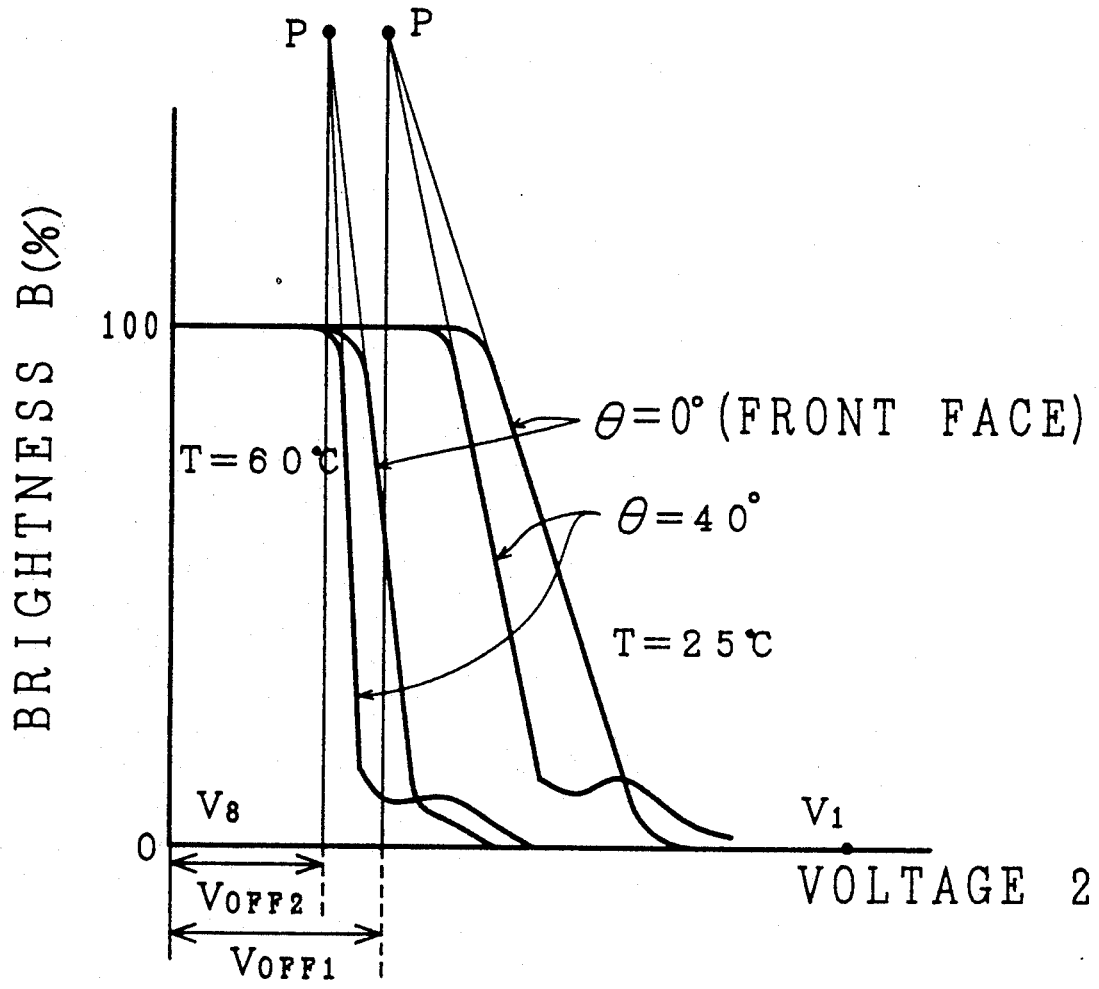
FIG. 4 is a characteristic diagram for explaining the principle of the observation angle correcting method while considering the temperature characteristics in the half tone liquid crystal display according to the present invention.

FIG. 4 is a characteristic diagram for explaining the principle of the observation angle correcting method while considering the temperature characteristics in the half tone liquid crystal display of the present invention.

It is known that the liquid crystal has its brightness-voltage characteristics varied even with the variation of the temperature, as shown in FIG. 4. We have carefully observed the characteristic curves at temperatures T=25° C. and T=60° C. and have discovered that the variations of the aforementioned characteristic curves are dominated by the following fixed laws even if the temperature is varied. Specifically, even if the temperature is varied to T=60° C. with respect to the reference voltage $V_{OFF1}$, which is determined from a point of intersection P of two straight lines approximating the characteristic curves for the observation angles $\theta=0$ degrees and $\theta=40$ degrees at the temperature T=20° C., so that a point of intersection P; is determined from two straight lines approximating the characteristic curves for the observation angles $\theta=0$ degrees and $\theta=40$ degrees at the temperature T=25° C. The reference voltage $V_{OFF2}$ is determined from that intersection point P1. In short, we have discovered that, if the temperature is varied, as above, the reference voltage $V_{OFF}$ is accordingly varied. In the driving voltage generator shown in FIG. 2, the voltage varying means 2 can be used for the aforementioned temperature compensations.

Figure 5:
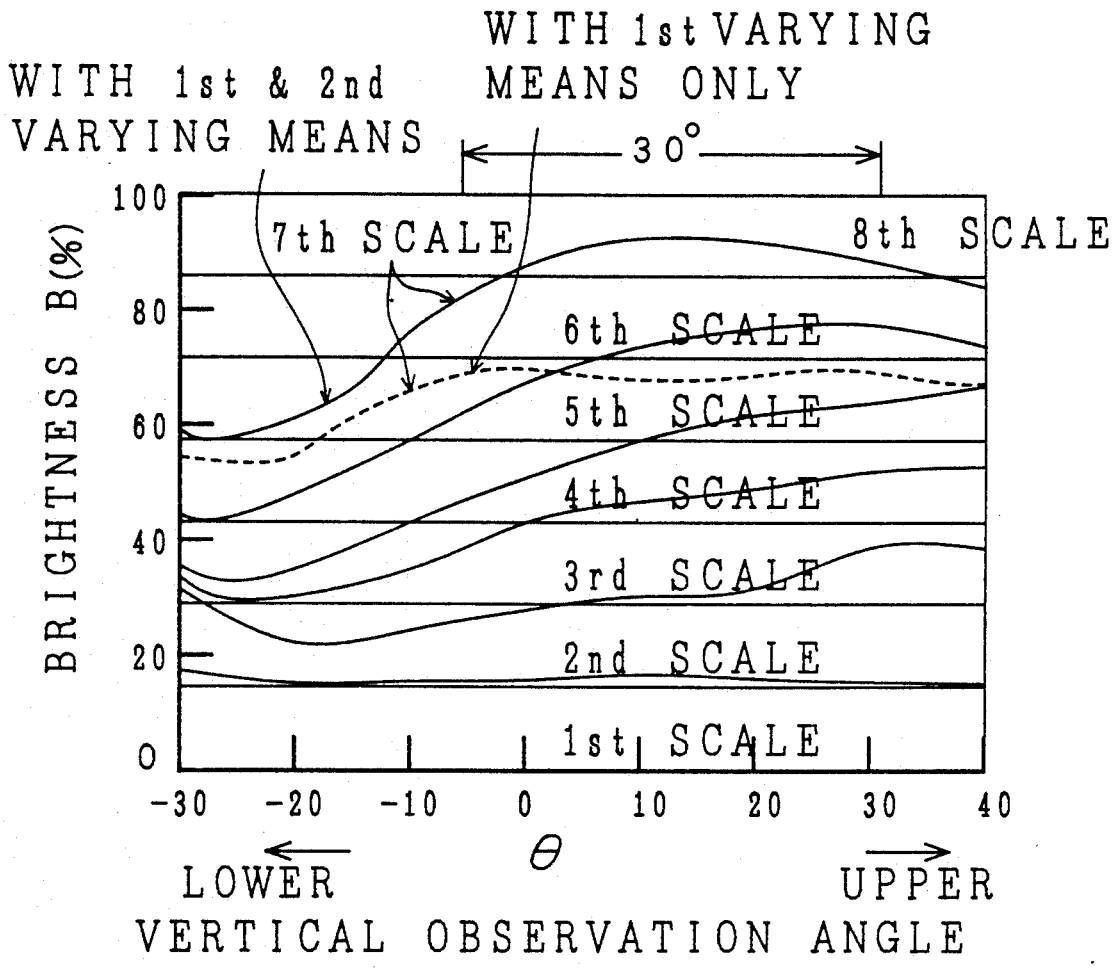
FIG. 5 is a diagram showing the brightness-observation angle using the aforementioned voltage varying means 1 and 2.

FIG. 5 shows one example of curves of brightness—observation angle by the voltage adjustments using the aforementioned voltage varying means 1 and 2. In FIG. 5, the characteristic curves, as indicated by solid lines, present the observation angle characteristics of the individual intermediate scales in case the aforementioned voltage varying means 2 is adjusted, at a temperature T=60° C. in case the reference voltage $V_{OFF2}$ is set to 1.2 V by setting the voltage $V_1$ of the 1st scale to 8 V in FIG. 4. The observation angle, at which the discrepancies of the individual scales are confined within the half scale, exhibits a value as wide as about 30 degrees. If, however, the reference voltage $V_{OFF1}=1.7$ V set at T=25° C. is used as it is, as exemplified by the 7th scale in a broken curve in FIG. 5, the transmissivity is seriously reduced to make the adjustment of color tone impossible.

In the observation angle correcting method in the half tone liquid crystal display according to the present invention, as has been described hereinbefore, the driving voltage $V_8$ at the white level or the maximum brightness and the driving voltage $V_1$ at the black level or the minimum brightness are the fixed ones which are set with voltage margins sufficient for the variations of the observation angle and the temperature, as described above. As a result, the two driving voltages are made independent of the variations of the voltage varying means 1 and 2 because of the aforementioned observation angle corrections and temperature corrections of the intermediate scales. Thus, the observation angle correcting method is advantageous in that the maximum contrast; in the monochromatic display or the contrast; in the basic eight colors in the color panel are not dropped even if the aforementioned voltage varying means 1 or 2 is operated. The adjustments of the reference voltage $V_{OFF}$ by the voltage varying means 2 for the aforementioned temperature compensations can be automated by using a temperature compensation circuit, as will be described in the following. As a result, the observation angle corrections in the half tone display can be accomplished substantially by adjusting one portion, to provide a half tone liquid crystal display circuit which is conveniently used for the observer.

Figure 6:
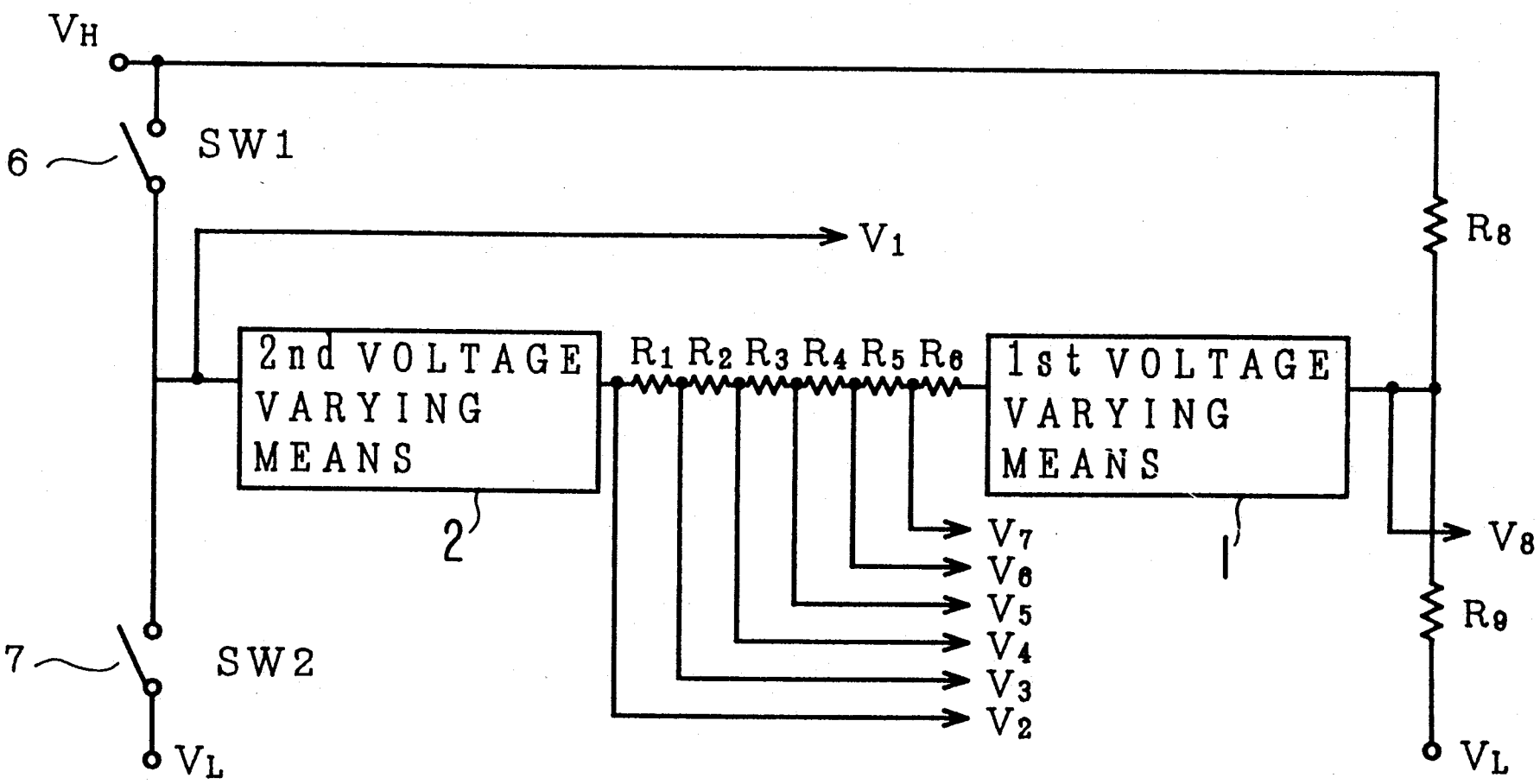
FIG. 6 is a circuit diagram showing one embodiment of a liquid crystal driving voltage for the half tone display.

FIG. 6 is a circuit diagram showing one embodiment of a liquid crystal driving voltage generator for the half tone display.

In order to eliminate a DC component in the driving voltage to be applied to the liquid crystal, the liquid crystal display circuit has to be driven with an AC current which has its polarities alternately inverted to positive/negative polarities for each frame. Positive and negative driving voltages are necessary for such AC drive. It is, therefore, possible to generate driving voltages corresponding to the positive and negative polarities by providing two sets of the circuit, as shown in FIG. 2. With this, however, the circuit scale is enlarged, and the positive and negative driving voltages are caused to fail to coincide correctly under the influences of the dispersion of the element characteristics. If the positive and negative driving voltages have such dispersion, this dispersion is applied as a DC component to the liquid crystal, thus causing a problem that the liquid crystal has its display lifetime seriously shortened.

In order to solve the above-specified problem, according to this embodiment, the positive and negative liquid crystal driving voltages are generated by using the aforementioned one circuit, as shown in FIG. 2.

The voltage $V_H$ at the high level and the voltage $V_L$ at the low level are applied to and divided by a series circuit of resistors $R_8$ and $R_9$ so that the center voltage is outputted as the aforementioned driving voltage $V_8$. At the side of this center voltage $V_8$, there is disposed the aforementioned voltage varying means 2 for generating the aforementioned reference voltage $V_{OFF}$, which is fed to the resistor $R_6$ of the series resistance circuit composed of the resistors $R_1$ to $R_6$ for generating the six scale voltages $V_2$ to $V_7$. At the resistor $R_1$ of the other end of the series resistance circuit, there is disposed the voltage varying means 1. In order to generate the aforementioned driving voltages for conversion into the AC current, this voltage varying means 1 is alternately fed with the aforementioned voltage $V_H$ at the high level through a switch SW1 and the aforementioned voltage $V_L$ at the low level through a switch SW2. For an odd frame, for example, the switch SW1 is turned on so that the driving voltages $V_1$ to $V_8$ in the positive polarity are generated by the high level $V_H$ and the center voltage $V_8$. For an even frame, on the other hand, the switch SW2 is turned on so that the driving voltages $-V_1$ to $-V_8$ are generated by the low level $V_L$ and the center voltage $V_8$. The driving voltages $V_1$ to $V_8$ are switched in the time-sharing manner to the positive and negative polarities. The voltages $V_H$ and $V_L$ to be alternately fed by the aforementioned switches SW1 and SW2 are used as the aforementioned driving voltages $V_1$ or $-V_1$ corresponding to the aforementioned first scale.

According to this structure, the driving voltages in the positive and negative polarities for the AC drive of the liquid crystal can be generated by the common voltage varying means 1 and 2 for the aforementioned observation angle corrections and temperature compensations and the series resistors. As a result, the circuit can be simplified, and the driving voltages in the positive and negative polarities can be correctly matched, so that no DC voltage is applied to the liquid crystal when it is alternately driven in the positive and negative polarities.

Figure 7:
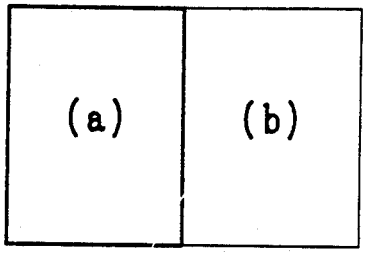
FIG. 7 is a block diagram showing one embodiment of a TFT liquid crystal display circuit according to the present invention.
Figure 7:
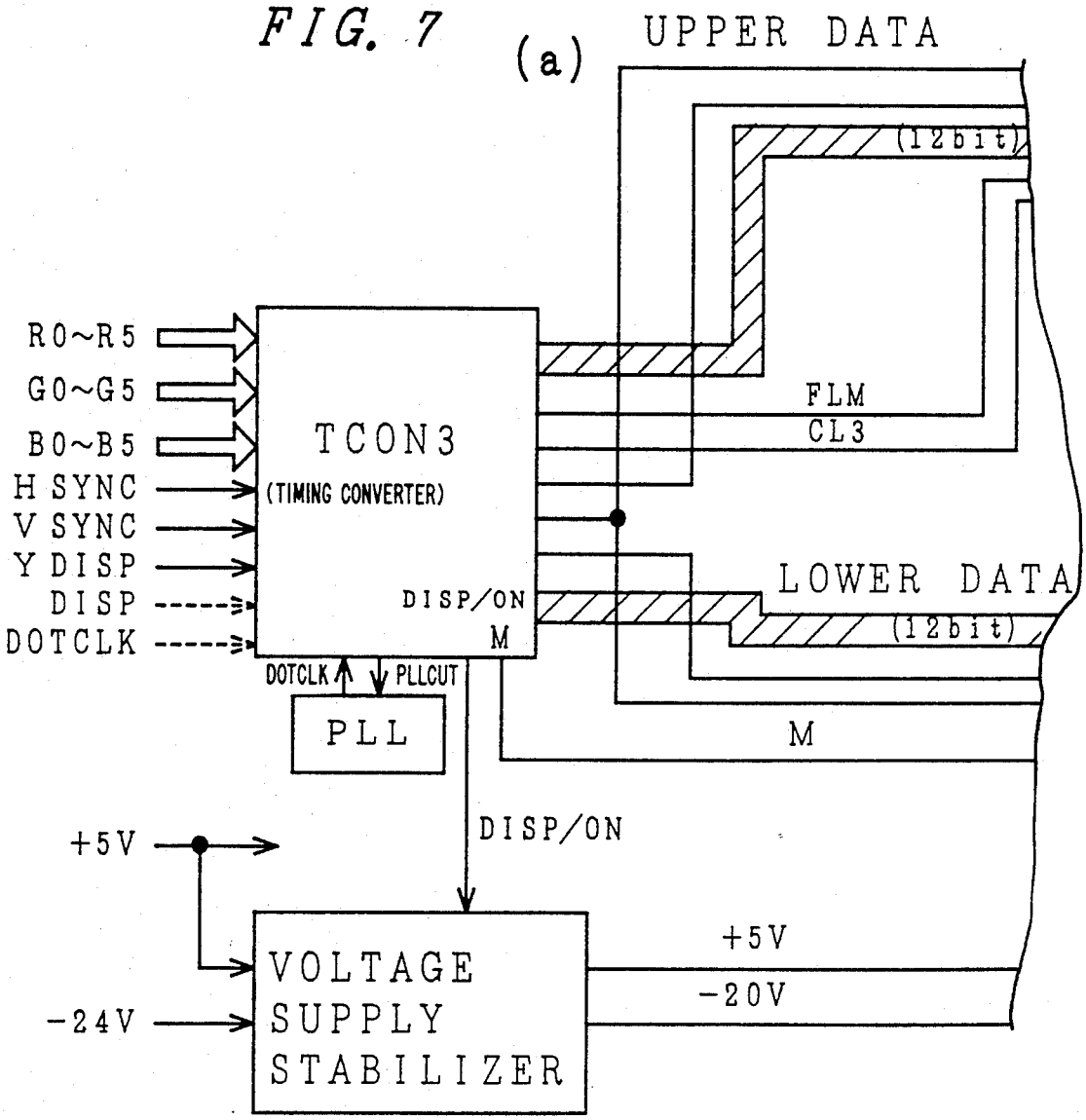
Figure 7:
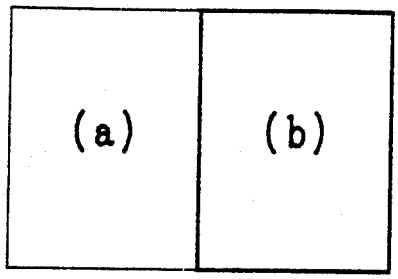
Figure 7:
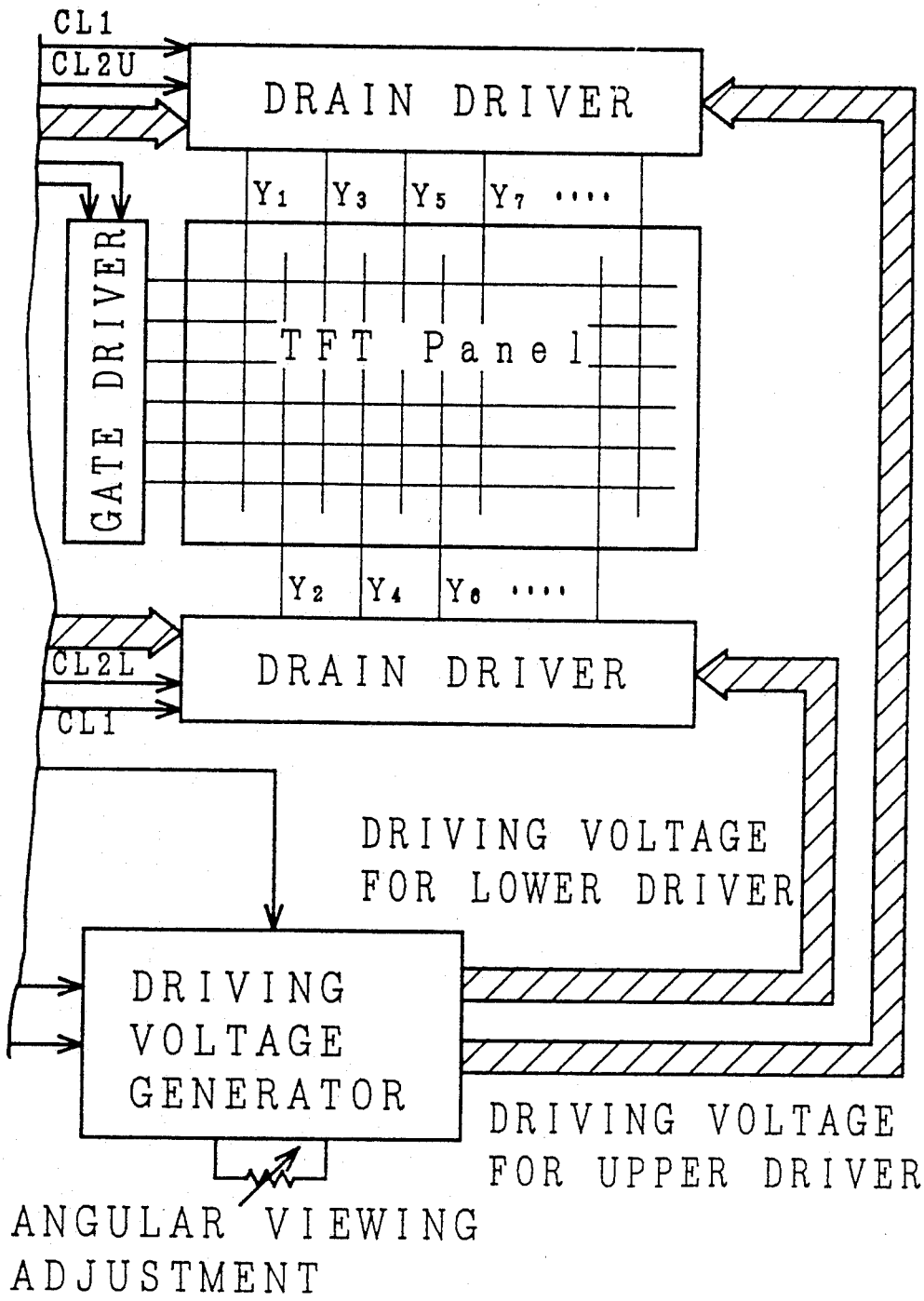

FIG. 7 is a block diagram showing one embodiment of a TFT liquid crystal display circuit according to the present invention.

This liquid display display circuit of FIG. 7 is directed to color displays for displaying 512 colors.

An interface corresponding to a microcomputer system or the like is composed of a timing converter TCON3. This timing converter receives color data R0 to R5, G0 to G5 and B0 to B5 corresponding to the R, G and B inputs of a standard color CRT (i.e., Cathode Ray Tube), a horizontal synchronizing signal HSYNC, a vertical synchronizing signal VSYNC, a display timing signal YDISP and so on, and converts them into TFT liquid crystal driving signals for the multi-color display. Reference letters PLL designate a phase locked loop circuit for generating one dot clock pulse DOTCLK.

A TFT panel is arranged to have its scanning line electrodes extended transversely and its signal line electrodes longitudinally, although not especially limited thereto. One pixel is formed at each node of the aforementioned scanning line electrodes and signal line electrodes. The pixel is composed of a pixel electrode and a TFT transistor. This TFT transistor has its gate connected with the corresponding scanning line electrode and its drain connected with the corresponding signal line electrode. The source of the TFT transistor is connected with the pixel electrode. The TFT transistor transmits a signal bilaterally like the MOSFET (i.e., Metal Oxide Semiconductor Field Effect Transistor). Thus, it should be understood that the drain and source of the aforementioned TFT transistor are conveniently named so.

The aforementioned scanning line electrodes extended transversely are sequentially selected by a gate driver. Specifically, this gate driver receives a frame signal FLM and a pulse CL3 corresponding to the scanning timing and selects the aforementioned scanning line electrodes sequentially upward. Thus, the gate driver is composed of dynamic shift resistors and drivers, although not especially limited thereto.

In this embodiment, although not especially limited, the signal line electrodes extending longitudinally in the TFT panel are divided into odd and even ones, which are individually equipped with drain drivers. For example, the odd signal line electrodes are driven by the drain driver, which is disposed above the TFT panel, and the even signal line electrodes are driven by the drain driver which is disposed below the TFT panel. By dividing the drivers into the upper and lower ones, the pitch of the signal line electrodes, as viewed from the driver, can be increased to facilitate the packaging of the drivers. By thus sharing the signal line electrodes, moreover, the odd and even signal line electrodes can be easily fed with the driving voltages of the different polarities.

The timing converter TCON3 transfers upper data and output side data through two signal buses corresponding to the aforementioned upper and lower drain drivers shared as above. Clock pulses CL2U and CL2L are used to input the data serially at a unit of 12 bits through the aforementioned signal buses. Specifically, the upper data and the lower data are transferred individually serially as a unit of 12 bits to the upper drain driver and the lower drain driver in synchronism with the aforementioned clock pulses CL2U and CL2L.

A clock pulse CL1 is used to latch the aforementioned data of one line transferred serially. Specifically, the clock pulse CL1 is generated at the end of the data transfer of one line, and the transferred data is latched so that the driving voltage of one line is accordingly generated. As a result, the data is written in parallel in the pixels of one line, which corresponding to the scanning line electrodes selected by the gate driver.

In parallel with the aforementioned writing in the liquid crystal pixels, the data corresponding to a next line are serially fetched by using the aforementioned clock pulses CL2U and CL2L.

A voltage supply stabilizer receives two voltages such as +5 V and −24 V to generate stabilizing voltages such as +5 V and −20 V necessary for the operations of the driving voltage generator. The voltage supply stabilizer has its operations effected in response to a display control signal DISP/ON coming from the timing converter TCON3.

The driving voltage generator is basically constructed of the circuit shown in FIG. 6. A variable resistor for angular viewing adjustment constitutes the aforementioned voltage varying means 1.

In this embodiment, as has been described hereinbefore, the drain driver of the TFT panel is divided into those for the odd signal line electrodes and the even signal line electrodes, and the driving voltages are given the different polarities, so that two kinds of positive and negative driving voltages are accordingly generated together. An AC conversion signal M generated by the timing converter TCON3 is alternately varied to the high or low level for each frame, and instructs switching of polarity of the drive voltage for driving the liquid crystals with the AC current. In response to the aforementioned AC conversion signal M, the driving voltage generator alternately switches the polarities of the driving voltages for the lower and upper drivers. With reference to the fundamental circuit of FIG. 6, the aforementioned AC conversion signal M is used to control the alternate switching of the switches SW1 and SW2.

Figure 8:
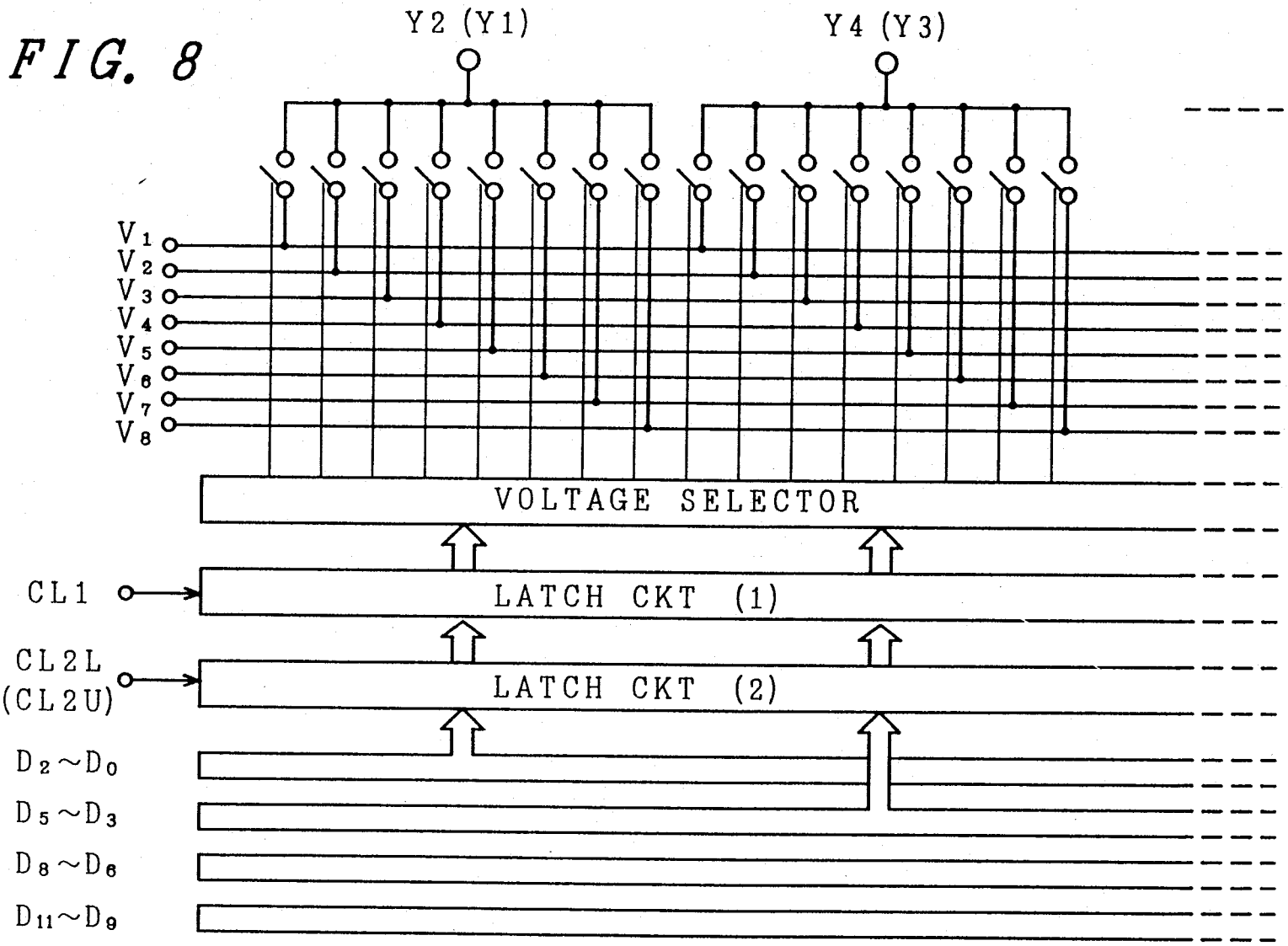
FIG. 8 is a block diagram showing one embodiment of an essential portion of a drain driver.

FIG. 8 is a block diagram showing an essential portion of one embodiment of the drain driver.

In this drain driver, the circuit relating two signal line electrodes Y2 and Y4 in the lower drain driver are shown by way of example in FIG. 8. The upper drain driver is constructed of a similar circuit, and the corresponding signal line electrodes are indicated, as parenthesized for reference.

For the eight-scale display, the data of one pixel is composed of three bits. Therefore, the signal bus for transferring the data of 12 bits is divided into those for every three bits. Data $D_0$ to $D_2$ are latched in a latch circuit (2) corresponding to the signal line electrode Y2. Data $D_3$ to $D_5$ are latched in a latch circuit (2) corresponding to the next signal line electrode Y4. Moreover, the remaining data $D_6$ to $D_8$ and data $D_9$ to $D_{11}$ are respectively latched in the latch circuit (2) corresponding to line electrodes not illustrated. As a result, the color pixel data transferred serially as a unit of 12 bits are latched for one cycle of the clock CL2L by the latch circuit corresponding to the four signal line electrodes.

In the case when the TFT panel has 640 signal line electrodes corresponding to the R, G and B colors, for example, the lower drain driver drives the $(320\times3)$ even signal line electrodes so that data of one line is latched for the $(320\times\frac{3}{4}=240)$ cycles. The upper drain driver drives the 320 even signal line electrodes, it latches the data of one line for the same time period of the cycles $(320\times\frac{3}{4}=240)$ as that of the aforementioned lower driver.

When the aforementioned color data of one line is inputted serially every 12 bits to the latch circuit (2), it is transferred in parallel to a latch circuit (1) for a horizontal retrace period in response to the clock pulse CL1. When the aforementioned parallel transfer is ended, the latch circuit (2) serially latches the color data corresponding to the next line. The color data latched in the latch circuit (1) is fed to a voltage selector. This voltage selector decodes the aforementioned color data composed of three bits and generates a selection signal corresponding to one drive voltage from the driving voltages $V_1$ to $V_8$ corresponding to the eight scales. As a result, the driving voltages of the scale corresponding to the color data is transmitted through the switch to the signal line electrodes. In the TFT panel, one scanning line electrode is brought into a selected state by the gate driver, and the corresponding TFT transistor is turned on. As a result, the aforementioned driving voltage is written in the pixel electrode throught the TFT transistor which is turned on.

As has been described above, the latch circuits (1) and (2) and the decoder circuit are composed of logical circuits which are operated at 5 V and 0 V. In case, on the contrary, the switch for transmitting the driving voltages $V_1$ to $V_8$ selectively is composed of a MOSFET, the aforementioned voltages $V_1$ to $V_8$ have to be transmitted without any level loss by the gate voltage of the MOSFET. For this necessity, the voltage selector is additionally given a level changing function to change the switch control signal, which is generated at the aforementioned logical level of 5 V, into the gate voltage level of the MOSFET necessary for transmitting the aforementioned voltages $V_1$ to $V_8$.

Figures 9, 9A:
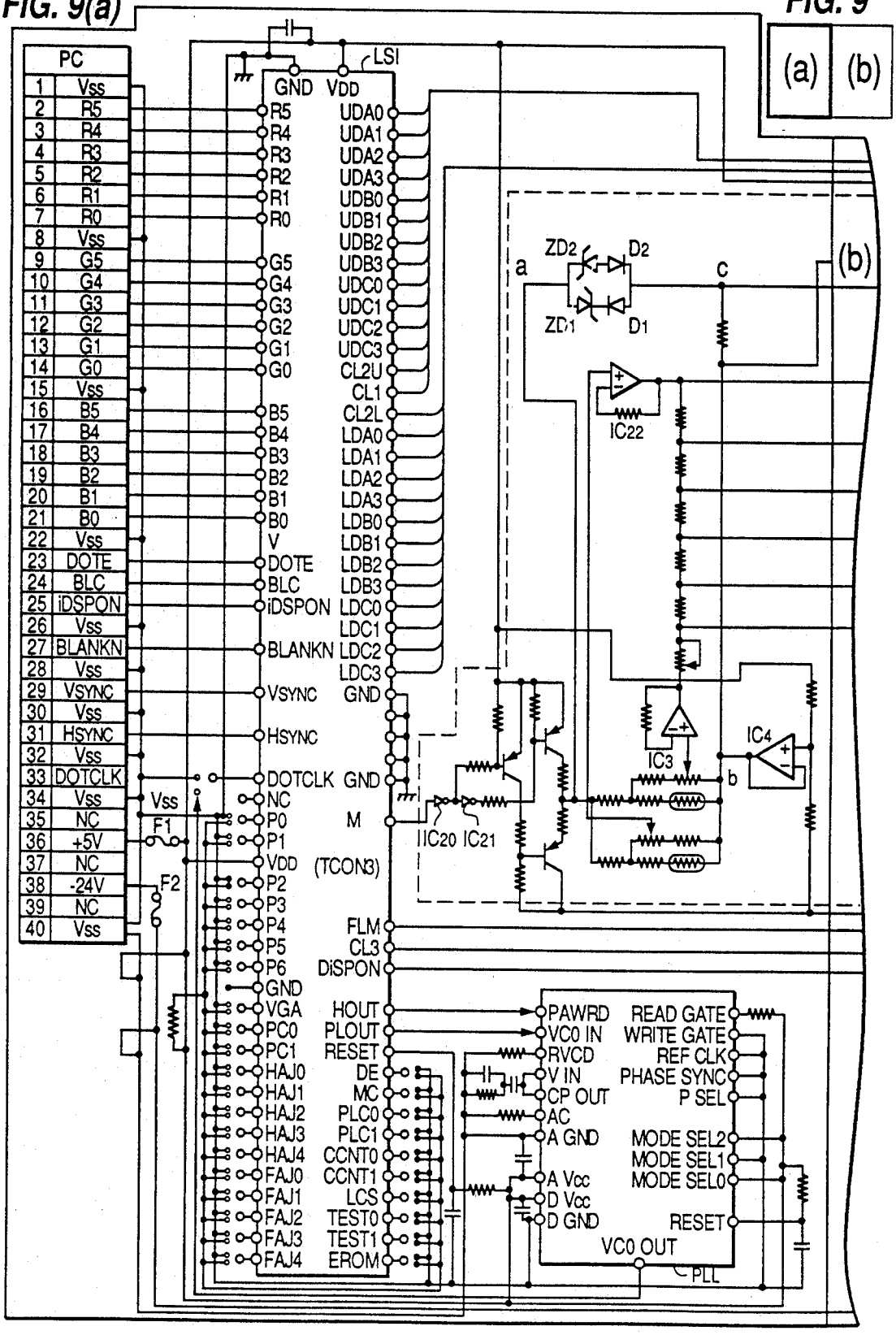
FIGS. 9(*a*) and 9(*g*) are a circuit diagram showing one embodiment of a mother board in the half tone liquid crystal display circuit according to the present invention.
Figures 9, 9B:
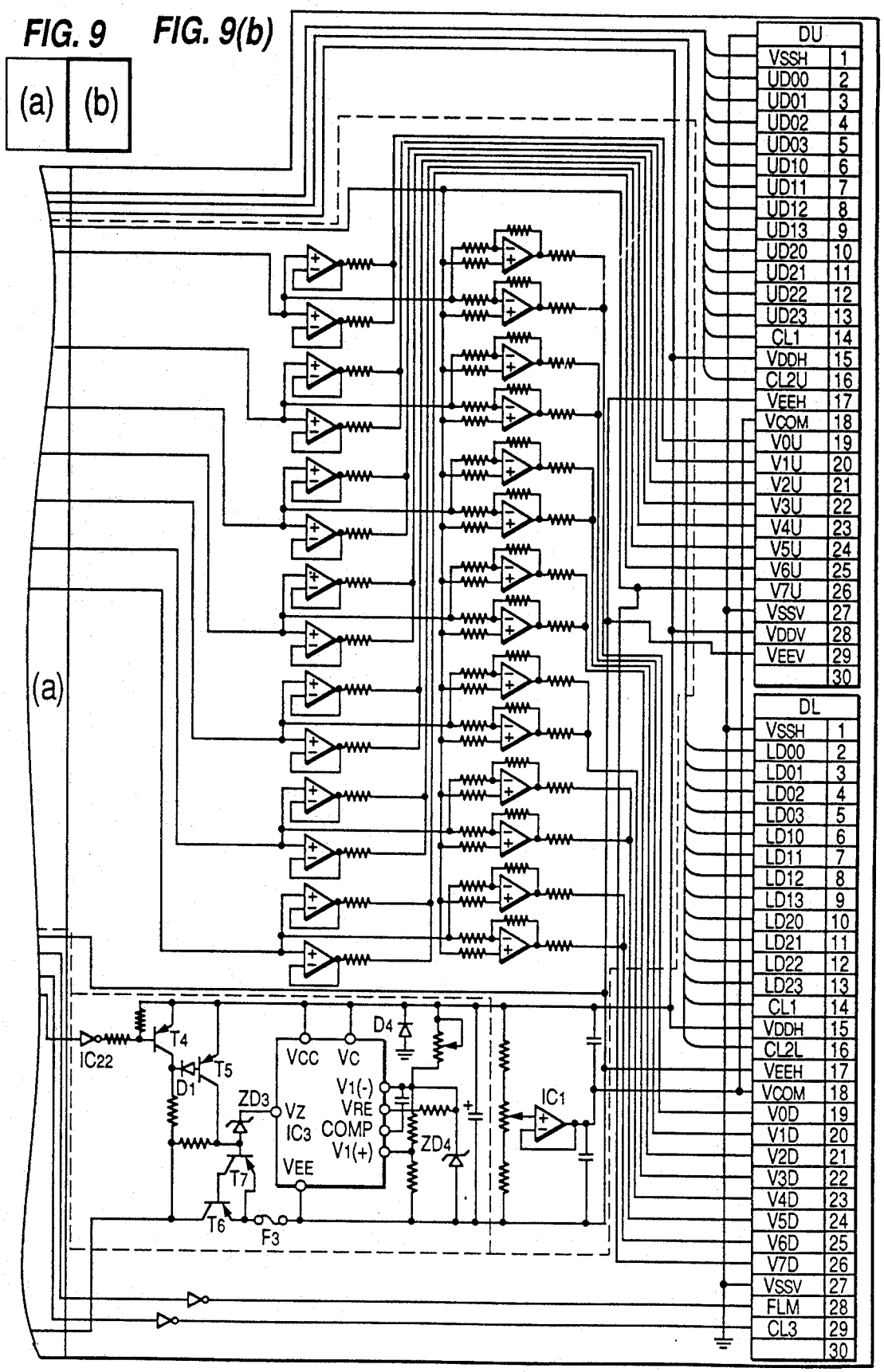

FIG. 9 is a circuit diagram showing one embodiment of a mother board in a half tone liquid crystal display circuit according to the present invention. This mother board is packaged with: a semiconductor integrated circuit LSI composing the aforementioned timing converter TCON3; a PLL IC; an IC3 for stabilized voltage supply; discrete parts such as bipolar transistors, resistance elements, diodes or capacitors; and a plurality of ICs composing an operation amplifier.

The mother board is connected through a flexible printed circuit FPC with a driver board, on which a TFT panel is mounted. Terminals PC, DU and DL are provided for connecting that flexible printed circuit. The terminals DU correspond to the upper drain driver and the terminals DL correspond to the lower drain driver.

The driving voltage generator is constructed from; discrete parts such as bipolar transistors, resistance elements, diodes and capacitors and a plurality of ICs composing an operational; amplifier.

Figure 10:
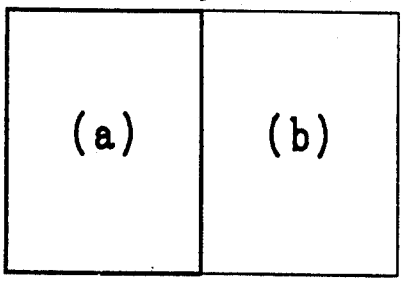
FIG. 10 is a circuit diagram showing one embodiment of the aforementioned driving voltage generator.
Figure 10:
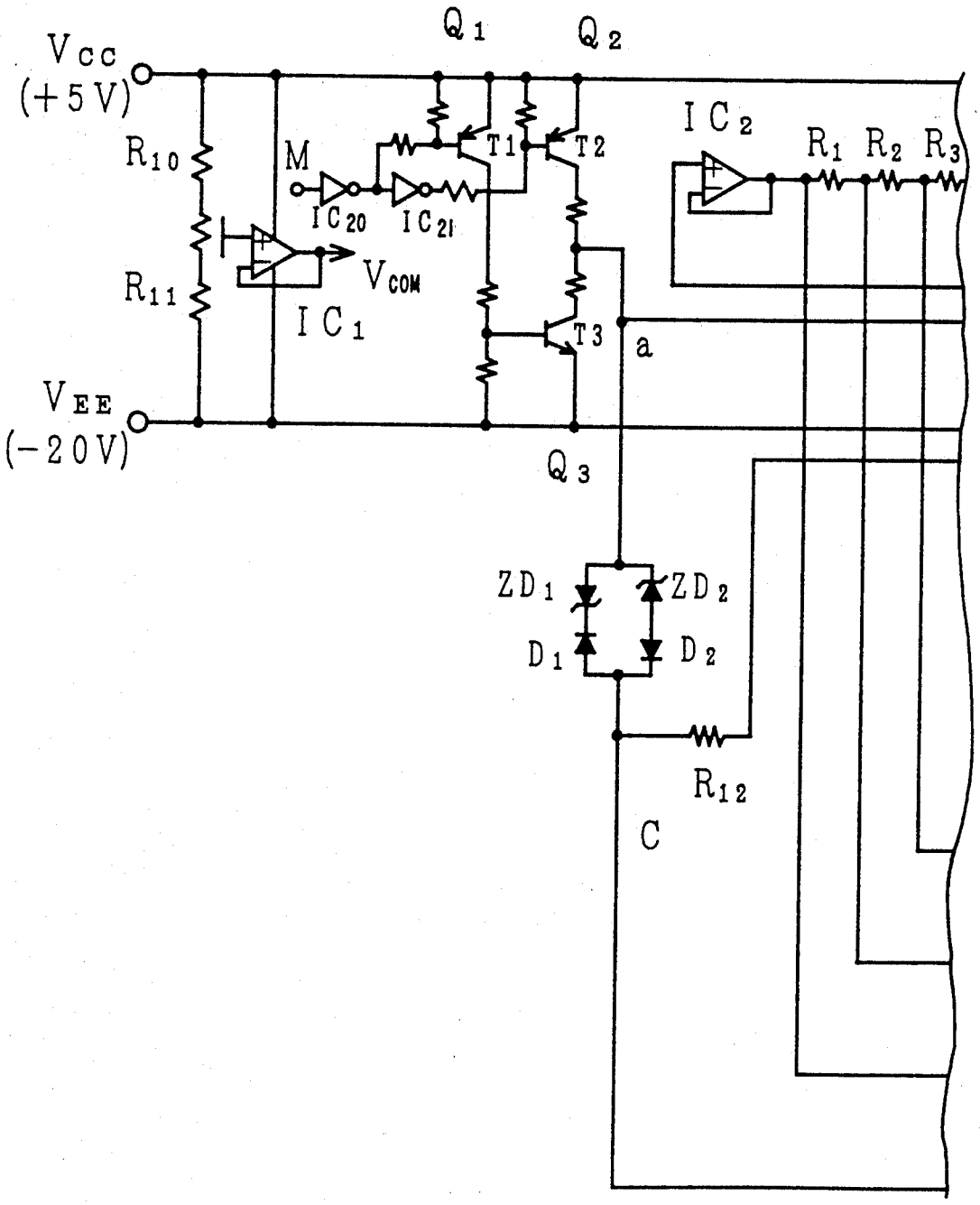
Figure 10:
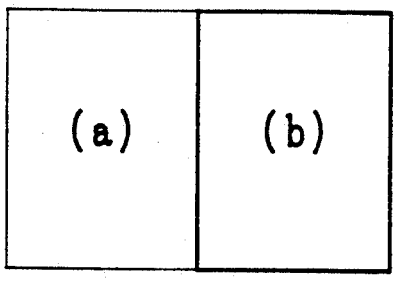
Figure 10:
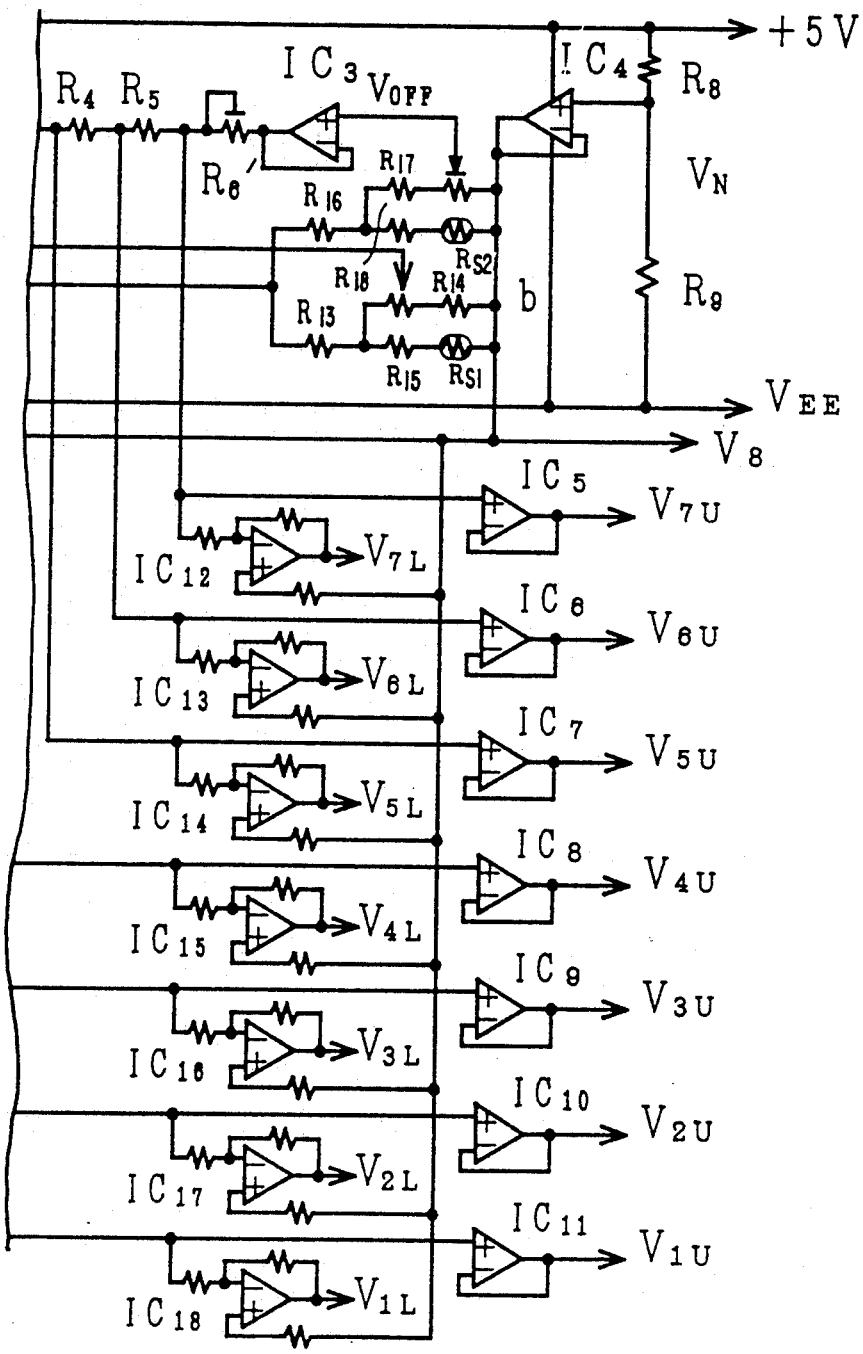

FIG. 10 is a circuit diagram showing one embodiment of the aforementioned driving voltage generator. The circuit of FIG. 10 corresponds to only the driving voltage generator of the circuit of FIG. 9.

The operating voltage, which is composed of +5 V ($V_{CC}$) and −20 V ($V_{EE}$) generated by a stabilizing voltage source circuit, as will be detailed hereinafter, corresponds to the aforementioned voltage $V_H$ at the high level and the aforementioned voltage $V_L$ at the low level, as shown in FIG. 6. The resistors $R_8$ and $R_9$ connected in series between the two voltages generate a center voltage $V_N$ such as −7.5 V.

This center voltage $V_N$ is transmitted to a node b through an operational amplifier $IC_4$ having the form of a voltage follower. The operational amplifier $IC_4$ performs an impedance transformation so that the center voltage $V_N$ of the node b is used as the voltage supply for a low-output impedance.

A PNP transistor T2, which has its emitter connected with the positive voltage $V_{CC}$, and an NPN transistor T3, which has its emitter connected with the negative voltage $V_{EE}$, correspond to the aforementioned switches SW1 and SW2 of FIG. 6. Inverters $IC_{20}$ and $IC_{21}$, a PNP transistor T1, and its collector resistor generate a control signal for complementarily switching the aforementioned transistors T2 and T3 in accordance with the AC conversion signal M. This AC conversion signal M is fed to the input of the inverter $IC_{20}$, the output signal of which is transmitted to the base of the transistor T1. This output signal of the inverter $IC_{20}$ is fed through the inverter $IC_{21}$ to the base of the transistor T2. As a result, the transistors T1 and T2 are complementarily turned on or off in response to the AC conversion signal M. The collector output signal of the aforementioned transistor T1 is transmitted to the base of the transistor T3.

When the AC conversion signal M is at the high level, the output signal of the inverter $IC_{20}$ takes the low level to turn on the PNP transistor T1. As a result, the PNP transistor T1 has its collector conductive to turn on the NPN transistor T3. Since the output signal of the inverter $IC_{20}$ is dropped to the low level in response to the high level of the aforementioned AC conversion signal M, the output signal of the inverter $IC_{21}$ is raised to the high level. As a result, the PNP transistor T2 is turned off. When the aforementioned transistor T3 is turned on, the negative voltage $V_{EE}$ of $-20$ V is transmitted to a node a through the transistor T3.

When the AC conversion signal M is at the low level, the output signal of the inverter $IC_{20}$ takes the high level to turn off the PNP transistor T1. As a result, no current flows through the collector of the transistor T1 so that the NPN transistor T3 is turned off. Since the inverter $IC_{20}$ has its output signal raised to the high level in response to the low level of the aforementioned AC conversion signal M, the inverter $IC_{21}$ has its output signal dropped to the low level. As a result, the PNP transistor T2 is turned on. Then, the positive voltage $V_{CC}$ of $+5$ V is transmitted to the node a through the transistor T2.

Thus, the node a is alternately fed with the positive voltage $V_{CC}$ and the negative voltage $V_{EE}$ with reference to the center voltage $V_N$ of the node b in response to the high and low levels of the AC conversion signal M.

This embodiment is equipped between the aforementioned nodes a and b with a voltage generator for generating an angular correcting voltage $V_K$ varying with the aforementioned reference voltage $V_{OFF}$ and observation angle $\theta$, although not especially limited thereto. Resistors $R_{13}$, $R_{14}$ and $R_{15}$ and a thermistor $R_{S1}$ acting as a temperature sensitive element generate the aforementioned angular correcting voltage $V_K$. Specifically, the resistor $R_{14}$ is a series connection of a fixed resistor and a variable resistor so that it can vary the angular correcting voltage $V_K$ by adjusting the aforementioned variable resistor. With the resistor $R_{14}$, there is connected in parallel a series circuit which is composed of the resistor $R_{15}$ and the thermistor $R_{S1}$. In this thermistor $R_{S1}$, as could be understood from the characteristic diagram of FIG. 4, the reference voltage $V_{OFF}$ is varied with the temperature variation, and the gradient itself of the brightness variation approximated from the oblique side of the rectangular triangle is also varied. Thus, the angular correcting voltage $V_K$ is reduced by making use of the negative characteristic that the resistance of the thermistor $R_{S1}$ will drop as the temperature rises. The composite resistance of the resistors $R_{14}$ and $R_{15}$ and the thermistor $R_{S1}$ drops as the resistance of the thermistor $R_{S1}$ drops with the aforementioned temperature rise. As a result, the voltage, which is determined by the resistance ratio of the composed resistance and the resistor $R_{13}$, will drop. This divided voltage is further divided by the aforementioned variable resistor $R_{14}$. As a result, the angular correcting voltage $V_K$ will drop with the temperature rise to increase the aforementioned gradient of the brightness.

Incidentally, the angular correcting voltage $V_K$ can be omitted from the practical circuit. Specifically, the operations to be carried out can be equalized to those of FIG. 1 even if the driving voltage $V_2$ corresponding to the 2nd scale is changed in accordance with the observation angle $\theta$. In this embodiment, therefore, the driving voltage $V_2$ for the angular corrections is generated directly by the circuit which is composed of the aforementioned resistors $R_{13}$ and $R_{15}$ and thermistor $R_{S1}$, as the voltage varying means 1. For this reasoning, the driving voltage $V_2$ corresponding to the 2nd scale is generated directly from the variable voltage terminal of the aforementioned variable resistor $R_{14}$. This driving voltage is subjected to an impedance transformation, before it is outputted, by the operational amplifier $IC_2$ having the voltage follower characteristic.

Resistors $R_{16}$, $R_{17}$ and $R_{18}$ and a thermistor $R_{S2}$ generate the aforementioned reference voltage $V_{OFF}$. Specifically, the resistor $R_{17}$ has a fixed resistor and an adjusting resistor connected in series for setting the reference voltage $V_{OFF}$ to correct the dispersions of the TFT panel and the aforementioned resistance elements by adjusting the adjusting resistor in the assembly or inspection step of the liquid crystal display circuit. In parallel with this adjusting resistor $R_{17}$, there is connected a series circuit of a resistor $R_{18}$ and a thermistor $R_{S2}$. This thermistor $R_{32}$ corrects the reference voltage $V_{OFF}$ automatically in a manner to correspond to the temperature dependency of the liquid crystal, as is apparent from the characteristic diagram of FIG. 4. Specifically, the reference voltage $V_{OFF}$ is dropped by making use of the negative characteristic that the resistance of the thermistor $R_{S2}$ will drop as the temperature rises. The composite resistance of the resistors $R_{17}$ and $R_{18}$ and the thermistor $R_{S2}$ drops as the resistance of the thermistor $R_{S2}$ drops in accordance with the aforementioned temperature rise. This drops the voltage which is determined at the resistance ratio of the composed resistance and the resistance of the resistor $R_{16}$. This divided voltage is further divided by the aforementioned adjusting resistor $R_{17}$. As a result, the reference voltage $V_{OFF}$ drops with the rise of the temperature so that the temperature compensation is automatically accomplished, as shown in FIG. 4. The reference voltage $V_{OFF}$ is subjected to an impedance transformation by the arithmetic amplifier $IC_3$ having the voltage follower shape, before it is outputted.

The angular correcting voltage $V_K$ can be replaced by the driving voltage $V_2$, as has been described hereinbefore. However, the aforementioned reference voltage $V_{OFF}$ is one for providing the reference to the two or more right triangles which are formed to correspond to the variations of the observation angle $\theta$, as has been described with reference to FIG. 1. Therefore, it should be noted that the reference voltage $V_{OFF}$ should really exist in the series resistance circuit for generating the liquid crystal driving voltage in the intermediate scale.

Between the output terminals of the aforementioned operational amplifiers $IC_2$ and $IC_3$, there are connected series resistors $R_1$ to $R_6'$ for generating the intermediate scale voltages $V_3$ to $V_7$. The aforementioned resistors $R_1$ to $R_5$ are resistance elements having resistances equal to those of the resistors $R_1$ to $R_5$ shown in FIG. 2. The resistor $R_6'$ is given the composite resistance of the resistors $R_6$ and $R_7$ shown in FIG. 1.

The intermediate scale voltages $V_2$ to $V_7$ outputted from the output terminals of the aforementioned operational amplifier $IC_2$ and the mutual nodes of the aforementioned series resistors $R_1$ to $R_6$ are outputted as liquid crystal driving voltages $V_{2U}$ to $V_{7U}$ corresponding to the upper drain driver, through operational amplifiers $IC_{10}$ to $IC_5$ having the voltage follower shape.

The intermediate scale voltages $V_2$ to $V_7$, which are outputted from the output terminal of the aforementioned operational amplifier $IC_2$ and the nodes of the aforementioned series resistors $R_1$ to $R_6$, are outputted as liquid crystal driving voltages $V_{2L}$ to $V_{7L}$ corresponding to the lower drain driver, through inverted amplifiers $IC_{17}$ to $IC_{12}$ which are set to have a voltage gain of 1. These inverted amplifiers $IC_{17}$ to $IC_{12}$ are constructed of operational amplifiers, which are equipped with an input resistor disposed at an inverted input (−), a feedback resistor disposed between the inverted input (−) and an output terminal, and a resistor disposed at a non-inverted input (+) for feeding the aforementioned center voltage $V_N$. Thus, the inverted amplifiers $IC_{17}$ to $IC_{12}$ output the liquid crystal driving voltages $V_{2L}$ to $V_{7L}$ which are prepared by inverting the polarities of the individual intermediate scale voltages $V_2$ to $V_7$ inputted from their individual output terminals.

The driving voltage $V_8$ corresponding to the transmissivity of 100% (or the white level) of the liquid crystal is exemplified by the center voltages $V_N$. Specifically, the voltage of the node b, which is obtained through the operational amplifier $IC_4$, is fed as it is as the liquid crystal driving voltage $V_8$ commonly to the upper and lower drain drivers.

The driving voltage $V_1$ corresponding to the transmissivity of 0% (i.e., the black level) of the liquid crystal is prepared by shifting the level of the voltage of the node a, which is to be switched to +5 V or −20 V, by a bilateral level shifter which is composed of Zener diodes $ZD_1$ and $ZD_2$ and diodes $D_1$ and $D_2$. Specifically, when the voltage of the node a is positive, e.g., +5 V, the Zener diode $ZD_2$ and the diode $D_2$ are turned on to determined the level shift with the Zener voltage and the diode forward voltage. When the voltage of the node a is negative, e.g., −20 V, the Zener diode $ZD_1$ and the diode $D_1$ are turned on to determine the level shift with the Zener voltage and the diode forward voltage. The resistor $R_{12}$ connected in series with that level shifter passes the operating current of the level shifter.

The voltage of a node c, which has its level shifted by the aforementioned level shifter, is likewise outputted as the liquid crystal driving voltage $V_{1U}$ to be fed to the upper drain driver, through an operational amplifier $IC_{11}$ having the voltage follower characteristic and further as the liquid crystal driving voltage $V_{1L}$ to be fed to the lower drain driver, through an inverted amplifier $IC_{18}$.

The aforementioned level shifters are provided for the following reasons. The gate driver shown in FIG. 7 receives the aforementioned positive voltage $V_{CC}$ and negative voltage $V_{EE}$ and generates an output signal for setting the selected level to +5 V and the unselected level to −20 V. In other words, the TFT transistor has its gate fed with the aforementioned level +5 V or −20 V. By providing the aforementioned level shifters, the maximum voltage $+V_8$ and minimum voltage $-V_8$ to be fed to the signal line electrodes to be coupled to the TFT drain (or source) are symmetrically determined to the positive and negative values with reference to the center voltage $V_N$ in accordance with the level shift set by the aforementioned level shifters.

By setting those level shifts to levels higher than the threshold voltage of the TFT transistors, the driving voltages of the signal line electrodes can be transmitted without any level loss to the pixel electrodes selected, when the TFT transistors are turned on.

The series circuit composed of the resistors $R_{10}$ and $R_{11}$ and the adjusting resistor is inputted to an operational amplifier $IC_1$ having the voltage follower shape. This arithmetic amplifier $IC_1$ generates a common voltage $V_{com}$ to be fed to the common electrode of the liquid crystal panel. Specifically, the pixel electrodes connected through the TFT transistors constitute capacitors equivalently to the aforementioned common electrode, and the drive voltage transmitted when the TFT transistor is on is applied with reference to the common voltage $V_{com}$ at the side of the aforementioned common electrode, so that the drive voltage is latched when the TFT transistor is turned off. Incidentally, other operational amplifiers such as that operational amplifier $IC_1$ or the aforementioned operational amplifier $IC_4$ are all operated in response to the voltages $V_{CC}$ and $V_{EE}$. By using such operating voltages, it is possible to generate the liquid crystal driving voltages $V_{1U}$ to $V_{7U}$ and $V_{1L}$ to $V_{7L}$ to be switched to positive and negative values with reference to the center voltage $V_N$.

Figure 11:
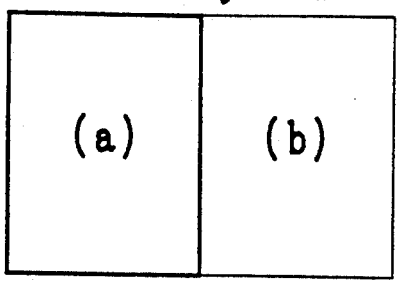
FIG. 11 is a circuit diagram showing another embodiment of the aforementioned driving voltage generator.
Figure 11:
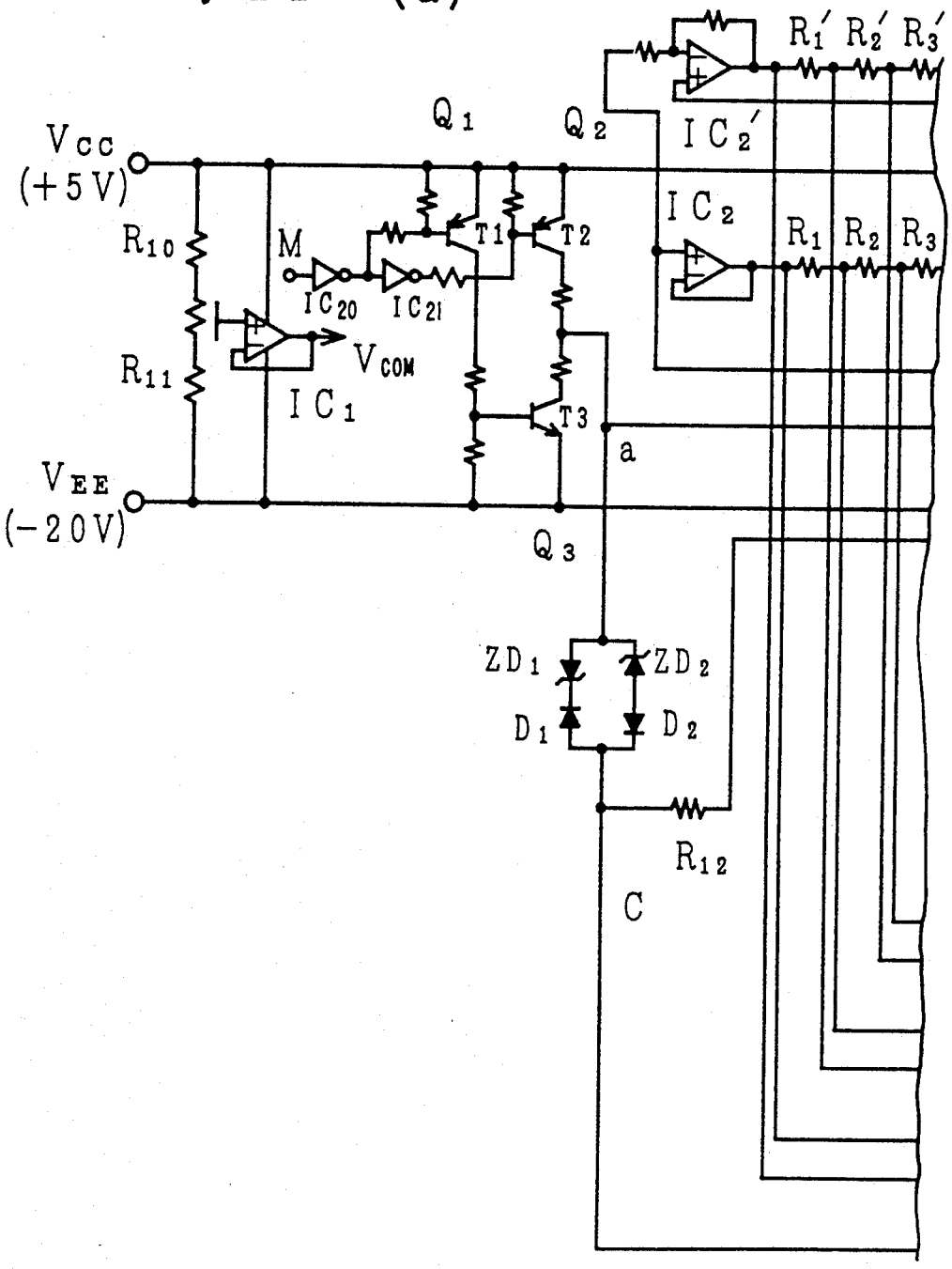
Figure 11:
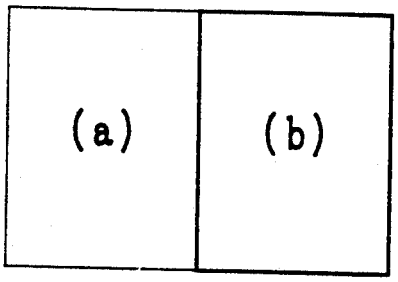
Figure 11:
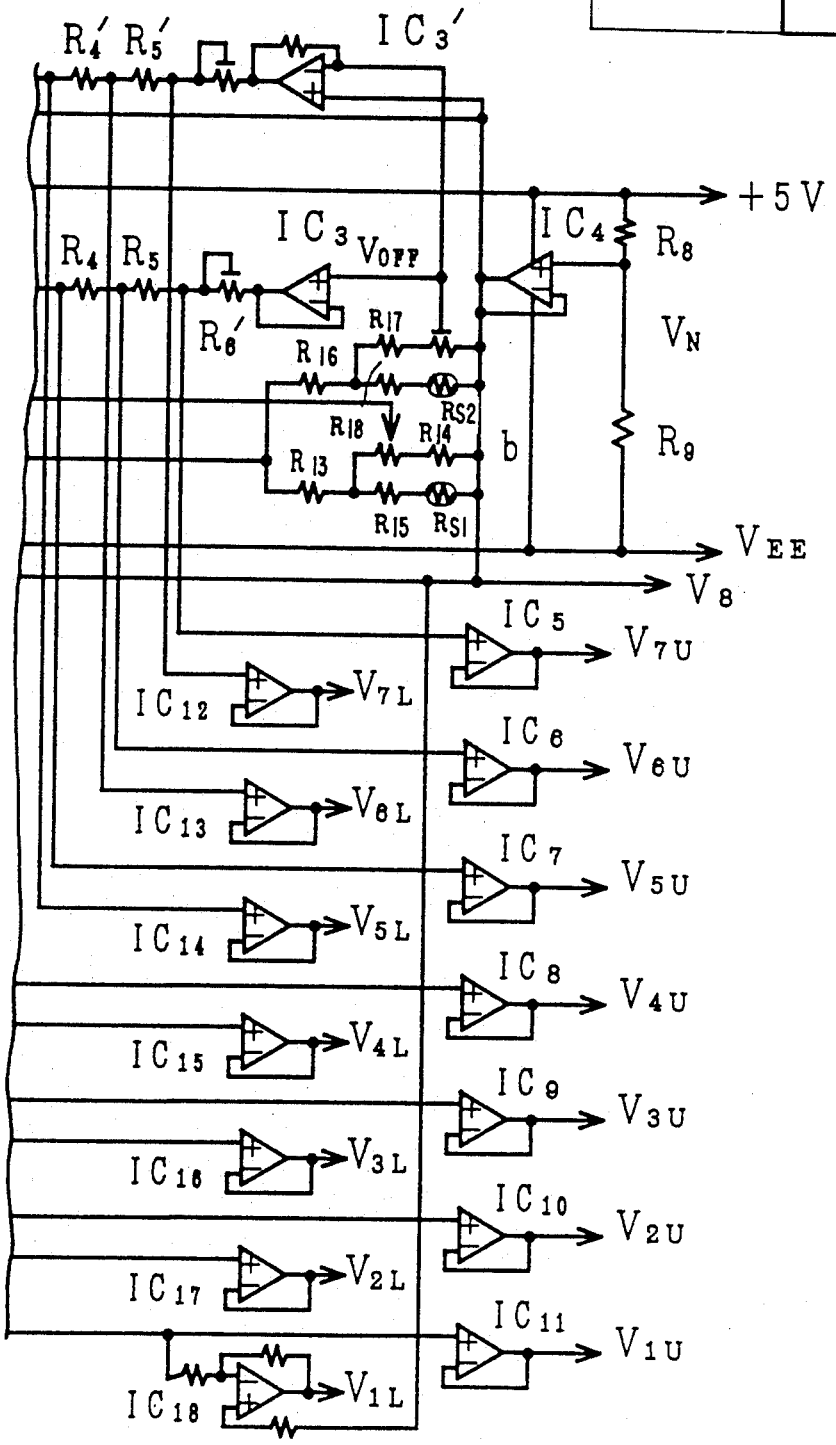

FIG. 11 is a circuit diagram showing another embodiment of the aforementioned driving voltage generator.

In this embodiment, voltage dividing resistance circuits $R_1$ to $R_5$ and $R_1'$ to $R_5'$ are provided to correspond to the upper drain driver and the lower drain driver. In order that the driving voltages $V_{1U}$ to $V_{7U}$ to be fed to the upper drain driver and the driving voltages $V_{1L}$ to $V_{7L}$ to be fed to the lower drain driver may be inverted like the embodiment of FIG. 10, the voltage dividing resistance circuit $R_1'$ to $R_5'$ for generating the driving voltages to be fed to the lower drain driver are fed with voltages in the opposite polarity. Specifically, the operational amplifier $IC_2'$ operating as the inverting amplifier generates a voltage and feeds it to the voltage dividing resistor $R_1'$ by inverting the polarity of a correcting voltage $V_K$ (i.e., the driving voltage $V_{2U}$ corresponding to the 2nd scale, as has been described hereinbefore) generated with reference to the potential of the aforementioned node b by the aforementioned angular correcting voltage generator which is composed of the resistors $R_{13}$, $R_{14}$ and $R_{15}$ and the thermistor $R_{S1}$ acting as the temperature sensitive element. As a result, the operational amplifiers $IC_2$ and $IC_2'$ output the angular collecting voltages in the polarities opposed to each other. Moreover, the operational amplifier $IC_3'$ acting as the inverting amplifier generates such a voltage and feeds it to the voltage dividing resistor $R_5'$ and has its polarity inverted from the reference voltage $V_{OFF}$ which is generated with reference to the potential of the aforementioned node b by the aforementioned reference voltage generator composed of the resistors $R_{16}$, $R_{17}$ and $R_{18}$ and the thermistor $R_{S2}$ acting as the temperature sensitive element. As a result, the operational amplifiers $IC_3$ and $IC_3'$ output reference voltages in the polarities opposed to each other. As a result, the driving voltages $V_{1U}$ to $V_{7U}$ and $V_{1L}$ to $V_{7L}$ having the opposite polarities can be generated from the nodes of the voltage dividing resistance circuits $R_1$ to $R_5$ and $R_1'$ to $R_5'$. In this embodiment, therefore, like the operational amplifiers $IC_5$ to $IC_{10}$ corresponding to the upper drain driver, the operational amplifiers $IC_{12}$ to $IC_{17}$ corresponding to the lower drain driver are given the voltage follower characteristic. Since, however, the driving voltage $V_{1L}$ is generated not by the voltage dividing circuit but by the level shifter, as has been described hereinbefore, it is generated by the operational amplifier $IC_{18}$ acting as the inverted amplifier.

In this structure, the operational amplifier can be formed into the voltage follower characteristic requiring no resistance element to generate the driving voltages $V_{2L}$ to $V_{7L}$ corresponding to the lower drain driver. Thus, the total number of elements constituting the driving voltage generator can be reduced even if it is considered that the voltage dividing resistance circuit $R_1'$ to $R_5'$ are newly required.

The remaining circuit portions other than the aforementioned one are similar to those of the embodiment shown in FIG. 10, and their repeated descriptions will be omitted.

Figure 12:
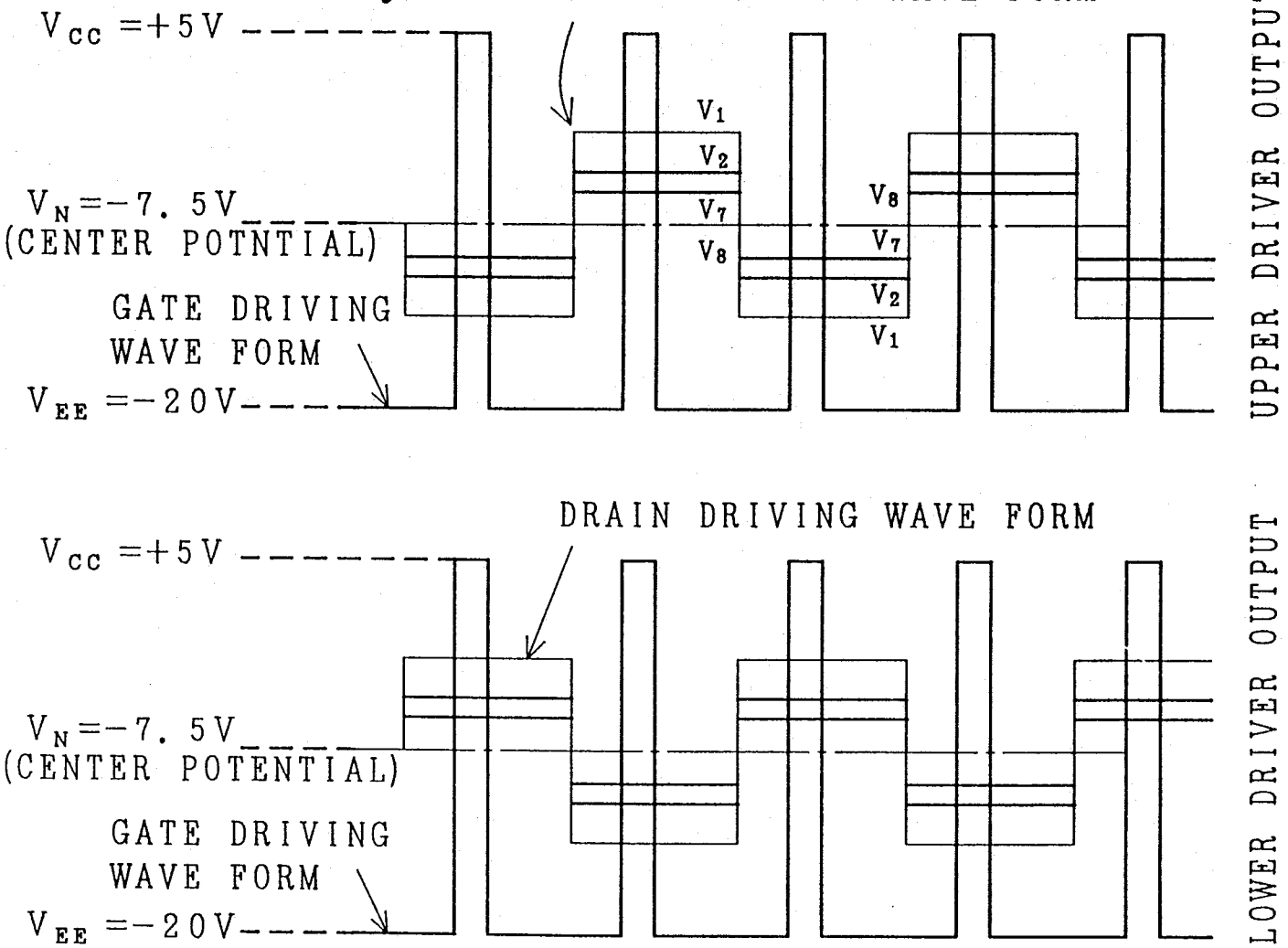
FIG. 12 is a driving waveform chart for explaining one example of the operations of the aforementioned TFT panel.

FIG. 12 is a driving waveform chart for explaining one example of the operations of the aforementioned TFT panel. Waveforms corresponding to the upper drain driver are shown at an upper side, and waveforms corresponding to the lower drain driver are shown at a lower side.

In the gate driving waveforms to be output from the gate drivers, a low voltage such as $V_{EE}=-20$ V is an unselected level, and a high voltage such as $V_{CC}=+5$ V is a selected level.

The positive voltages $V_1$ to $V_7$ and negative voltages $V_1$ to $V_7$ for driving the liquid crystal with the AC current are generated by using the center voltage $V_N$ (of $-7.5$ V) of the aforementioned high voltage $V_{CC}$ and low voltage $V_{EE}$ as the center potential. The driving voltage $V_8$ is set to a level equal to the center potential $V_N$. In FIG. 12, the intermediate voltages $V_3$ to $V_6$ for the half tone displays are generated by equally dividing the range between the two voltages $V_2$ and $V_7$, as exemplified. With respect to these intermediate scale voltages $V_2$ and $V_7$, the voltage $V_1$ corresponding to the black level and the voltage $V_8$ corresponding to the white level are set with relatively large margins.

The polarity of the output voltage of the upper driver and the polarity of the output voltage of the lower driver are made opposite to each other, as shown. In the first frame, for example, a driving voltage in the negative polarity is outputted from the upper driver, and a driving voltage in the positive polarity is outputted from the lower driver, as shown. In the next frame, a driving voltage in the positive polarity is outputted from the upper driver, and a driving voltage in the negative polarity is outputted from the lower driver. This switching of polarities is accomplished in response to the high level and low level of the aforementioned AC conversion signal M, although omitted from FIG. 12.

Figure 13:
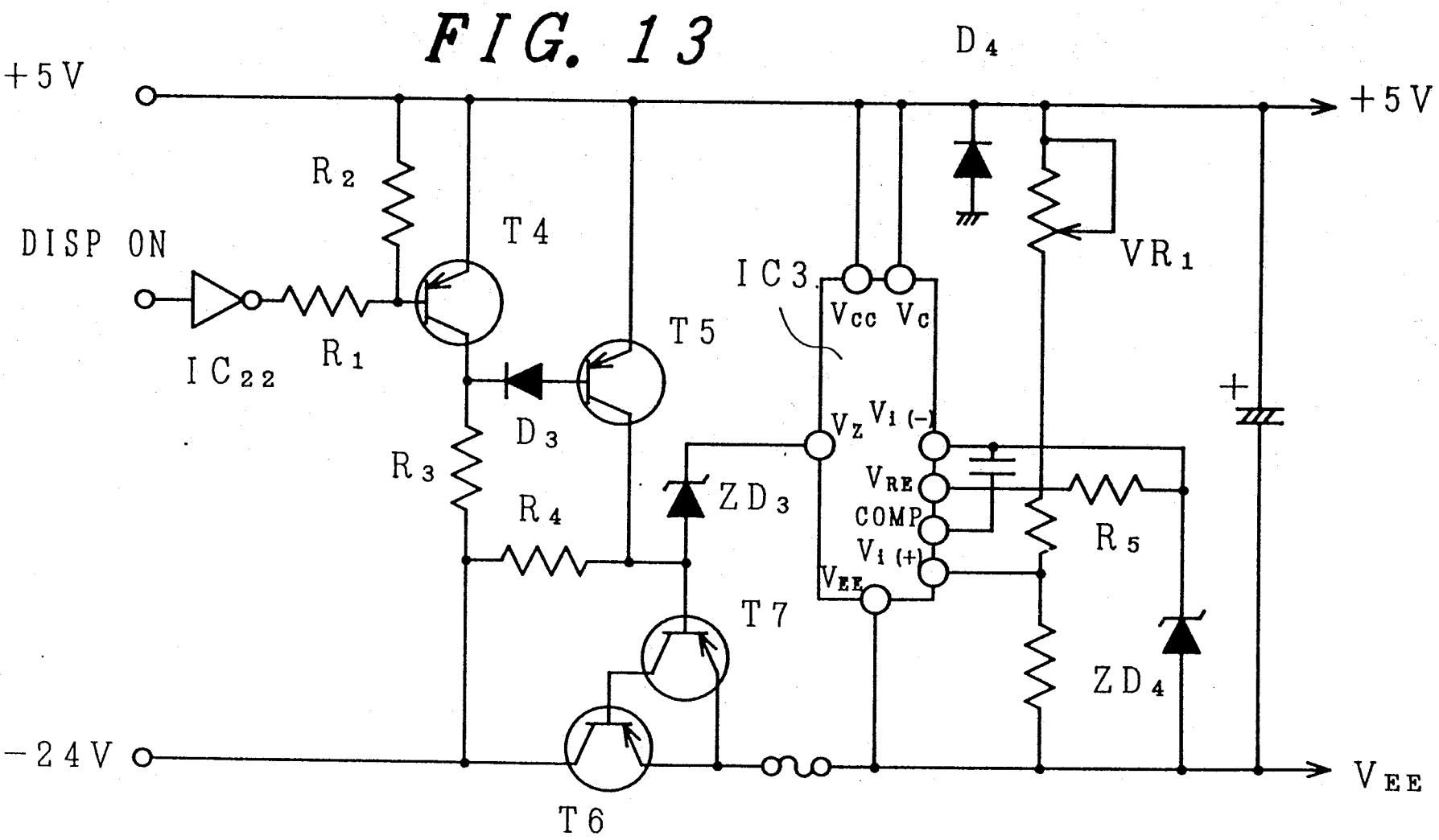
FIG. 13 is a circuit diagram showing one embodiment of the aforementioned voltage source stabilizer.

FIG. 13 is a circuit diagram showing one embodiment of the voltage supply stabilizer. The circuit of FIG. 13 is the voltage supply stabilizer from the mother board shown in FIG. 9.

A control signal DISP ON is generated by the timing converter TCON3 to instruct the start of the display of the liquid crystal. Specifically, if an unstable voltage is fed to the liquid crystal driving voltage generator before the timing converter TCON3 starts its normal operations immediately after the power is turned on, a nonsensing driving voltage may be applied to the liquid crystal to effect a display. This display is prevented by the control signal DISP ON.

Specifically, when the control signal DISP ON is at the low level, the output signal of the inverter $IC_{22}$ takes the high level to turn off a PNP transistor T4. Then, PNP transistors T6 and T7 in a Darlington connection for transmitting a negative high voltage of $-24$ V are turned off. As a result, a PNP transistor T5 is turned on to turn off the transistors T7 and T6. Even with these transistors T7 and T6 being off, the stabilizing voltage supply IC3 is fed with no operating voltage so that the stabilizing voltage such as $-20$ V is not outputted.

When the control signal DISP ON is at the high level, the output signal of the inverter $IC_{22}$ takes the low level to turn on the PNP transistor T4. As a result, the transistor T4 has its collector potential raised to a level as high as $V_{CC}$ to turn off the transistor T5. Thus, the PNP transistor T7 in the Darlington connection for transmitting the negative high voltage such as $-24$ V has its base fed with $-24$ V to turn on those transistors T7 and T6. When these transistors T7 and T6 are turned on, the stabilizing voltage supply IC3 is fed with the operating voltage at the low potential side to generate the stabilizing voltage $V_{EE}$ such as $-20$ V.

In the voltage supply stabilizer of this embodiment, if a negative voltage such as $-24$ V is fed before the positive voltage $V_{CC}$ such as $+5$ V is fed, the ground potential is fed through the diode $D_4$ to the emitter of the transistor T5 so that this transistor T5 is turned on to turn off the aforementioned transistors T7 and T6. As a result, the negative voltage such as $-24$ V is prevented from being preferentially fed to the voltage supply stabilizing IC3.

Figure 14:
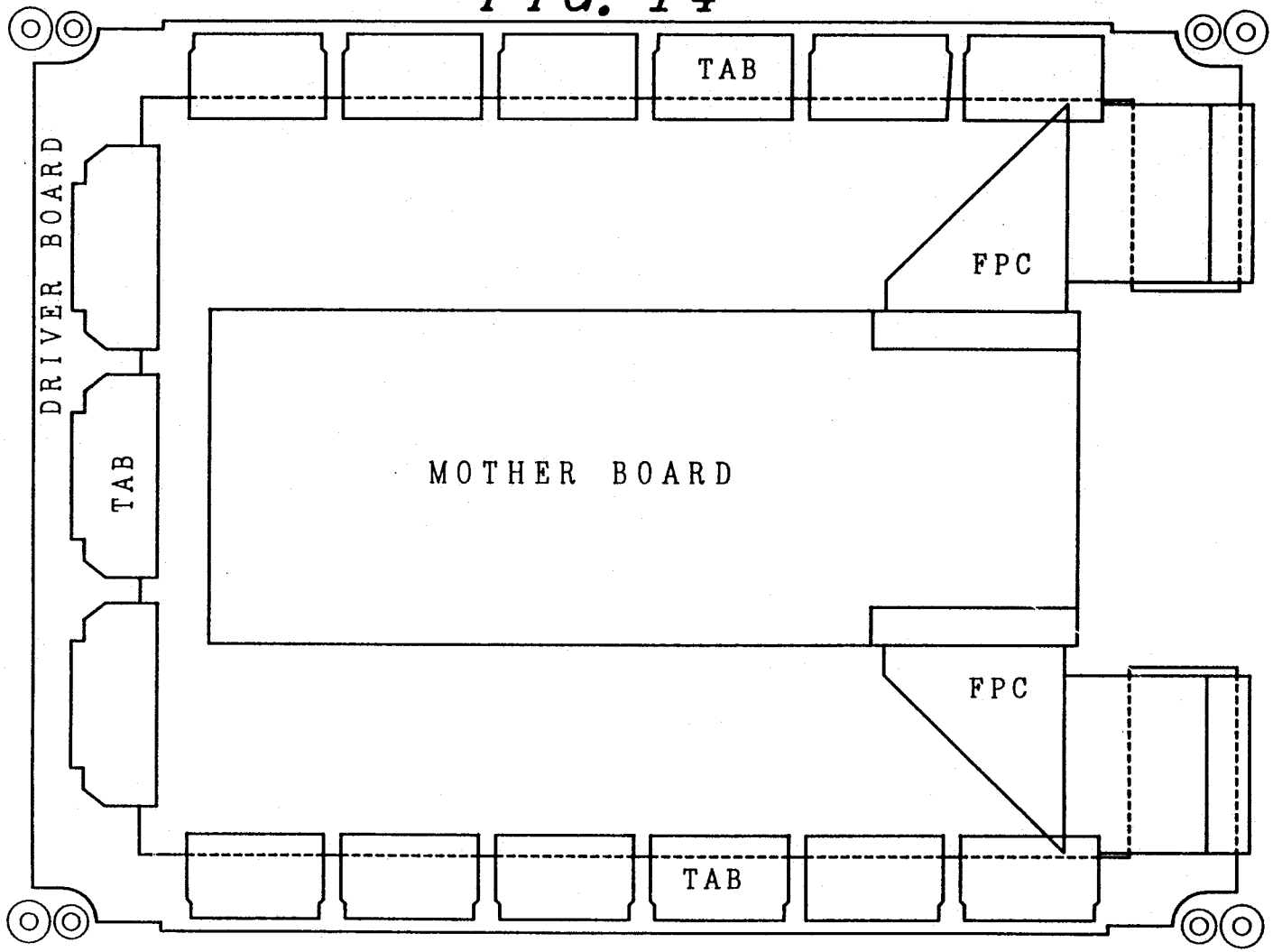
FIG. 14 is a back elevation showing one embodiment of the half tone liquid crystal display circuit according to the present invention.

FIG. 14 is a back elevation showing the packaging of one embodiment of the half tone liquid crystal display circuit according to the present invention.

FIG. 14 shows the back elevation of the half tone liquid crystal display circuit. Although not especially limited thereto, the driver board is formed into a fallen "U-shape" having three sides corresponding to the upper, lower and lefthand sides of the TFT panel (not illustrated). This driver board is equipped with tabs, of which the upper and lower tabs are packaged with semiconductor integrated circuit devices constituting the drain drivers whereas the lefthand tab is packaged with semiconductor integrated circuit devices constituting the gate drivers.

The aforementioned tabs are formed with wiring patterns for connecting the output terminals of the semiconductor integrated circuit devices such as the drain drivers or gate drivers packaged therein, individually with the corresponding signal line electrodes and scanning line electrodes of the TFT panel. As a result, the driver board thus packaged with the aforementioned tabs and semiconductor integrated circuit devices is assembled so thin with the TFT panel as to form generally a coextensive plane.

In the liquid crystal display circuit based upon a single tone according to the prior art, the mother board can be made relatively small by using the binary voltages of white and black as the driving voltages. As a result, the liquid crystal display circuit based upon the singletone of the prior art is arranged to form a generally coextensive play with the TFT panel like the aforementioned driver board.

In the half tone liquid crystal display circuit according to this embodiment, however, a number of semiconductor integrated circuit devices and discrete parts, as shown in FIG. 9, are packaged to generate a number of driving voltages according to the half tones. This makes it unavoidable that the mother board packaged with those electronic parts is sized larger than that of the prior art. If this large-sized mother board is placed generally in a plane with the TFT panel like the aforementioned driver board, there arises a problem that the whole structure of the liquid crystal display circuit has its display frame enlarged around the center and made horizontally or vertically asymmetric.

In this embodiment, therefore, the aforementioned mother board and driver board are connected through a flexible printed circuit FPC such that the mother board is placed at the back of the TFT panel. In other words, the TFT panel and the mother board are superposed across a back light board.

Figure 15:
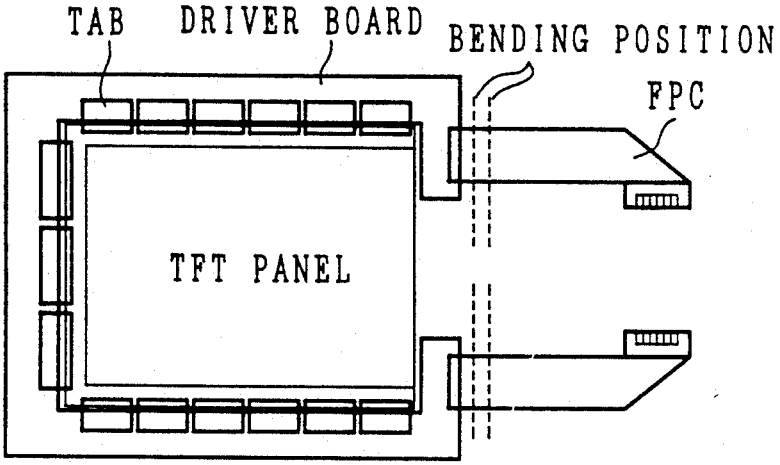
FIG. 15 is a front elevation showing another embodiment of the half tone liquid crystal display circuit according to the present invention.

FIG. 15 is a front elevation showing another embodiment of the half tone liquid crystal display circuit according to the present invention. In order to facilitate understanding of the structure, the flexible printed circuit is expanded in FIG. 15. In this embodiment, the driver board is formed into a fallen "U-shape", which has three sides corresponding to the upper, lower and lefthand sides of the TFT (LCD) panel. This driver board is equipped with tabs, of which the upper and lower tabs are packaged with the semiconductor integrated circuit devices constituting the drain drivers whereas the lefthand side is packaged with the semiconductor integrated circuit devices constituting the gate drivers. The aforementioned tabs are equipped with wiring patterns for connecting the output terminals of the semiconductor integrated circuit devices such as the drain drivers or gate drivers packaged therein, individually with the corresponding signal line electrodes and scanning line electrodes of the TFT panel. As a result, the driver board thus packaged with the aforementioned tabs and semiconductor integrated circuit devices is assembled so thin with the TFT panel as to form a generally coextensive plane. Moreover, there are disposed at the righthand of the driver board vertically two flexible printed circuits FPC for connecting the driver board and the mother board arranged at the back.

Figure 16:
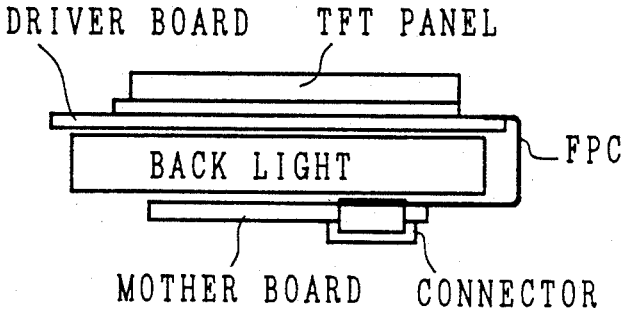
FIG. 16 is a side elevation showing another embodiment of the aforementioned half tone liquid crystal display circuit.

FIG. 16 is a side elevation showing another embodiment of the half tone liquid crystal display circuit according to the present invention. This side elevation corresponds to the front elevation shown in FIG. 15. In this embodiment, across the back light, the TFT panel and the driver board are arranged at the front, whereas the mother board is arranged at the back. These components at the front and back sides are connected through the flexible printed circuit FPC. In this case, the mother board and the flexible printed circuit FPC are connected through a connector. This sandwich structure across the back light is exemplified, too, in the half tone liquid crystal display circuit shown in FIG. 14. Specifically, the embodiment of FIG. 14 is slightly different in the method of mounting the flexible printed circuit FPC.

Figure 17:
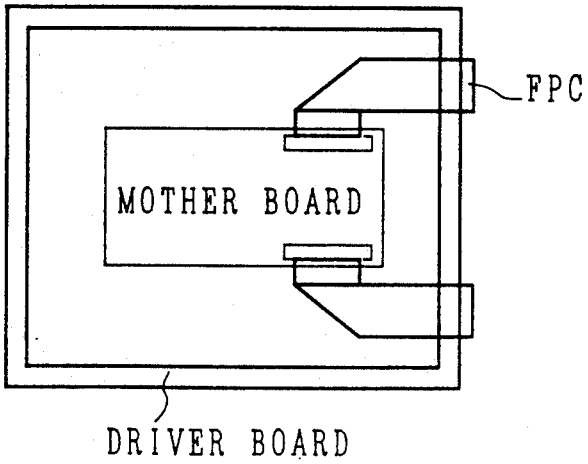
FIG. 17 is a back elevation showing another embodiment of the aforementioned half tone liquid crystal display circuit.

FIG. 17 is a back elevation showing another embodiment of the half tone liquid crystal display circuit according to the present invention. This back elevation of FIG. 17 corresponds to the front elevation shown in FIG. 15. In this embodiment, the mother board is completely superposed on the TFT panel and the driver board, as shown in FIG. 17. Specifically, the driver board and the mother board are superposed across the not-shown back light. As a result, even if the mother board has its size enlarged to package the half tone driving voltage generator, as described above, it is possible to prevent the overall size of the liquid crystal display circuit from being enlarged, as viewed from the front.

Next, the TFT panel (or LCD panel) to be used in the half tone liquid crystal display circuit according to the present invention will be described in detail in the following.

Figure 18A:
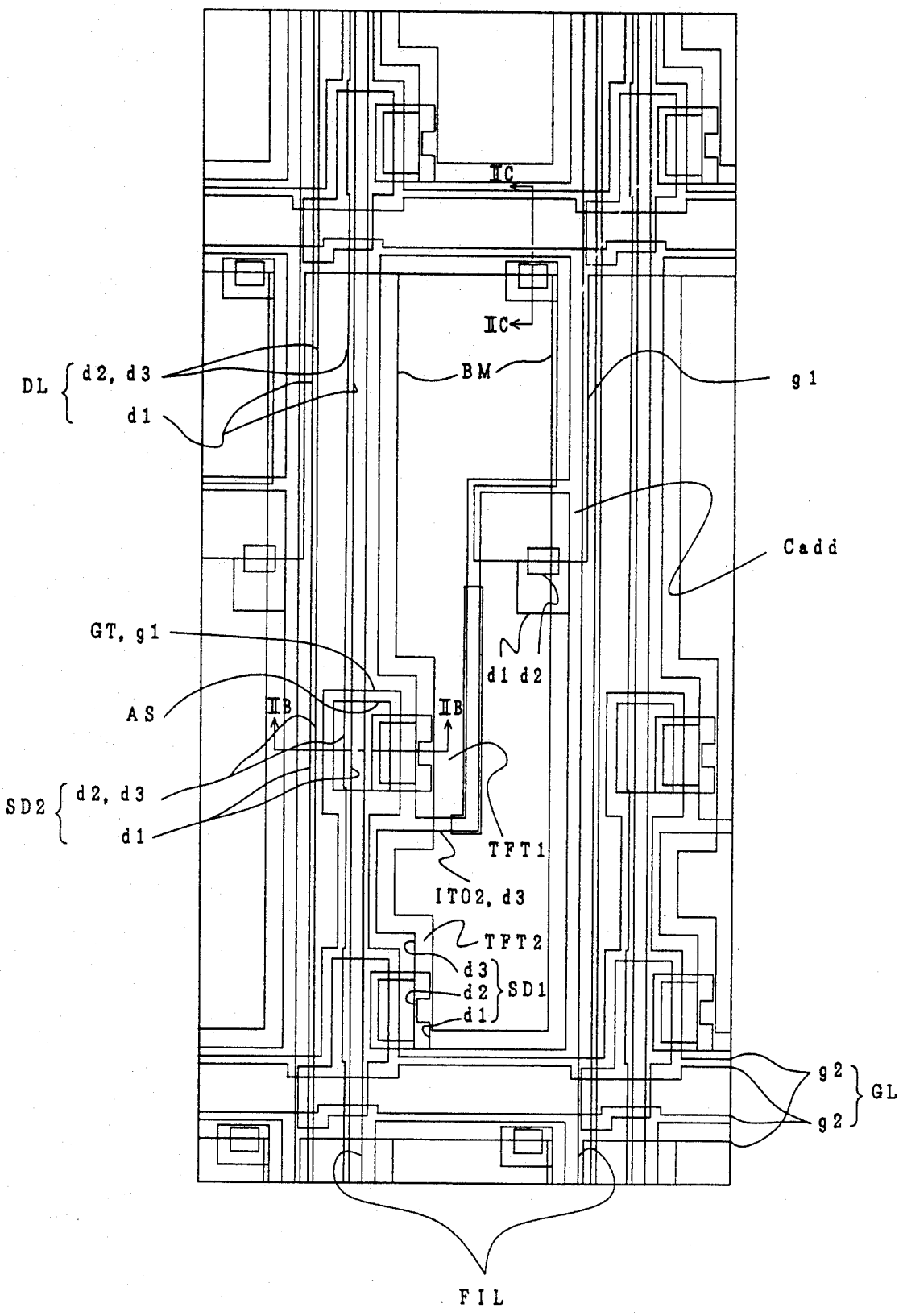
FIG. 18A is a top plan view showing one embodiment of one pixel of its peripheral portion of the active matrix type color liquid crystal display circuit, to which the present invention is applied.
Figure 18B:
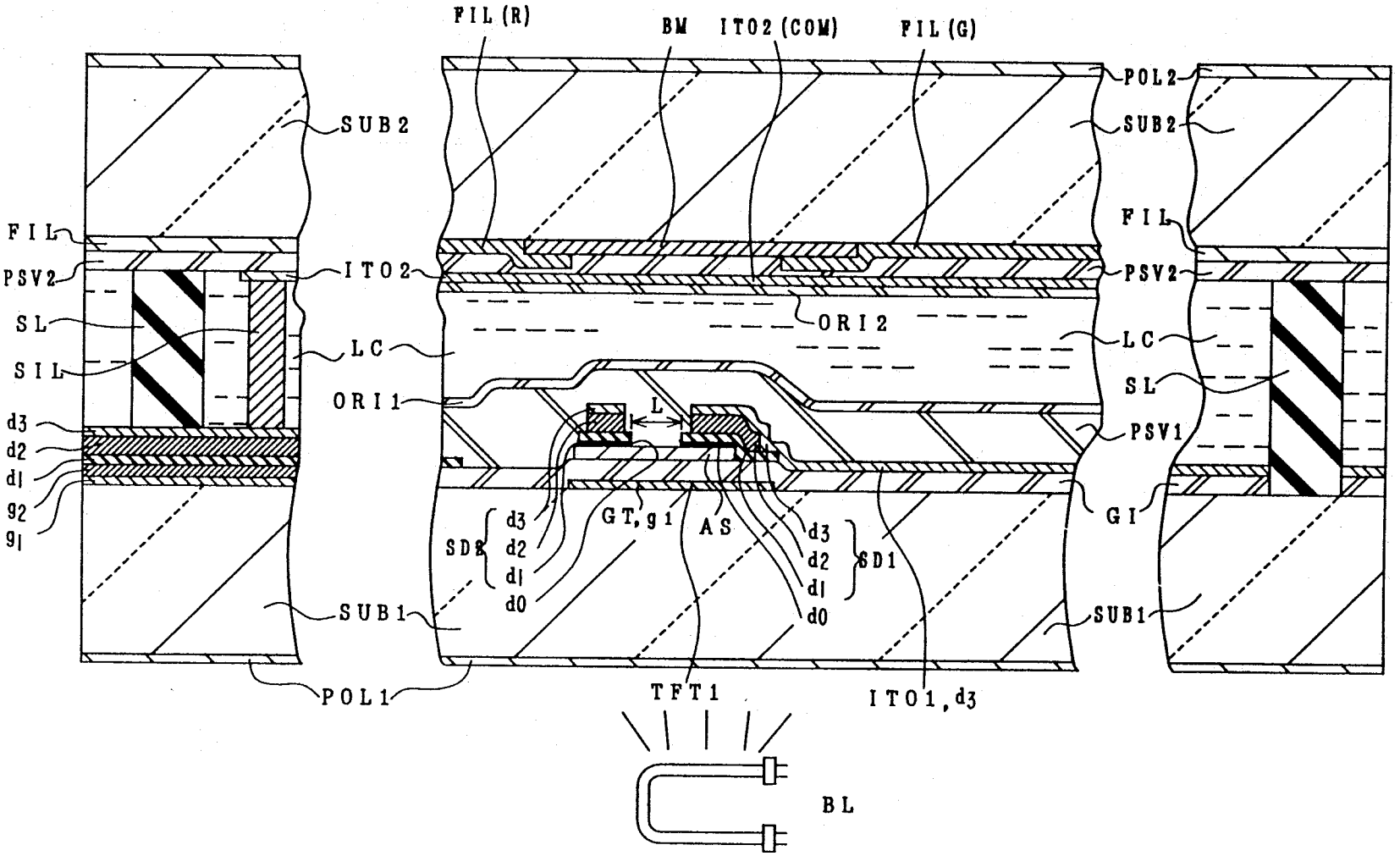
FIG. 18B is a section taken along line IIB—IIB of FIG. 18A showing one embodiment and the sealing member of the display panel.

FIG. 18A is a top plan view showing one embodiment of one pixel and its peripheral portion of the active matrix type color liquid crystal display circuit. FIG. 18B is a section taken along line IIB—IIB of FIG. 18A and shows the embodiment and the vicinity of the sealing portion of the display panel.

Figure 18C:
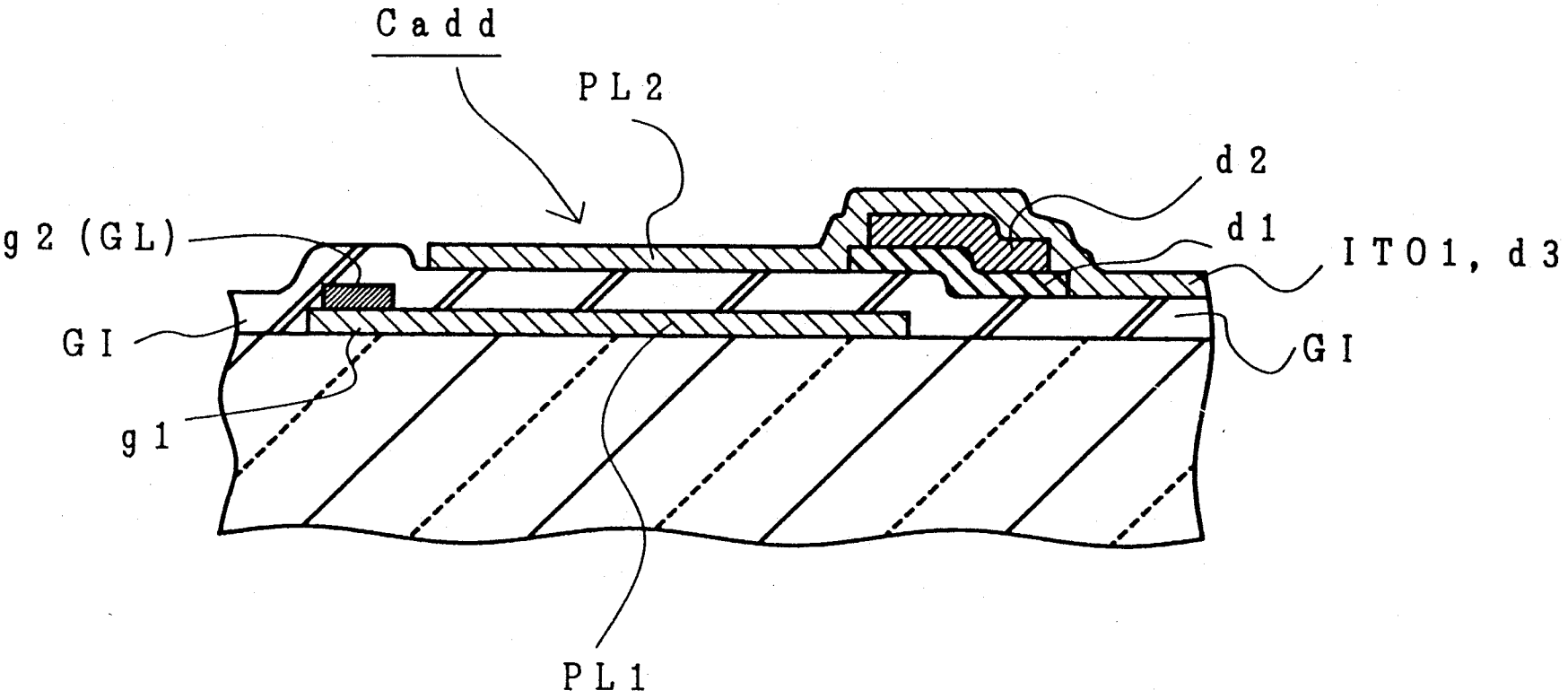
FIG. 18C is a section taken along line IIC—IIC of FIG. 18A.
Figure 19:
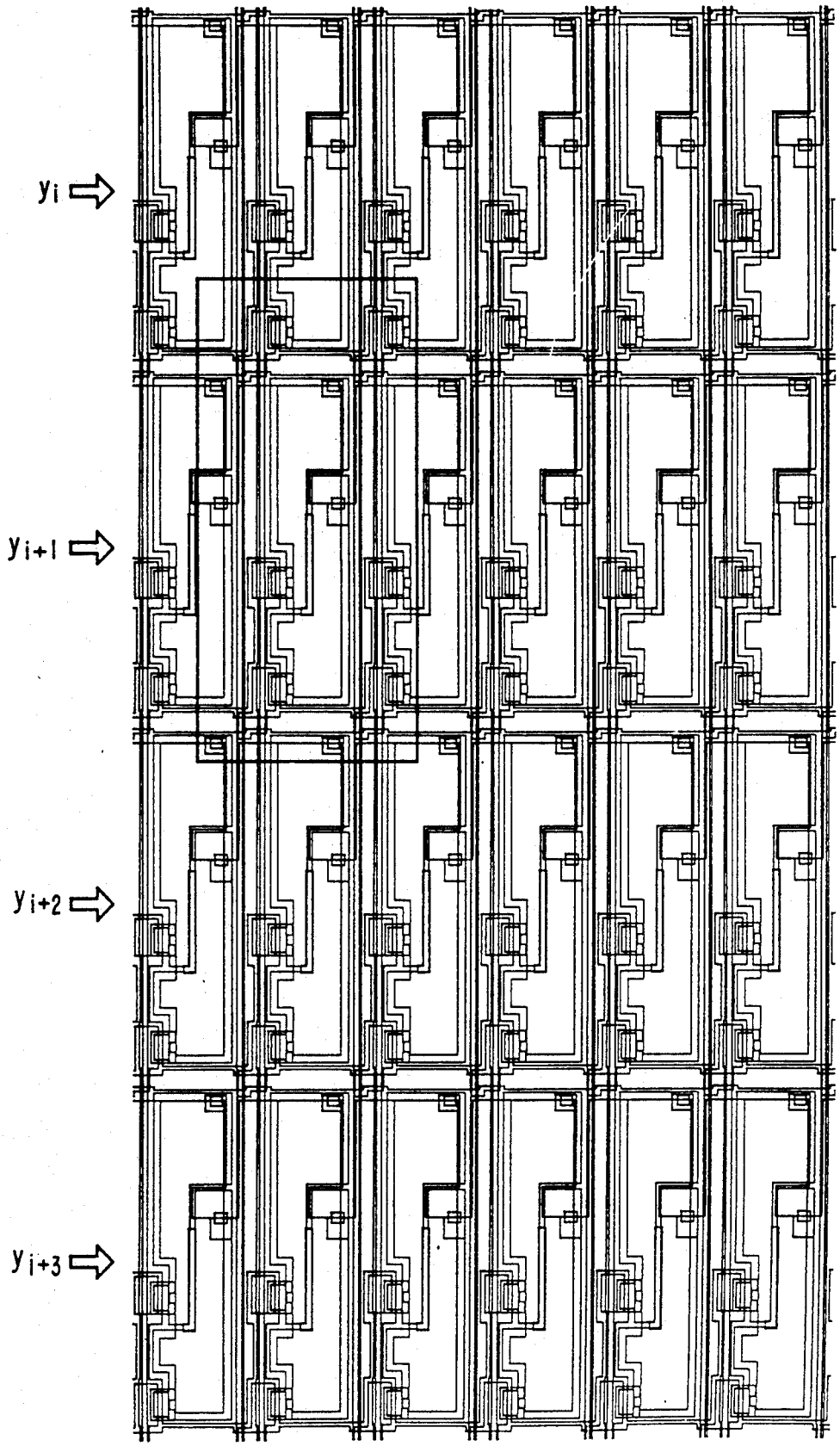
FIG. 19 is a top plan view showing one embodiment with a plurality of pixels as shown in FIG. 18A a semicolon.

FIG. 18C is a section taken along IIC—IIC of FIG. 18A and shows this embodiment. On the other hand, FIG. 19 (showing an essential portion in a top plan view) is a top plan view showing one embodiment in a case where a number of pixels shown in FIG. 18A are arranged.

Pixel Arrangement

As shown in FIG. 18A, each pixel is arranged in a cross region (defined by four signal lines, i.e., two operation signal lines and two video signal lines) between two adjacent operation signal lines (e.g., gate signal lines or horizontal signal lines) GL and two video signal lines (e.g., drain signal lines or vertical signal lines) DL. Each pixel includes a thin film transistor TFT, a pixel electrode ITO1 and a additional capacitor Cadd. The scanning signal lines GL are extended in the column direction and arranged in plurality in the row direction. The video signal lines DL are extended in the row direction and arranged in plurality in the column direction. (Overall Structure of Panel Section)

As shown in FIG. 18B, the thin film transistor TFT and the transparent pixel electrode ITO1 are formed at the side of a lower transparent glass substrate SUB1 across a liquid crystal layer LC, and a color film FIL and a shielding black matrix pattern BM are formed at the side of an upper transparent glass substrate SUB2. The side of the lower transparent glass substrate SUB1 is made to have a thickness of about 1.1 (mm), for example.

FIG. 18B presents a section of a one pixel portion at its center and a section of the portion, i.e., the lefthand side edges of the transparent glass substrates SUB1 and SUB2, in which the leading-out wires are present, at its lefthand side. The righthand side presents a section of a portion, i.e., the righthand side edges of the transparent glass substrates SUB1 and SUB2, in which the leading-out wires are absent.

Sealing members SL, as indicated at the lefthand and righthand sides of FIG. 18B, are made to seal the liquid crystal LC and are formed along the whole edges of the transparent glass substrates SUB1 and SUB2 excepting the liquid crystal sealing port (an open parenthesis not shown). For example the sealing members SL may be made of an epoxy resin.

A common transparent pixel electrode ITO2 at the side of the aforementioned upper transparent glass substrate SUB2 has its at least one portion connected with the leading-out wire, which is formed at the side of the lower transparent glass substrate SUB1, by means of silver paste SIL. This leading-out wire is formed at the fabrication step shared with the aforementioned gate electrode GT, source electrode SD1 and drain electrode SD2.

The individual layers of alignment films ORI1 and ORI2, transparent pixel electrode ITO1, common transparent pixel electrode ITO2, passivation films PSV1 and PSV2 and insulating film GI are formed inside of the sealing member SL. Polarizers POL1 and POL2 are formed on the individual outer surfaces of the lower transparent glass substrate SUB1 and the upper transparent glass substrate SUB2.

A liquid crystal LC is filled between the lower alignment film ORI1 and upper alignment film ORI2 for setting the orientations of the liquid crystal molecules and is sealed with the sealing member SL.

The lower alignment film ORI1 is formed over the passivation film PSV1 at the side of the lower transparent glass substrate SUB1.

On the surface of the inside (at the liquid crystal side) of the upper transparent glass substrate SUB2, there are sequentially laminated a shielding film BM, a color filter FIL, a passivation film PSV2, a common transparent pixel electrode (COM) ITO2 and an upper alignment film ORI2.

This liquid crystal display circuit is assembled by forming the individual layers at the sides of the lower transparent glass substrate SUB1 and the upper transparent glass substrate SUB2 by subsequently superposing the upper and lower transparent glass substrates SUB1 and SUB2 and by filling the liquid crystal LC between the two.

Thin Film Transistor TFT

If a positive bias is applied to the gate electrode GT, the thin film transistor TFT has its channel resistance reduced between its source and drain. If the bias is reduced to zero, the thin film transistor TFT operates to have its channel resistance increased.

The thin film transistor TFT of each pixel is divided into two (or plurality) so that it is composed of thin film transistors (or divided thin film transistors) TFT1 and TFT2. These thin film transistors TFT1 and TFT2 are individually made to have a substantially equal size in the channel length and width. Each of these divided thin film transistors TFT1 and TFT2 is composed mainly of a gate electrode GT, a gate insulating film GI, an i-type (i.e., intrinsic type not doped with a conductivity type determining impurity) amorphous Si semiconductor layer AS, and a pair of source electrode SD1 and drain electrode SD2. The source and drain are intrinsically determined in dependence upon the applied bias polarity, and this polarity is inverted during the operation in the circuit of the present display circuit. Thus, it should be understood that the source and drain are interchanged during the operation. In the following description, however, one is fixed as the source whereas the other is fixed as the drain, for conveniences only.

Gate Electrode GT

Figure 20:
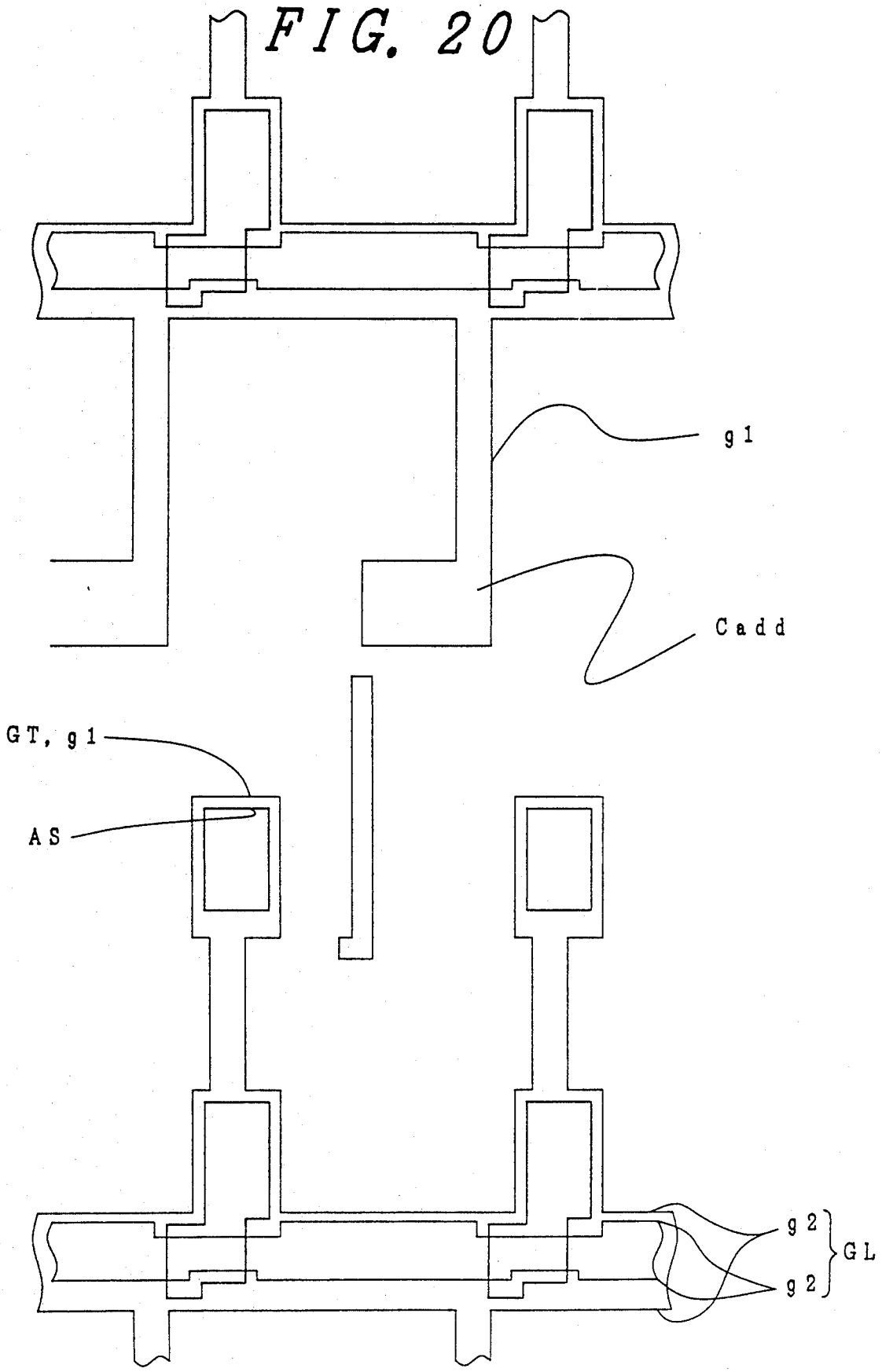
FIGS. 20 to 22 are top plan views showing only a predetermined layer shown in FIG. 18A.

The gate electrode GT is formed to project perpendicularly (i.e., upward, as viewed in FIGS. 2A and 4) from the scanning signal lines GL (or branched in the "T-shape"), as shown in detail in FIG. 20 (presenting a top plan view showing the layers g1, g2 and AS of FIG. 18A only). The gate electrode GT is extended to the regions to be individually formed with the thin film transistors TFT1 and TFT2. These thin film transistors TFT1 and TFT2 have their individual gate electrodes GT integrated (as their common gate electrode) to merge into the scanning signal line GL. The gate electrode GT is formed of a single-layered first conductive film g1 so that a high step may not be formed in the regions to be formed with the thin film transistors TFT. This first conductive film g1 is made of a sputtered chromium (Cr) film, for example, to have a thickness as small as about 1,000 (A).

This gate electrode GT is made so as to cover the semiconductor layer AS completely (as viewed upward), as shown in FIGS. 18A and 18B and FIG. 20. In case, therefore, a back light BL such as a fluorescent lamp is attached to the bottom of the substrate SUB1, this opaque Cr gate electrode GT establishes a shadow to shield the semiconductor layer AS from the back light, thus substantially eliminating the conducting phenomenon due to the optical irradiation, i.e., the deterioration of the OFF characteristics of the TFTs. Here, the intrinsic size of the gate electrode GT is given the least necessary width (including the positioning allowance of the gate electrode of the source/drain electrodes) for extending between the source/drain electrodes SD1 and SD2. The depth for determining that channel width W is determined in dependence upon the factor W/L determining the mutual conductance gm, i.e., the ratio to the distance (i.e., the channel length) L between the source/drain electrodes.

The size of the gate electrode in the present embodiment is naturally made larger than the aforementioned intrinsic size.

The gate electrode GT and its wiring line GL may be integrally formed of a single layer if considered from the gating and shielding functions of the gate electrode GT. In this case, the opaque conductive material to be selected can be exemplified by Al containing Si, pure Al, or Al containing Pd.

Scanning Signal Line GL

The aforementioned scanning signal line GL is formed of a composite film which is composed of the first conductive film g1 and the second conductive film g2 formed over the former. The first conductive film g1 of the scanning signal line GL is formed at the same step and integrally with the first conductive film of the aforementioned gate electrode GT. The second conductive film g2 is formed of a sputtered aluminum (Al), for example, to have a thickness of about 2,000 to 4,000 (Å). The second conductive film g2 is formed to reduce the resistance of the scanning signal line GL thereby to speed up the signal transmission rate (or to improve the information writing characteristics of the pixel).

Moreover, the scanning signal line GL has its second conductive film g2 made to have a smaller width than that of the first conductive film g1. In other words, the scanning signal line GL has a gentle step at its side wall.

Gate Insulating Film GI

The insulating film GI is used as the individual gate insulating films of the thin film transistors TFT1 and TFT2. The insulating film GI is formed over the gate electrode GT and the scanning signal line GL. The insulating film GI is formed of a silicon nitride film prepared by the plasma CVD, for example, to have a thickness of about 3,000 (Å).

Semiconductor Layer AS

The i-type semiconductor layer AS is used as the individual channel forming regions of the thin film transistors TFT1 and TFT2 divided into a plurality of parts as shown in FIG. 20. The i-type semiconductor layer AS is formed of an amorphous silicon film or polycrystalline silicon film to have a thickness of about 1,800 (Å).

This i-type semiconductor layer AS is formed subsequent to the formation of the $Si_3N_4$ gate insulating film GI by changing the components of supply gases but by using the common plasma CVD system such that it is not exposed from the system to the outside. On the other hand, an $N^+$-type layer d0 (shown in FIG. 18B) doped with P for the ohmic contact is likewise formed subsequently to have a thickness of about 400 (Å). After this, the lower substrate SUB1 is taken out of the CVD system, and the $N^+$-type layer d0 and the i-type AS are patterned into independent islands by the photographic technology, as shown in FIGS. 18A and 18B.

The i-th semiconductor layer AS is also formed between the intersecting portions (or crossover portions) of the scanning signal line GL and the video signal line DL, as shown in detail in FIG. 18A and FIG. 20. This cross over i-type semiconductor layer AS is formed to reduce the short-circuiting between the scanning signal line GL and the video signal line DL at the intersecting portion.

Source/Drain Electrodes SD1 and SD2

Figure 21:
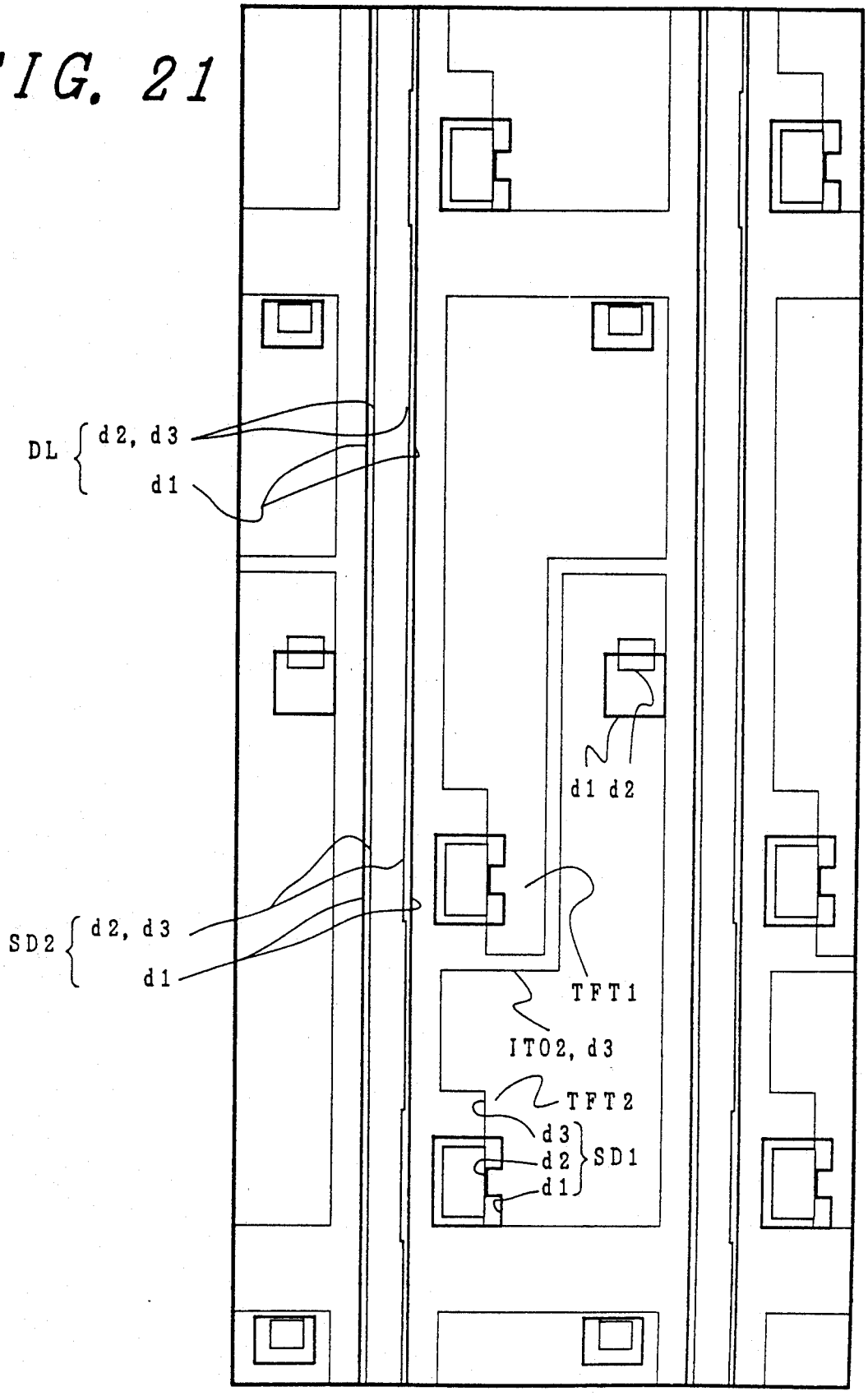

The individual source electrodes SD1 and drain electrodes SD2 of the divided thin film transistors TFT1 and TFT2 are formed over the semiconductor layer AS and separately from each other, as shown in detail in FIGS. 18A and 18B and in FIG. 21 (presenting a top plan view showing the layers d1 to d3 of FIG. 18A only).

Each of the source electrode SD1 and the drain electrode SD2 is formed by overlaying a first conductive film d1, a second conductive film d2 and a third conductive film d3 sequentially from the lower side contacting with the $N^+$-type semiconductor layer d0. The first conductive film d1, second conductive film d2 and third conductive film d3 of the source electrode SD1 are formed at the same fabrication step as those of the drain electrode SD2.

The first conductive film d1 is formed of a sputtered chromium film to have a thickness of 500 to 1,000 (Å) (e.g., about 600 (Å) in the present embodiment). The chromium film is formed to have a thickness no more than 2,000 (Å) because it establishes a high stress if it is made excessively thick. The chromium film has an excellent contact with the $N^+$-type semiconductor layer d0. This chromium film constitutes the so-called "barrier layer" for preventing the aluminum of the later-described second conductive film d2 from diffusing into the $N^+$-type semiconductor layer d0. The first conductive film d1 may be made of not only the aforementioned chromium film but also a refractory metal (e.g., Mo, Ti, Ta or W) film or its silicide (e.g., $MoSi_2$, $TiSi_2$, $TaSi_2$ or $WSi_2$).

After the first conductive film d1 has been patterned with the photography, the $N^+$-type layer d0 is removed by using the same photographic mask or the first conductive film d1. Specifically, the $N^+$-type layer d0 left on the i-th layer AS is removed in self-alignment while leaving the first conductive film d1 as it is. Since, at this time, the $N^+$-type layer d0 is etched to remove its whole thickness, the i-th layer AS is slightly etched off at its surface portion, but this removal may be controlled by the etching period.

After this, the second conductive film d2 is formed of sputtered aluminum to have a thickness of 3,000 to 4,000 (Å) (e.g., about 3,000 (Å) in the present embodiment). The aluminum layer is less stressed than the chromium layer so that it can be formed to have larger thickness thereby to reduce the resistances of the source electrode SD1, the drain electrode SD2 and the video signal line DL. The second conductive film d2 may be formed of not only the aluminum film but also an aluminum film containing silicon (Si) or copper (Cu) as an additive.

After the second conductive film d2 has been patterned by the photographic technology, the third conductive film d3 is formed. This third conductive film d3 is formed of a sputtered transparent conductive film (e.g., ITO, i.e., Indium-Tin-Oxide: NESA film) to have a thickness of 1,000 to 2,000 (Å) (about 1,200 (Å) in the present embodiment). This third conductive film d3 constitutes not only the source electrode SD1, the drain electrode SD2 and the video signal line DL but also the transparent pixel electrode ITO1.

Each of the first conductive film d1 of the source electrode SD1 and the first conductive film d1 of the drain electrode SD2 is internally (i.e., into the channel region) turned more deeply than the upper lying second conductive film d2 and third conductive film d3. In other words, the first conductive films d1 in those portions are enabled to regulate the gate length L of the thin film transistor TFT independently of the layers d2 and d3.

The source electrode SD1 is connected with the transparent pixel electrode ITO1, as has been described hereinbefore. The source electrode SD1 is formed along the stepped shape (i.e., the step corresponding to the sum of the thicknesses of the first conductive film d1, the $N^+$-type layer d0 and the i-type semiconductor layer AS) of the i-th type semiconductor layer AS. More specifically, the source electrode SD1 is composed of the first conductive film d1 formed along the stepped shape of the i-type semiconductor layer AS; the second conductive film d2 formed over the first conductive film d1 but sized smaller than the first conductive film d1 at its side to be connected with the transparent pixel electrode ITO1; and the third conductive film d3 connected with the portion of the first conductive film d1 exposed to the outside from the second conductive film d2. This second conductive film d2 of the source electrode SD1 is formed to ride over the i-type semiconductor layer AS because the chromium film of the first conductive film d1 cannot made so thick because of the increase in the stress as to ride over the stepped shape of the i-type semiconductor layer AS. In short, the second conductive film d2 is made thick to improve the step coverage. The second conductive film d2 can be made thick so that it can highly contribute to the reduction of the resistance of the source electrode SD1 (as well as those of the drain electrode SD2 and the video signal line DL). The third conductive film d3 is connected with the first conductive film d1, which is exposed to the outside by reducing the size of the second conductive film d2, because it cannot ride over the stepped shape made by the i-type semiconductor layer AS of the second conductive film d2. The first conductive film d1 and the third conductive film d3 can not only have an excellent adherence but also ensure the connections because their connected portions have a small step.

Pixel Electrode ITO1

The aforementioned transparent pixel electrode ITO1 is provided for each pixel and constitutes one of the pixel electrodes of the liquid crystal display. The transparent pixel electrode ITO1 is divided into two transparent pixel electrodes (i.e., divided transparent pixel electrodes) E1 and E2 corresponding to the thin film transistors TFT1 and TFT2 which are divided for the plural pixels). Each of the transparent pixel electrode E1 and E2 is connected with the source electrode SD1 of the thin film transistor TFT.

Each of the transparent pixel electrodes E1 and E2 is patterned to have a substantially equal area.

Thus, the thin film transistor TFT of one pixel is divided into the plural thin film transistors TFT1 and TFT2, which in turn are individually connected with the divided transparent electrodes E1 and E2. As a result, even if one divided portion (e.g., TFT1) has its point defected, this defect is eliminated, if viewed all over the pixel (because the other TFT2 is not defective), so that the probability of the point defect can be reduced. Moreover, the defect itself can be made hard to see.

If, moreover, the divided transparent pixel electrodes E1 and E2 of the pixel are made to have the substantially equal areas, it is possible to make uniform the capacity (Cpix) of the liquid crystal which is composed of the transparent pixel electrodes E1 and E2 and the common transparent pixel electrode ITO2).

Passivation Film PSV1

Over the thin film transistor TFT and the transparent pixel electrode ITO1, there is formed the passivation film PSV1, which is provided mainly for protecting the thin film transistor TFT against humidity. Thus, the passivation film PSV1 to be used is highly transparent and humidity resistant. The passivation film PSV1 is formed of a silicon oxide film or silicon nitride film prepared by the plasma CVD, to have a thickness of about 8,000 (Å).

Shielding Film BM

Figure 22:
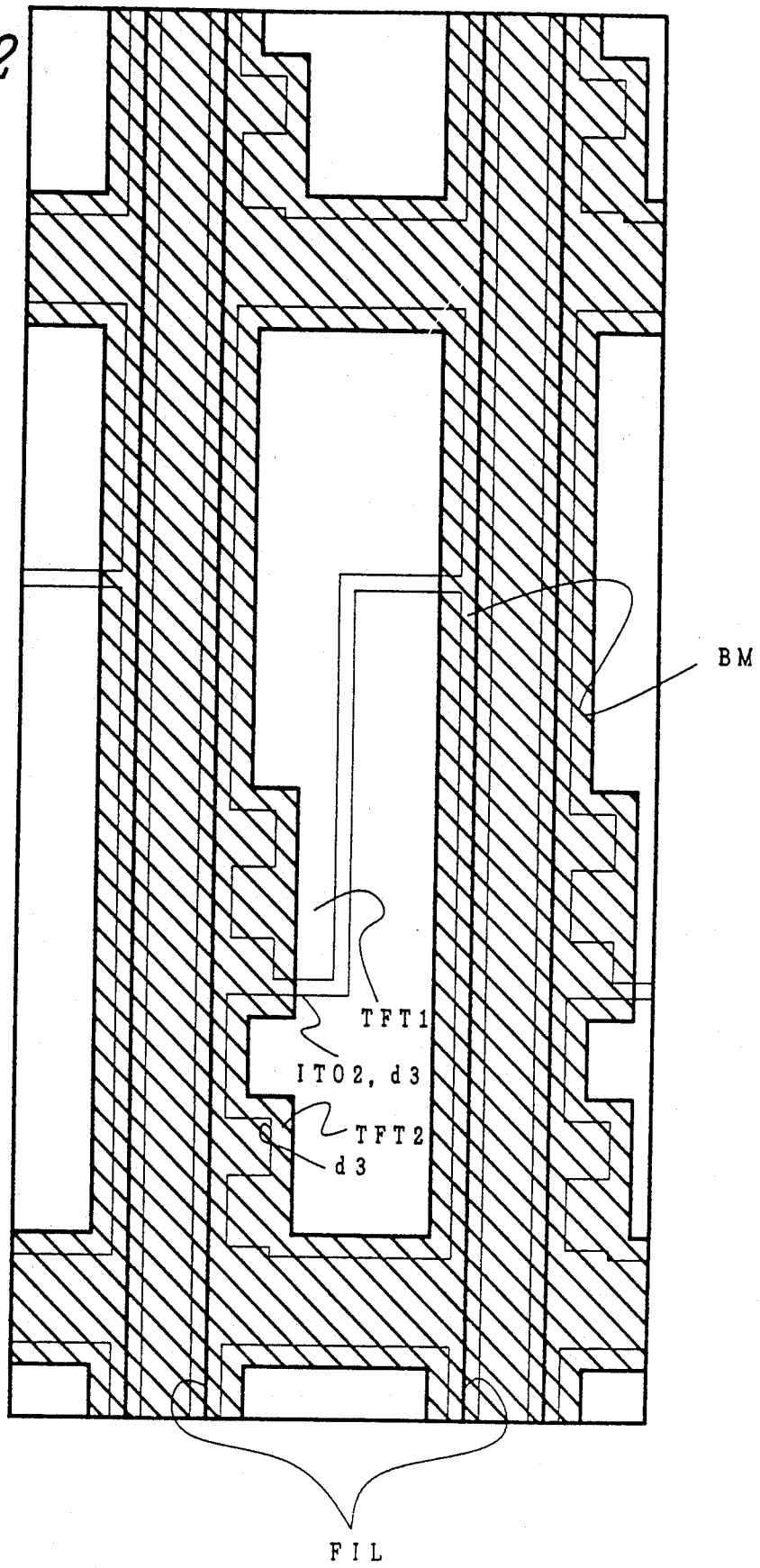

At the side of the upper substrate SUB2, there is disposed the shielding film BM for shielding any external light (i.e., the light coming from the top of FIG. 18B) from entering the i-type semiconductor layer AS to be used as the channel forming region, as hatched to have the pattern shown in FIG. 22. Here, FIG. 22 is a top plan view showing only the ITO film, the layer d3, the filter layer FIL and the shielding film BM of FIG. 18A. The shielding film BM is formed of a film having a high shielding property to the light, e.g., an aluminum film or chromium film. In the present embodiment, the shielding film BM is formed of a chromium film by the sputtering, to have a thickness of about 1,300 (Å).

As a result, the common semiconductor layer AS shared by the TFT1 and TFT2 is sandwiched between the upper shielding film BM and the lower but larger gate electrode GT so that it is shielded from the outside natural light or the back light. The shielding film BM is formed around the pixel, as hatched in FIG. 22. Specifically, the shielding film BM is formed in a lattice (of black matrix) shape, which defines the effective display region of one pixel. As a result, the contour of each pixel is clarified to improve the contrast by the shielding film BM. In other words, this shielding film BM has two functions, i.e., the shielding and black matrix functions for the semiconductor layer AS.

The back light may be attached to the side of SUB2, and, the SUB1 may be disposed at the observation side (exposed to the outside).

Common Electrode ITO2

The common transparent pixel electrode ITO2 is opposed to the transparent pixel electrode ITO2, which is provided for each pixel at the side of the lower transparent glass substrate SUB1, so that the liquid crystal has its optical state varied in response to the potential difference (or electric field) between each pixel electrode ITO1 and the common pixel electrode ITO2. This common transparent pixel electrode ITO2 is fed with the common voltage Vcom. This common voltage Vcom is at an intermediate potential between a driving voltage Vdmin at the low level and a driving voltage Vdmax at the high level, both of which are applied to the video signal line DL.

Color Filter FIL

Figure 23:
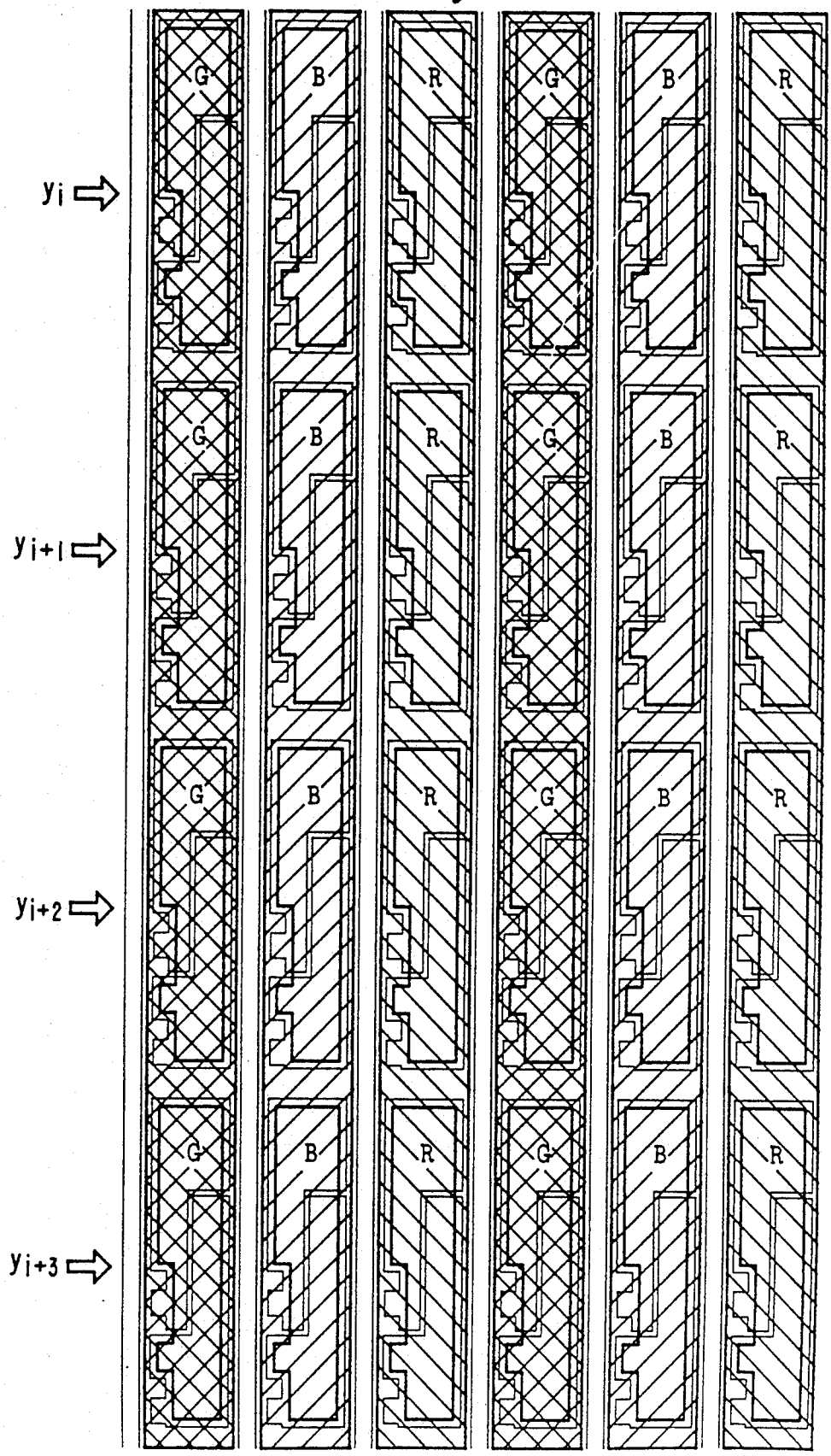
FIG. 23 is a top plan view showing only a pixel electrode layer and a color filter layer shown in FIG. 19.

The color filter FIL is prepared by cooling a dyeing base, which is made of a resin material such as an acrylic resin, with a dye. The color filter FIL is formed (as shown in FIG. 23) in the shape of a dot for each pixel and in a position to face the pixel. FIG. 23 shows the third conductive film d3, the black matrix layer BM and the color filter layer FIL of FIG. 19 only, and the R, G and B filters are hatched at 45 degrees and 135 degrees and in a cloth, respectively.

The color filter FIL is made large enough to cover the pixel electrode ITO1 (e.g., E1 and E2) in its entirety, as shown in FIG. 22. The shielding film BM is so formed inside of the peripheral edge of the pixel electrode ITO1 as to overlap the color filter FIL and the pixel electrode ITO1.

The color filter FIL can be formed in the following manner. First of all, the dyeing base is formed on the surface of the upper transparent glass substrate SUB2 and the dyeing base other than that in the red color filter forming region is removed by the photolithographic technology. After this, the dyeing base is dyed with the red dye and fixed to form the red filter R. Next, the green filter G and the blue filter B are sequentially formed by the similar steps.

The passivation film PSV2 is provided for preventing the dyes for the different colors of the aforementioned color filter FIL from leaking into the liquid crystal LC. The passivation film PSV2 is made of a transparent resin material such as an acrylic resin or epoxy resin.

Equivalent Circuit of Whole Display Panel

Figure 24:
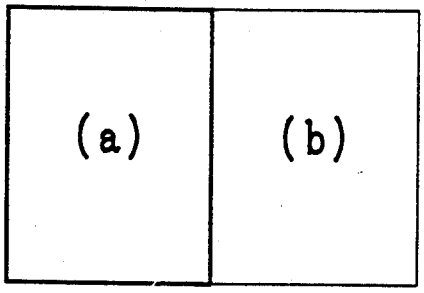
FIG. 24 is an equivalent circuit diagram showing the liquid crystal display portion of the active matrix type color liquid crystal display circuit.
Figure 24:
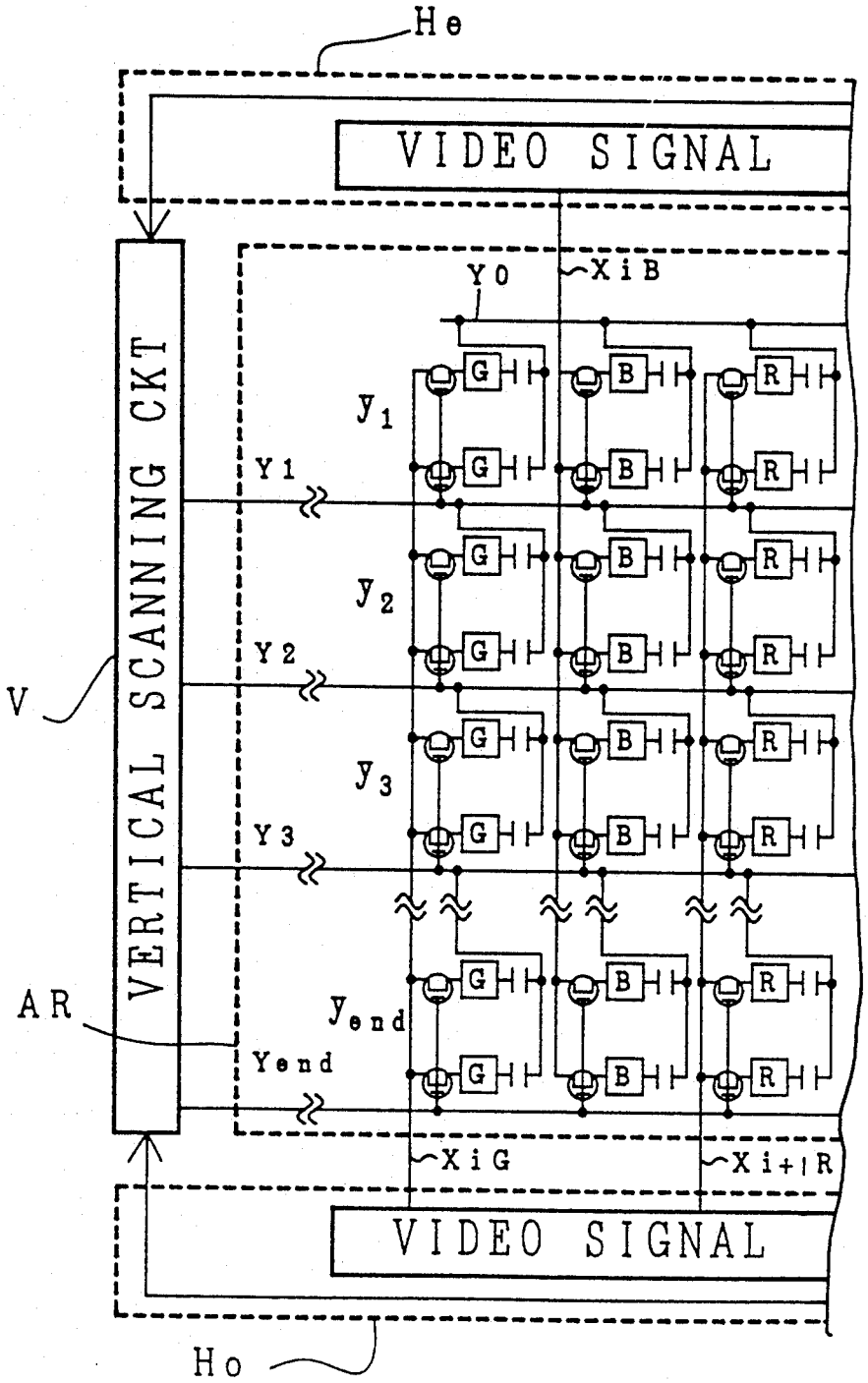
Figure 24:
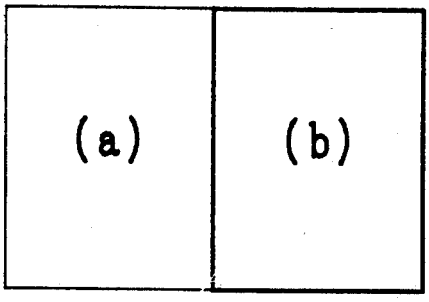
Figure 24:
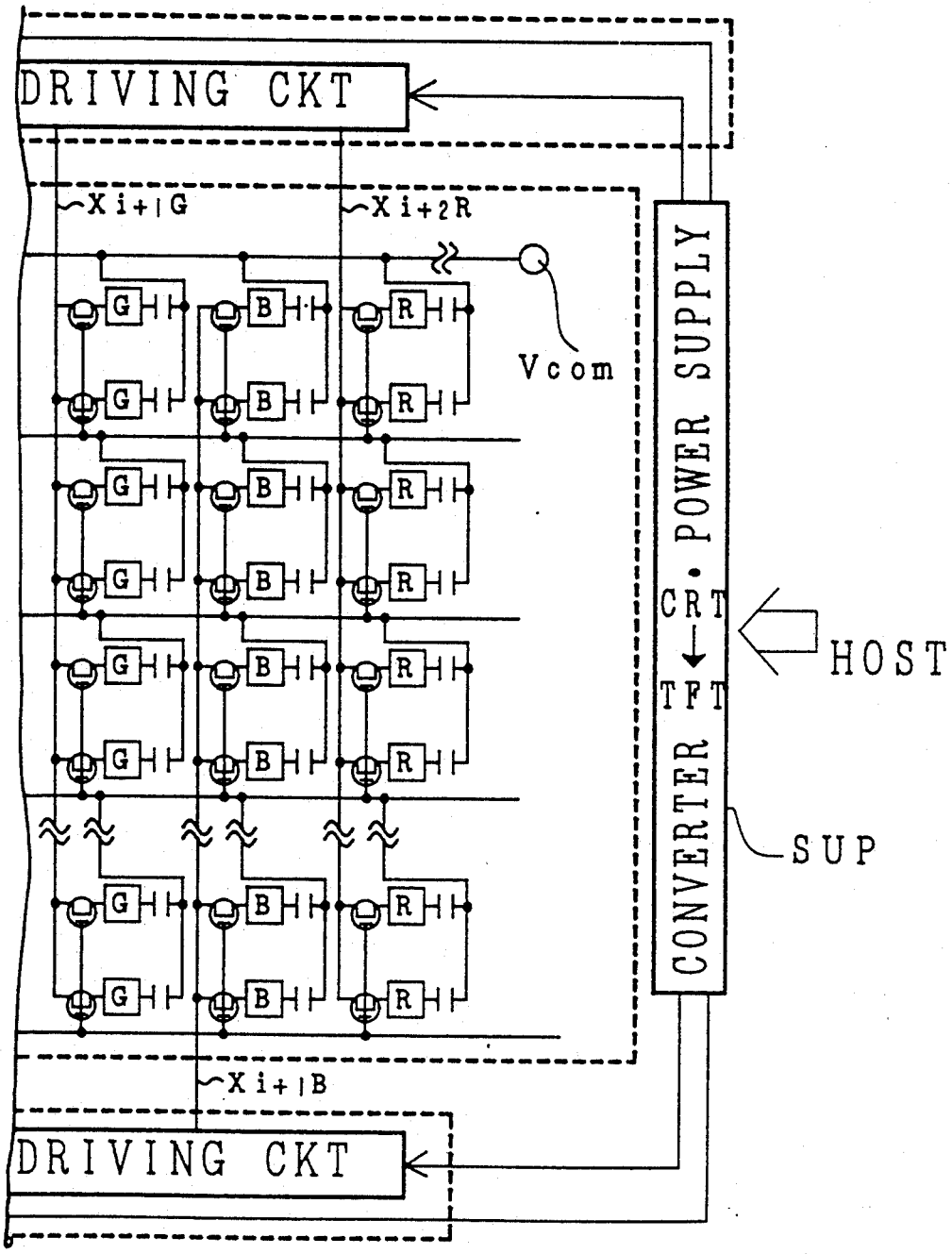

The equivalent circuit of the display matrix and its peripheral circuits are shown in a connection diagram in FIG. 24. FIG. 24 is a circuit diagram but is drawn to correspond to the actual geometric arrangement. Letters AR designate a matrix array of a plurality of pixels arrayed two-dimensionally.

In FIG. 24, letter X designates the video signal lines DL, which are suffixed by the letters G, B and R corresponding to the green, blue and red pixels. Letter Y designates the scanning signal lines, which are suffixed by numerals 1, 2, 3, - - -, and end in accordance with the order of the scanning timing.

The video signal lines X (although not suffixed) are alternately connected with an upper (or odd) video signal driver He and a lower (or even) video signal driver Ho.

Letters SUP designate a circuit including a power supply for generating a plurality of; divided and stabilized voltage supplied from one voltage source; and a circuit for converting the information for the CRT (i.e., Cathode Ray Tube) from a host (i.e., higher rank arithmetic processor) into that for the TFT liquid crystal panel.

Structure of Additional Capacitor Cadd

Each of the transparent pixel electrodes E1 and E2 is formed to overlap the adjoining scanning signal line GL at the end opposite to the end to be connected with the thin film transistor TFT. This superposition constitutes a latching capacity element (or electrostatic capacity element) Cadd which uses each of the transparent pixel electrodes E1 and E2 as its one electrode PL1 and the adjoining scanning signal line GL as its other electrode PL2, as is apparent from FIG. 18C. This latching capacity element Cadd has its dielectric film formed of the same layer as that of the insulating film GI to be used as the gate insulating film of the thin film TFT.

The latching capacitor Cadd is formed in the widened portion of the first layer g1 of the gate line GL, as is apparent from FIG. 20. Here, the layer g1 at the portion intersecting the drain line DL is reduced in thickness; to reduce the probability of the short-circuiting with the drain line.

A portion between each of the transparent pixel electrodes E1 and E2 and the capacity electrode line (g1) to be superposed to constitute the latching capacity Cadd is partially formed like the aforementioned source electrode SD1 with the island region, in which the first conductive film d1 and the second conductive film d2 is formed, so that the transparent pixel electrode ITO1 may not be broken when it rides over the stepped shape. The island region is made as small as possible so that the area (or opening percentage) of the transparent pixel electrode ITO1 may not drop.

Equivalent Circuit of Additional Capacitor Cadd and its Operations

Figure 25:
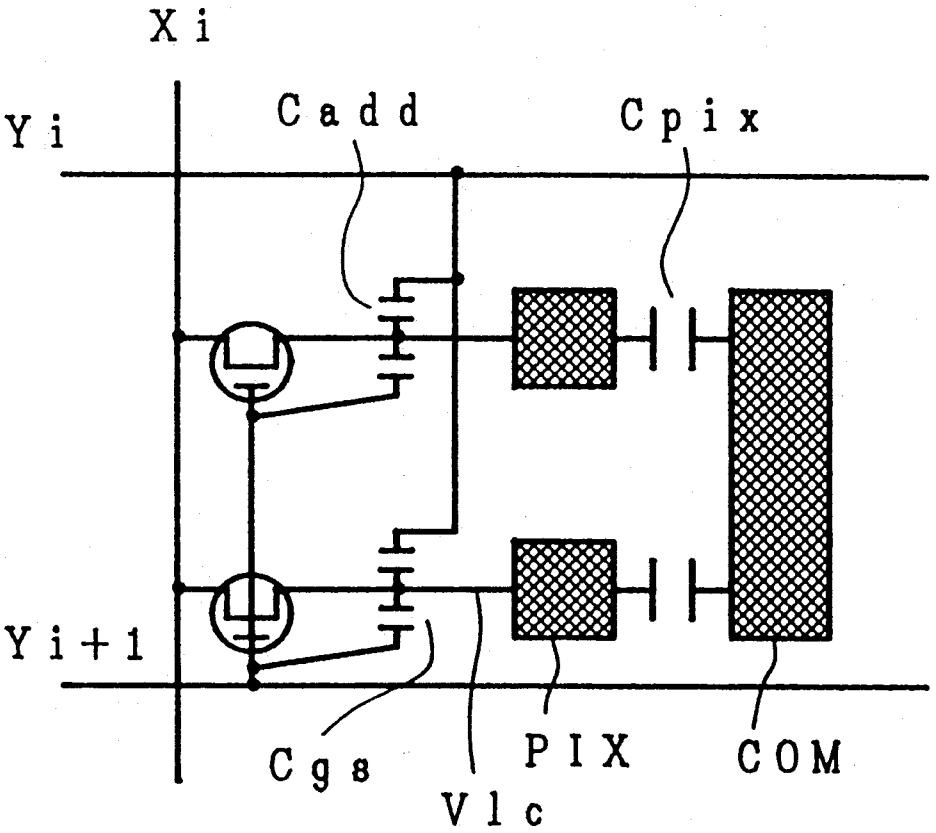
FIG. 25 is an equivalent circuit diagram showing a pixel shown in FIG. 18A.

The equivalent circuit of the pixel shown in FIG. 18A is shown in FIG. 25. In FIG. 25, letters Cgs designate a parasitic capacitor to be formed between the gate electrode GT and the source electrode SD1 of the thin film transistor TFT. The parasitic capacitor Cgs has its dielectric film made of the insulating film GI. Letters Cpix designate a liquid crystal capacitor to be formed between the transparent pixel electrode ITO1 (or PIX) and the common transparent pixel electrode ITO2 (or COM). The dielectric film of the liquid capacitor Cpix is formed of the liquid crystal LC, the passivation film PSV1 and the alignment films ORI1 and ORI2. Letters V1c designate a center potential.

The aforementioned latching capacity element Cadd functions to reduce the influences of the gate potential variation ΔVg upon the center potential (e.g., the pixel electrode potential) V1c when the TFT switches, as expressed by the following formula:

$$\Delta V1c = \{Cgs/(Cgs + Cadd + Cpix)\} \times \Delta Vg,$$

wherein ΔV1c designates the variation of the central potential due to ΔVg.

This variation ΔV1c causes the DC component to be added to the liquid crystal and can be reduced the more for the higher latching capacitor Cadd.

Moreover, the latching capacitor Cadd functions to elongate the discharge time and stores the video information for a long time after the TFT is turned off. The DC component to be applied to the liquid crystal LC can improve the lifetime of the liquid crystal LC, if reduced, to reduce the so-called "printing", by which the preceding image is left at the time of switching the liquid crystal display frame.

Since the gate electrode GT is enlarged to such an extent as to cover the semiconductor layer AS completely, as has been described hereinbefore, the overlapped area with the source/drain electrodes SD1 and SD2 is increased to cause an adverse effect that the parasitic capacity Cgs is increased to make the center potential V1c liable to be influenced by the gate (scanning) signal Vg. However, this problem can be eliminated by providing the latching capacitor Cadd.

The latching capacity of the aforementioned latching capacity element Cadd is set from the pixel writing characteristics to a level four to eight times as large as that of the liquid crystal capacity Cpix ($4 \cdot Cpix < Cadd < 8 \cdot Cpix$) and eight to thirty two times as large as that of the superposed capacity Cgs ($8 \cdot Ccgs < Cadd < 32 \cdot Ccgs$).

Method of Connecting Electrode Line of Additional Capacitor Cadd

The initial state scanning signal line GL (i.e., $Y_0$) to be used only as the capacity electrode line is connected with the common transparent pixel electrode (Vcom) ITO2 as shown in FIG. 24. The common transparent pixel electrode ITO2 is connected with a leading-out line in the peripheral edge of the liquid crystal display circuit by means of a silver paste SL, as shown in FIG. 18B. Moreover, this leading-out line has its partial conductive layer (g1 or g2) prepared at the same step as that of the scanning signal line GL. As a result, the final stage capacity electrode line GL can be easily connected with the common transparent pixel electrode ITO2.

The initial stage $Y_0$ may be connected with either the final stage scanning signal line Yend or a DC potential point (e.g., an AC ground point) other than Vcom or connected to receive one more scanning pulse $Y_0$ from the vertical scanning circuit V.

In the embodiment thus far described, the structure is inversely staggered as follows: formation of the gate electrode→formation of the gate insulating film→formation of the semiconductor film→formation of the source/drain electrodes. However, this staggered structure may be inverted vertically or in the order.

Figure 26:
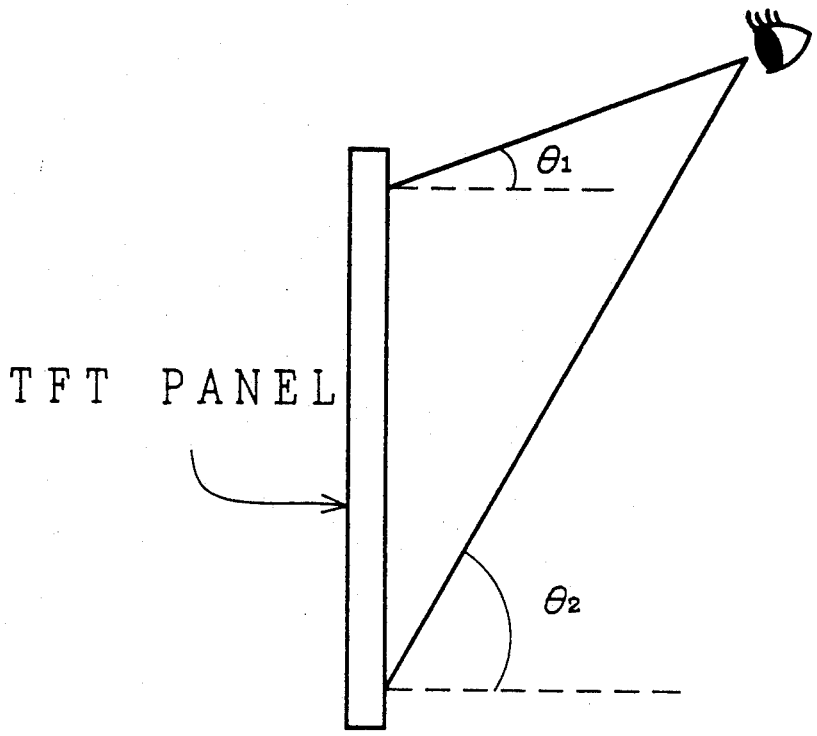
FIG. 26 is a conceptional diagram for explaining another embodiment of the half tone liquid crystal display circuit according to the present invention.

FIG. 26 is a conceptional diagram for explaining another embodiment of the half tone liquid crystal display circuit according to the present invention.

In case the TFT panel is enlarged or in case the observer's eye is brought close to the panel even if this panel is small-sized, the observation angle $\theta_1$ is relatively small for the upper portion of the TFT panel whereas the observation angle $\theta_2$ is relatively large for the lower portion, as shown in FIG. 26. If the observation angle is corrected with respect to the upper portion of the TFT panel, as has been described with reference to FIG. 1, the region, in which the brightness of the liquid crystal is linearly varied, is shifted leftward in its entirety in the lower portion, in which the observation angle is enlarged from $\theta_1$ to $\theta_2$, so that the scales become the more obscure to the lower side of the TFT panel.

We have discovered that the vertical unevenness of the scales is caused in the half tone display of the liquid crystal if the TFT panel has the vertical observation angle difference, in the case the TFT panel is large-sized or in the case the eye is brought close to the relatively small-sized TFT panel. Since, moreover, the vertical unevenness of the scales of the TFT panel is caused by the vertical difference between the observation angles, we have found that the unevenness can be corrected by making use of the features of the variations owned by the aforementioned brightness characteristic curve of the liquid crystal with respect to the variations of the observation angle. In other words, we have conceived a dynamic observation angle correcting method by which the correction angle correction voltage is sequentially varied in association with the scanning timing of the TFT panel in the vertical direction.

Figure 27:
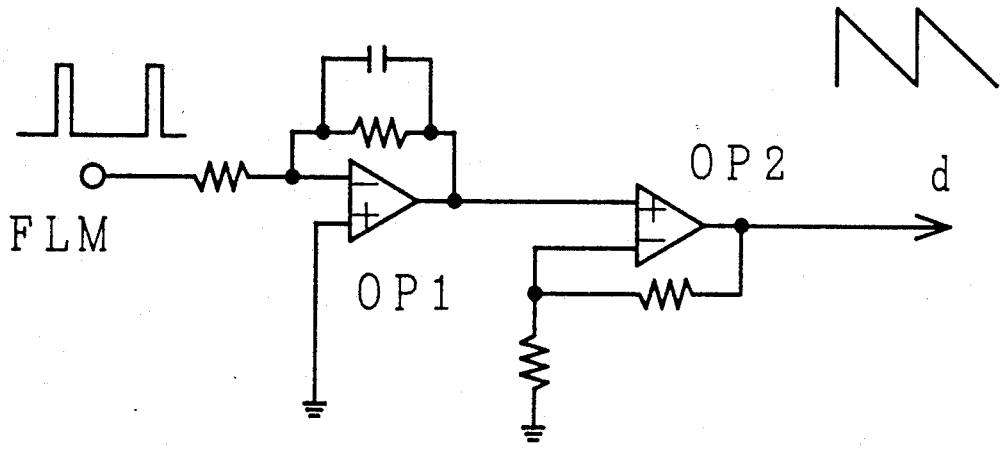
FIG. 27 is a circuit diagram showing one embodiment of a correcting voltage generator corresponding to the vertical difference of observation angles of the TFT panel.

FIG. 27 is a circuit diagram showing one embodiment of the correction voltage generator corresponding to the vertical observation angle difference of the TFT panel.

In this embodiment linear circuit technology is utilized. The operational amplifier OP1 constitutes an integration circuit with its input resistor, feedback resistor and capacitor and receives a frame pulse (or vertical synchronizing signal) FLM. As a result, it is possible to generate a saw-toothed voltage synchronized with the frame period. Since, in this case, the integration circuit integrates the positive pulses FLM, the voltage will drop with a lapse of time. This voltage can be superposed on the correction voltage, which is set with reference to the upper observation angle $\theta_1$ of the TFT panel, to drop the observation angle correction voltage gradually to the lower level, as the observation angle $\theta_2$ becomes the larger, as has been described with reference to FIG. 1. Operational amplifier OP2 is used as a buffer amplifier for adjusting the saw-tooth wave generated by the aforementioned integration circuit and the voltage level. Thus, the saw-toothed correction voltage d is generated by the correction voltage generator.

Figure 28:
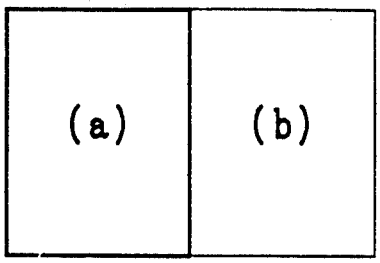
FIG. 28 is a circuit diagram showing one embodiment of the driving voltage generator containing the correcting voltage generator corresponding to the vertical angular difference of the TFT panel.
Figure 28:
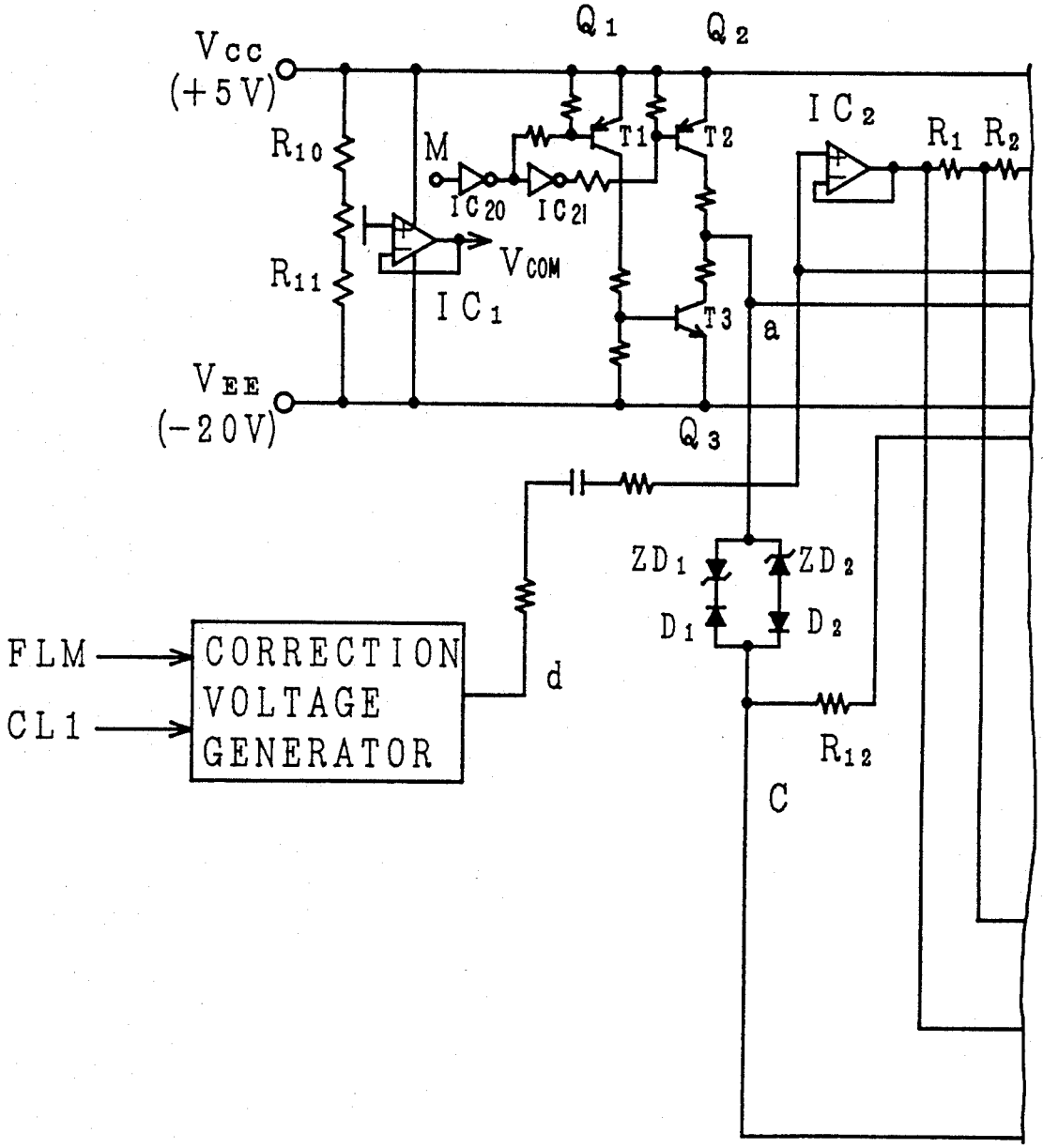
Figure 28:
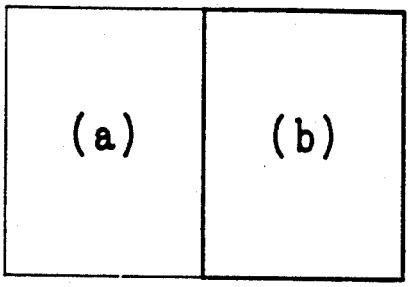
Figure 28:
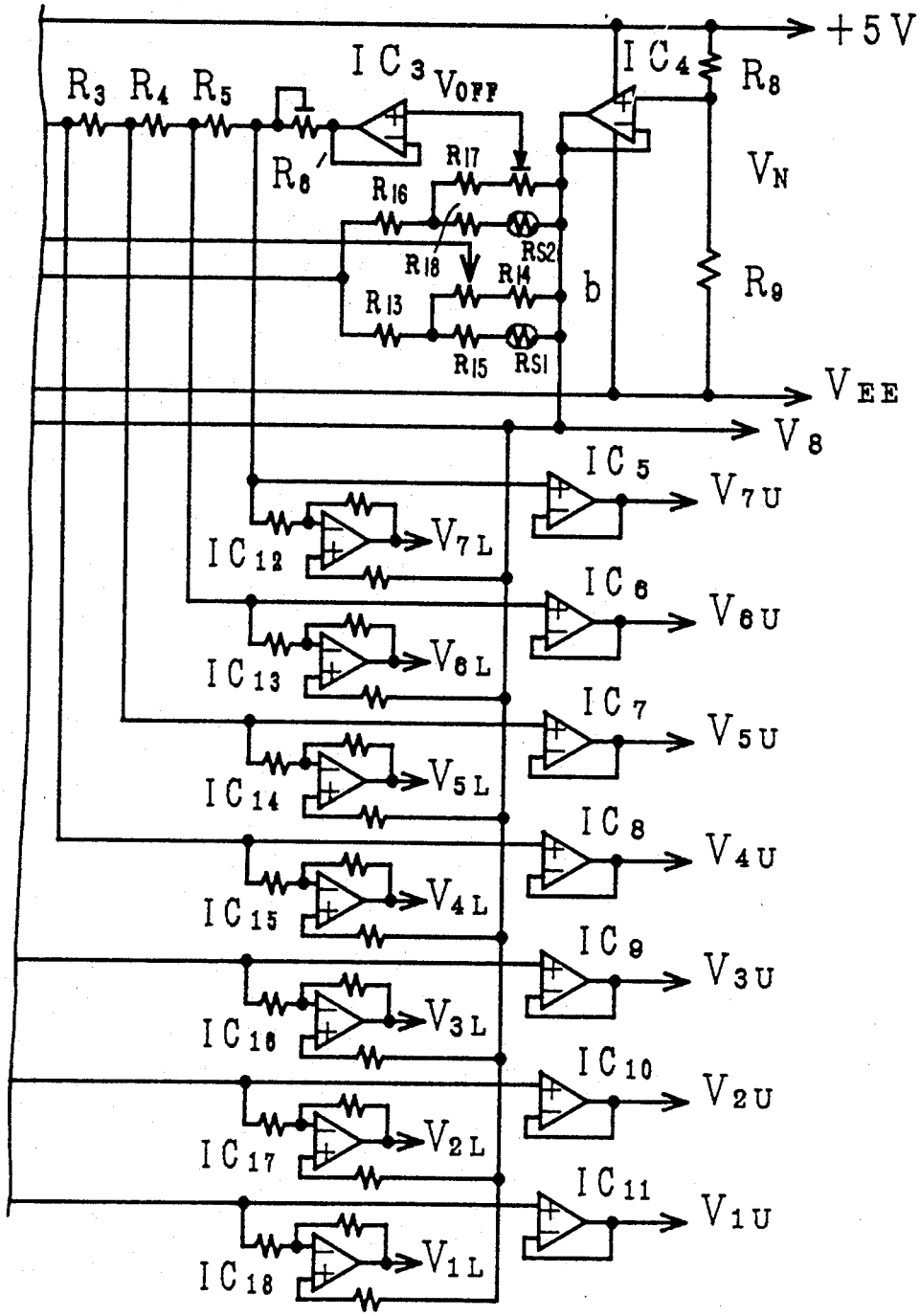

FIG. 28 is a circuit diagram showing one embodiment of the driving voltage generator including the correction voltage generator corresponding to the vertical observation angle difference of the aforementioned TFT panel.

The correction voltage waveform generator is exemplified by the correction voltage generator making use of the aforementioned integration circuit shown in FIG. 27. The saw-toothed correction voltage d generated by that correction voltage waveform generator is superposed through the resistor and the capacitor upon the linear correction voltage which has its DC component generated by the aforementioned observation angle correction voltage generator which is composed of the resistors $R_{13}$ to $R_{15}$ and the thermistor $R_{S1}$. Specifically, the aforementioned correction voltage d is superposed on the correction voltage $V_2$ corresponding to the 2nd scale and is fed to the input (+) of the buffer amplifier $IC_2$ having the voltage follower shape. As a result, the liquid crystal driving voltages $V_2$ to $V_7$ to be used for the actual half tone displays are dropped as the display positions go down to the lower level so that the aforementioned saw-toothed correction voltage d is superposed. Thus, the aforementioned observation angles can be dynamically corrected in synchronism with the vertical scanning timing of the liquid crystal.

The clock pulse CL1 inputted to the correction voltage generator of FIG. 28 is not used by the correction voltage generator which is constructed of the aforementioned linear circuit shown in FIG. 27.

Figure 29:
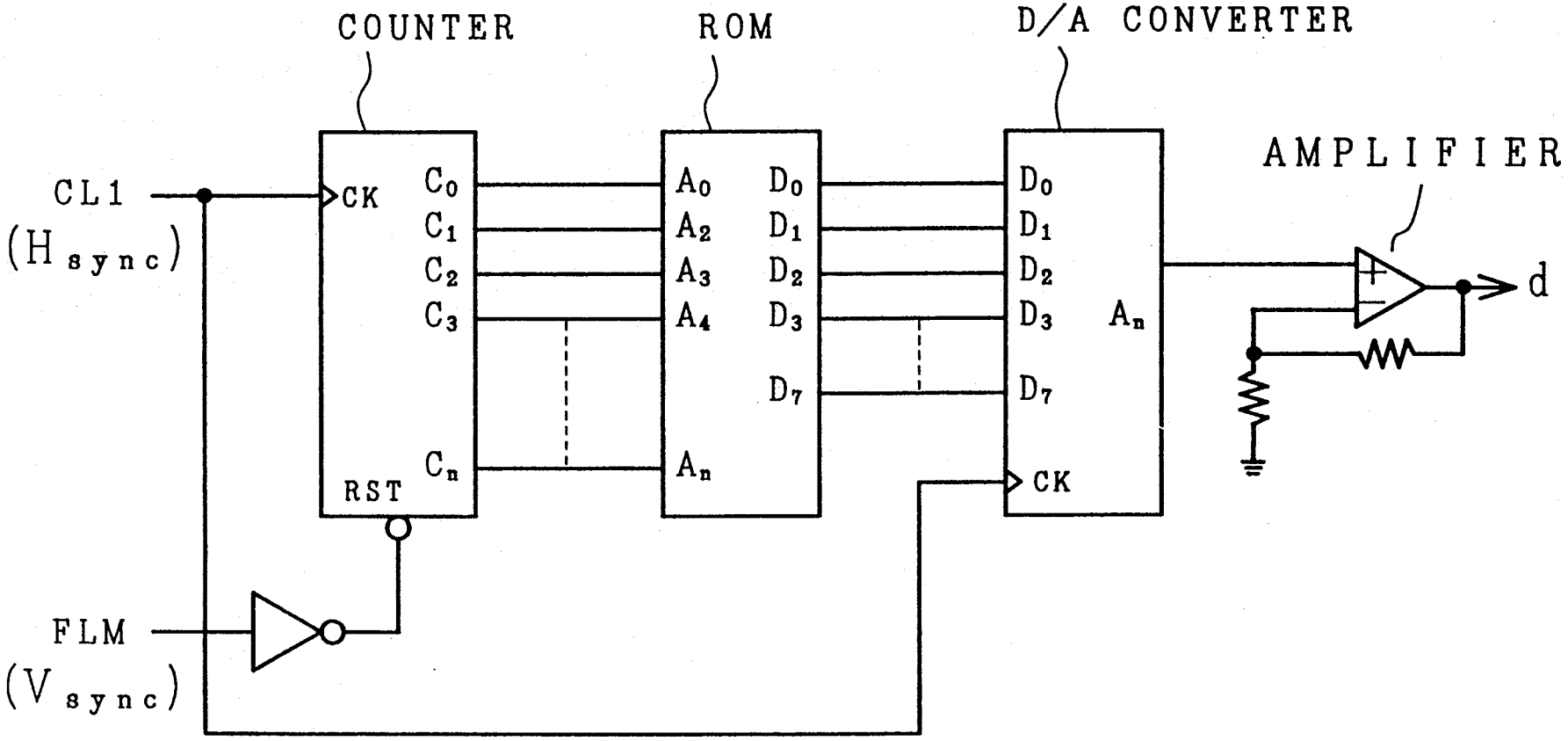
FIG. 29 is a block diagram showing another embodiment of the correcting voltage generator corresponding to the vertical angular difference of the TFT panel.
Figure 30:
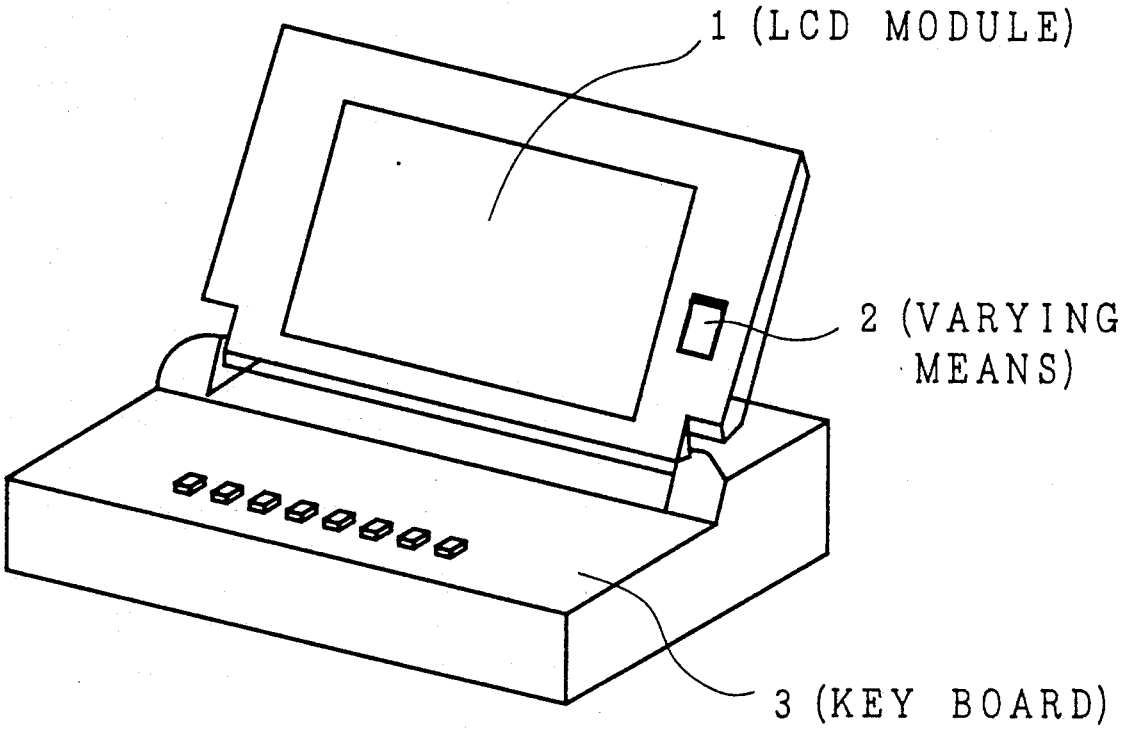
FIG. 30 is a schematic perspective view showing one embodiment of a laptop microcomputer using the half tone liquid crystal display circuit according to the present invention.
Figure 31:
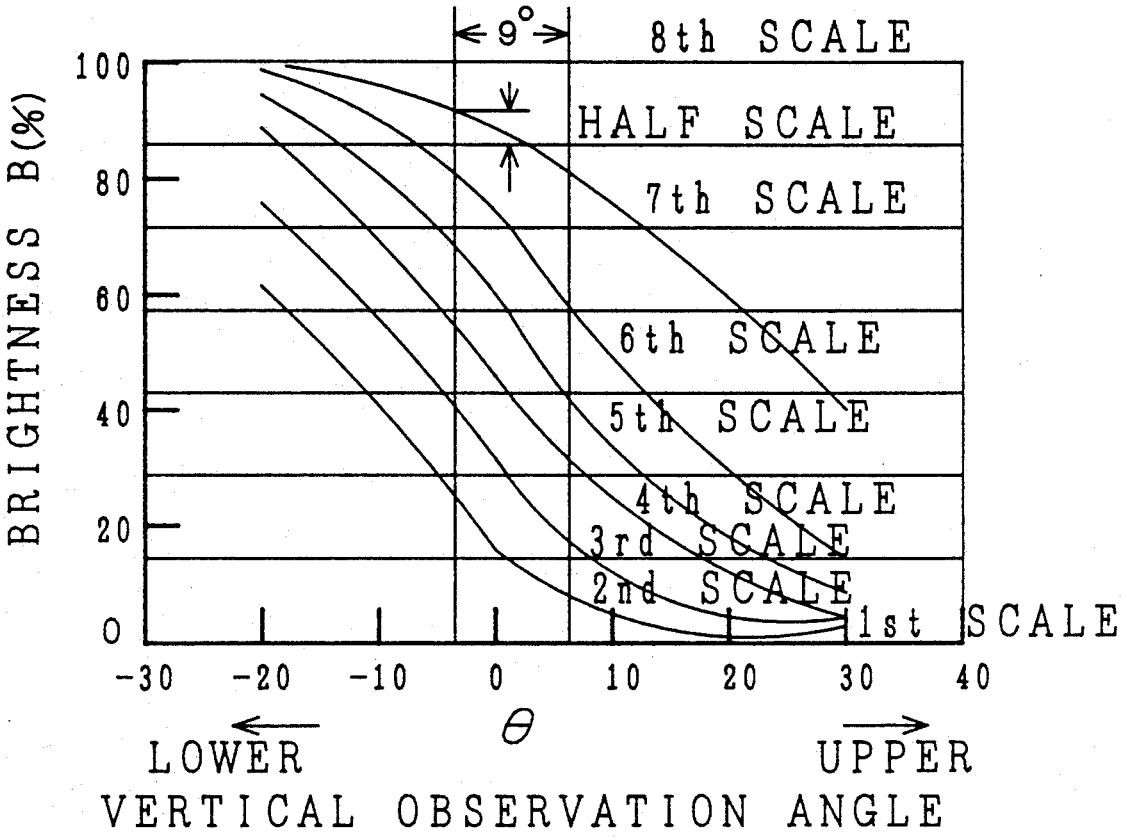
FIG. 31 is a characteristic diagram for explaining the observation angle range of the liquid crystal.

FIG. 29 is a block diagram showing another embodiment of the correction voltage generator corresponding to the vertical observation angle difference of the aforementioned TFT panel.

In this embodiment, digital circuit technology is utilized. A counter is a binary one for counting the clock pulses CL1 and has its reset terminal RST fed with the frame pulse FLM which is inverted by the inverter. As a result, the counter is reset for each frame. It could be understood that the counter counts the number of scanning lines of the TFT panel to be selected, from the aforementioned counting operations and resetting operations.

The counted outputs $C_0$ to $C_n$ of the aforementioned counter are inputted to a decoder composed of a ROM (i.e., Read Only Memory) so that they are converted into digital signals $D_0$ to $D_7$ corresponding to the addresses of the scanning lines. Specifically, the counted outputs are converted into 256 addresses by the aforementioned 8-bit signals. If the TFT panel has about 500 scanning lines, for example, the conversions are made such that one address is assigned to every two scanning lines or such that one address is assigned to every four 1,000 lines.

The 8-bit digital signals $D_0$ to $D_7$ thus converted by the aforementioned ROM are inputted to a digital-/analog converter (as will be shortly referred to as the "D/A converter"). This D/A converter fetches the input digital signals in synchronism with the aforementioned clock pulse CL1 and generates and outputs saw-toothed analog voltages corresponding to digital values like those described before. In these D/A conversions, what was generated is the saw-toothed voltage which has its voltage level dropped like the foregoing embodiment as the time elapses. Thus, it is sufficient to use a down counter for counting the clock pulses CL1 or to generate the aforementioned digital signals $D_0$ to $D_7$ by performing such decoding operations in the ROM as are varied from the maximum to the minimum.

The saw-toothed voltage signal obtained from the output AO of the aforementioned D/A converter is fed as the dynamic observation angle correction voltage d to the driving voltage generator like that described before through the amplifier using the operational amplifier. The aforementioned amplifier operates not only as a buffer amplifier but also for adjusting the observation angle correction dynamically by adjusting the gain of the buffer amplifier.

The method of setting the aforementioned observation angle correction may be accomplished by determining the correction voltages statically in the upper and lower portions and by generating the saw-toothed voltage having the difference voltage as its peak. Alternatively, the setting method may be accomplished by adjusting the gain of the amplifier for outputting the saw-toothed voltage while observing the display frame.

FIG. 15 is a schematic perspective view showing one embodiment of a laptop (or book type) microcomputer using the half tone liquid crystal display circuit according to the present invention.

The microcomputer of this embodiment uses a key board 3 as its body so that a liquid crystal module (as will be called the "half tone liquid crystal display circuit" in the following) 1 can be opened or closed by varying means 2. Specifically, the microcomputer is closed to have its half tone liquid crystal display circuit 1 superposed on the key board, when it is not used or carried. When, on the other hand, the microcomputer is to be used, the key board 3 or body and the half tone liquid crystal display circuit 1 are opened and set, as shown.

At this time, the light of the ceiling or the landscape outside of the window is frequently reflected, as the place may be, upon the display frame to make it difficult to read the therefor display. In this situation, it is the current practice to manipulate the varying means 2 to erect the half tone liquid crystal display circuit substantially upright, namely, to reduce the opening angle of the half tone liquid crystal display circuit so that the display frame may be observed from the upper side. At this time, the aforementioned observation angle adjusting volume can be manipulated to observe the display frame in the correct scale for monochromatic display and in the correct color tone for the color display.

Let it be assumed that the microcomputer is placed for use on a desk. Then, the varying means 2 for adjusting the opening angle of the half tone liquid crystal display circuit with respect to the aforementioned key board body 3 is equipped with an angle sensor so that the observation angle correction voltage may be automatically varied by the detected signal of the sensor. Thus, when the microcomputer is to be used by the designated operator, the observation angle correction can be automatically accomplished even at a different opening angle of the half tone liquid crystal display circuit 1, once the observation angle correction is performed by the aforementioned volume manipulation.

In the case, on the other hand, when the frame of the half tone liquid crystal display circuit 1 is large-sized, the aforementioned vertical observation angle may become different therefor causing variation of the scales or color tones. Despite this possibility, however, the display can always be achieved in the correct scales or color tones by accomplishing the aforementioned dynamic observation angle corrections.

According to the embodiments thus far described, the following effects can be attained:

(1) An approximate reference voltage is generated from a voltage which is approximately determined on the basis of a point of intersection of the extensions of straight lines along the gradients of brightness-voltage characteristics corresponding to at least two observation angles vertically different with respect to a liquid crystal display panel, and a voltage which is varied to correspond to said observation angles is generated. Driving voltages for the half tone displays, which are corrected by a divided voltage associated with said voltage are generated. The plural driving voltages for the half tones can be varied by the adjustment of one portion along the gradients of the brightness-voltage characteristics corresponding to those observation angles. As a result, there can be attained an effect that the tone displays for the vertical variations of the observation angles can be adjusted simply and; accurately.

(2) There is provided a correcting voltage waveform generator for generating a dynamic observation angle correcting voltage varied in association with a vertical scanning operation corresponding to the difference in the vertical observation angles of a liquid crystal display frame and the dynamic observation angle correcting voltage is transmitted to a voltage divider for generating the driving voltages for the half tone displays associated with the voltage varied to correspond to the aforementioned observation angle. The half tone driving voltages generated by said voltage divider from said dynamic observation angle correcting voltage are subjected to level modulations. Thus, there can be attained another effect that the observation angle can be automatically corrected to satisfy the large size of the frame.

(3) Since the aforementioned correction voltage generator is exemplified by the an integrated circuit for receiving the pulse signal generated for each frame, there can be attained another effect that the aforementioned dynamic observation angle corrections can be accomplished by a simple structure.

(4) The aforementioned correction voltage generator is composed of the counter circuit adapted to be reset for each frame for receiving the clock pulse corresponding to the scanning line selected; the decoder for converting the counted output of the counter into the observation angle correction voltage signal expressed in the binary form; and the D/A converter for generating the analog correction voltage wave form in response to the output signal of that decoder. As a result, there can be attained another effect that the observation correction can be accomplished finely and dynamically at accurate units of the scanning line.

Although our invention has been specifically described in connection with its embodiments, it should not be limited thereto but can naturally be modified in various manners without departing from the gist thereof. For example, the voltage at each scale need not be equally divided but may be given an offset if necessary. In other words, the voltage dividing ratio of the voltage dividing resistance circuit may be given with a slight discrepancy. The scales may be not only eight but also four. In case of the four scales, for example, the color display can have $4 \times 4 \times 4 = 64$ colors.

The circuit for generating the reference voltage or the temperature compensating voltage may be connected in series with the voltage divider for generating the half tone driving voltages. In this case, the voltage generator for the reference voltage and the temperature compensating voltage can be exemplified by a level shifter.

The dynamic observation angle correction voltage generator may generate the correction voltage midway of the vertically scanning operations, e.g., from the lower half of the frame. In this case, the timing pulses may be generated by the counter for counting the selection timings of the scanning lines and integrated by the integration circuit. This structure may be exemplified merely by varying the content of the decoder in case the counter, the decoder and the D/A converter are used.

The half tone liquid crystal display circuit may be utilized in a color TV receiver. Since, however, the aforementioned driving voltage generator is used, the video signals separated into the R, G and B components may be individually transformed into 3-bit digital signals. Since, in this case, the TV video signals are generated in the interlace mode, they may once be stored in the frame memory, so that the positive voltage with respect to the pixel may be written for the odd frames whereas the negative voltage may be written for the even frames.

Furthermore, the reference voltage and the observation angle correction voltage can also be utilized for writing an analog voltage in the liquid crystal. Specifically, the black level of the analog voltage may be adjusted with the observation angle correction voltage $V_K$ shown in FIG. 1 and the white level may correspond to the threshold voltage $V_{TH}$. In other words, the analog signal may have its amplitude varied with the aforementioned ranger of $V_K$ to $V_{TH}$. In this invention, the aforementioned analog signal is captured as one mode of the substantial scale display. In this case, the color tones with respect to the observation angle can be corrected easily are accurately. Moreover, the dynamic observation angle can likewise be accomplished by superposing the aforementioned saw-toothed voltage on the analog signal.

This invention can be widely utilized in the half tone liquid crystal display circuit.

The effects to be obtained from one embodiment of the invention disclosed herein will be briefly described in the following. The approximate reference voltage is generated from the voltage which is approximately determined on the basis of the point of intersection of the extensions of straight lines along the gradients of brightness-voltage characteristics corresponding to at least two observation angles vertically different with respect to the liquid crystal display panel and the voltage which is varied to correspond to said observation angles is generated. Driving voltages for the half tone displays which are corrected by the divided voltage associated with said voltage are generated. The plural driving voltages for the half tones can be varied by the adjustment of one portion along the gradients of the brightness-voltage voltage characteristics corresponding to those observation angles. As a result, there can be attained an effect that the tone displays for the vertical variations of the observation angles can be adjusted simply and accurately.

The effects to be obtained from a second embodiment of the invention disclosed herein will be briefly described in the following. The approximate reference voltage is generated from the voltage which is approximately determined on the basis of the point of intersection of the extensions of straight lines along the gradients of brightness-voltage characteristics corresponding to at least two observation angle vertically different with respect to the liquid crystal display panel and the voltage which is varied to correspond to said observation angles is generated. Driving voltages for the half tone displays which are corrected by the divided voltage associated with said voltage are generated. The plural driving voltages for the half tones can be varied by the adjustment of one portion along the gradients of the brightness-voltage characteristics corresponding to those observation angles. As a result, there can be attained an effect that the one displays for the vertical variations of the observation angles can be adjusted simply and, accurately. Moreover, the operating voltage having its polarity inverted in response to the AC conversion signal of the liquid crystal is fed through the switch circuit to the voltage divider for generating the half tone display driving voltages so that the AC driving voltages can be generated by the simple structure.

The effects to be obtained from the present invention disclosed herein will be briefly described in the following. An approximate reference voltage is generated from a voltage which is approximately determined on the basis of a point of intersection of the extensions of straight lines along the gradients of brightness-voltage characteristics corresponding to at least two observation angles vertically different with respect to a liquid crystal display panel and a voltage which is varied to correspond to said observation angles is generated. Driving voltages for the half tone displays which are corrected by a divided voltage associated with said voltage are generated. The pluraL driving voltages for the half tones can be varied by the adjustment of one portion along the gradients of the brightness-voltage characteristics corresponding to those observation angles. As a result, there can be attained an effect that the tone displays for the vertical variations of the observation angles can be adjusted simply and, accurately. Moreover, there is provided a correcting voltage waveform generator for generating a dynamic observation angle correcting voltage varied in association with a vertical scanning operation corresponding to the difference in the vertical observation angles of a liquid crystal display frame and the dynamic observation angle correcting voltage is transmitted to a voltage divider for generating the driving voltages for the half tone displays associated with the voltage varied to correspond to the aforementioned observation angle. The half tone driving voltages generated by said voltage divider from said dynamic observation angle correcting voltage are subjected to level modulations. Thus, there can be attained another effect that the observation angle can be automatically corrected to satisfy the large size of the frame.

We claim:

1. An observation angle correcting method in the half tone display of a liquid crystal, comprising the steps of: generating an approximate reference voltage from a voltage which is approximately determined on the basis of a point of intersection of the extensions of straight lines along the gradients of brightness-voltage characteristics corresponding to at least two observation angles vertically different with respect to a liquid crystal display panel; generating a voltage which is varied to correspond to said observation angles; and generating driving voltages for the half tone displays, which are corrected by a divided voltage associated with said voltage.

2. A half tone liquid crystal display circuit characterized: in that an approximate reference voltage is generated from a voltage which is approximately determined on the basis of a point of intersection of the extensions of straight lines along the gradients of brightness-voltage characteristics corresponding to at least two observation angles vertically different with respect to a liquid crystal display panel; in that a voltage varied to correspond to said observation angles is generated; and in that driving voltages for the half tone display are generated by a divided voltage associated with said voltage.

3. A half tone liquid crystal display circuit according to claim 2, wherein the driving voltages corresponding to maximum and minimum brightnesses for said half tone displays are independent of said divided voltage.

4. A half tone liquid crystal display circuit according to claim 2, wherein said driving voltages are fed to signal line electrodes to be connected with the drains of the TFT transistors.

5. A half tone liquid crystal display circuit according to claim 2, wherein said reference voltage is made adjustable.

6. A half tone liquid crystal display circuit according to claim 5, wherein the adjustable reference voltage is automatically varied by the output of a temperature compensator.

7. A half tone liquid crystal display circuit according to claim 2, wherein said divided voltage is generated on the basis of resistance elements connected in series.

8. A half tone liquid crystal display circuit according to claim 2, wherein the liquid crystal display panel having said TFT active matrix structure is enabled to perform multi-color display by providing color filters.

9. A half tone liquid crystal display circuit according to claim 2, wherein said half tone liquid crystal display circuit is used as a monitor for an electronic device packaging a microcomputer.

10. A half tone liquid crystal display circuit according to claim 2, further comprising a packaging substrate mounting thereon a voltage source circuit for generating the half tone driving voltages and being so arranged on the back of the liquid crystal display panel as to sandwich a back light inbetween.

11. A driving voltage generator for a half tone liquid crystal display circuit, comprising: a voltage divider for generating driving voltages for the half tone displays associated with a voltage varied to correspond to said observation angles by using as a reference voltage a voltage which is approximately determined on the basis of a point of intersection of the extensions of straight lines along the gradients of brightness-voltage characteristics corresponding to at least two observation angles vertically different with respect to a liquid crystal display panel having a TFT active matrix structure; and a switch circuit for feeding operating voltages having inverted polarities to a circuit for generating said reference voltage in accordance with a liquid crystal Ac conversion signal and a voltage dividing circuit.

12. A driving voltage generator according to claim 11, wherein the half tone driving voltages generated by said voltage dividing circuit are individually fed to a voltage follower circuit and an inverted amplifier for inverting the phase in response to said output voltage, and wherein the driving voltages having passed through said voltage follower circuit and said inverted amplifier are individually fed to the drivers which are vertically divided to correspond to the alternate signal lines of the liquid crystal.

13. A driving voltage generator according to claim 11, wherein said voltage dividing circuit is composed of two voltage dividers, of which one is fed through said switch circuit with the operating voltage having its polarity inverted in accordance with an AC conversion signal whereas the other is fed with the operating voltage through a polarity inverting amplifier, and wherein the voltage-divided output voltages of said two voltage dividers are individually fed through said voltage follower circuits to the drivers which are vertically divided to correspond to the alternate signals of the liquid crystal panel.

14. A driving voltage generator according to claim 11, wherein said reference voltage is automatically subjected to a temperature compensation by a temperature compensator corresponding to the temperature dependency thereof.

15. A driving voltage generator according to claim 1, wherein said voltage dividing circuit is fed through a buffer amplifier of low output impedance with the operating voltage which have been subjected to the observation angle correction and the temperature compensation.

16. A driving voltage generator according to claim 11, wherein the voltage having passed through said switch circuit for generating said liquid crystal AC conversion driving voltage is fed to a level shifter for generating a bilateral level shift voltage matching the effective threshold voltage of the TFT transistor, to generate the maximum driving voltage at an absolute value to be fed to the signal lines of the liquid crystal through said level shifter.

17. A driving voltage generator according to claim 11, wherein the voltage having its polarity switched through the switch circuit, which has its switching controlled by the AC conversion signal of said liquid crystal, is fed to the observation angle correcting or temperature compensation voltage generator, so that the generated voltage is fed through a buffer amplifier of low output impedance to the voltage dividing circuit for generating the half tone driving voltage.

18. A half tone liquid crystal display circuit, comprising: a voltage divider for using as a reference voltage a voltage which is approximately determined on the basis of a point of intersection of the extensions of straight lines along the gradients of brightness-voltage characteristics corresponding to at least two observation angles vertically different with respect to a liquid crystal display panel having a TFT active matrix structure, to generate driving voltages for the half tone displays associated with a voltage varied to correspond to said observation angles are generated; and a correcting voltage waveform generator for generating a dynamic observation angle correcting voltage varied in association with a vertical scanning operation corresponding to the difference in the vertical observation angles of a liquid crystal display frame, wherein the half tone driving voltages generated by said voltage divider from said dynamic observation angle correcting voltage are subjected to level modulations.

19. A half tone liquid crystal display circuit according to claim 18, wherein said voltage divider is fed with said dynamic observation angle correction voltages through a coupling capacitor.

20. A half tone liquid crystal display circuit according to claim 18, wherein said correcting voltage waveform generator includes an integrator for receiving a pulse signal generated for each frame.

21. A half tone liquid crystal display circuit according to claim 18, wherein said correcting voltage waveform generator includes: a counter adapted to be reset for each frame and to receive a clock pulse corresponding to the scanning line selected; a decoder for converting the counted output of said counter into the observation angle correction voltage signals in a binary form; and a D/A converter for generating an analog correction voltage waveform in response to the output signal of said decoder.

22. A half tone liquid crystal display device comprising:

a display panel having a first and a second set of lines;

a first driver means for driving said first set of lines;

a second driver means for driving said second set of lines;

a driving voltage generator means for generating a driving voltage for said second driver means; and wherein said driving voltage generator means comprises a correction voltage generator means for generating a correction voltage; and said correction voltage drops after a lapse of time so observation angles of said display panel are dynamically corrected in synchronism with the vertical scanning timing of said display panel.

23. A half tone liquid crystal display device according to claim 22 wherein said driving voltage generator means further comprises:

a first and second voltage varying means and a plurality of resistors; and wherein, said plurality of resistors are connected serially between said first and second voltage varying means.

24. A half tone liquid crystal display device according to claim 23 wherein:

said display panel is a thin film transistor display panel;

said first set of lines are gate lines; and said second set of lines are drain lines.

25. A half tone liquid crystal display device according to claim 24 wherein:

said correction voltage generator means comprises a resistor and a capacitor.

26. A half tone liquid crystal display device according to claim 24 wherein:

a plurality of half tone driving voltages are outputted from nodes of said serially connected plurality of resistors.

27. A half tone liquid crystal display device according to claim 23 wherein:

a plurality of half tone driving voltages are outputted from nodes of said serially connected plurality of resistors.

28. A half liquid crystal display device according to claim 22 wherein:

said display panel is a thin film transistor display panel;

said first set of lines are gate lines; and said second set of lines are drain lines.

29. A half tone liquid crystal display device according to claim 22 wherein:

said correction voltage generator means comprises a resistor and a capacitor.

30. A half tone liquid crystal display device according to claim 22 wherein:

said correction voltage generator means comprises a resistor, a capacitor and an operational amplifier.

* * * * *